US011857003B2

(12) United States Patent
Bailey et al.

(10) Patent No.: US 11,857,003 B2
(45) Date of Patent: Jan. 2, 2024

(54) APPAREL THERMO-REGULATORY SYSTEM

(71) Applicant: NIKE, Inc., Beaverton, OR (US)

(72) Inventors: Collin Bailey, Milwaukie, OR (US); Kim D. Baschak, Portland, OR (US); Olivia A. Echols, Portland, OR (US); Stacey L. Hansen, Portland, OR (US); Lucas Hartman, Beaverton, OR (US); Rebecca P. Hurd, Tigard, OR (US); Adam Parkinson, Portland, OR (US); Shannon K. Redell, Beaverton, OR (US); David Sagan, Lake Oswego, OR (US); Susan L. Sokolowski, Portland, OR (US); Stuart B. Brown, Needham, MA (US); Matthew J. Hancock, Needham, MA (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 17/699,922

(22) Filed: Mar. 21, 2022

(65) Prior Publication Data

US 2022/0202113 A1 Jun. 30, 2022

Related U.S. Application Data

(63) Continuation of application No. 15/606,308, filed on May 26, 2017, now Pat. No. 11,330,851.
(Continued)

(51) Int. Cl.
*A41D 13/00* (2006.01)
*A41D 27/28* (2006.01)
(Continued)

(52) U.S. Cl.
CPC ..... *A41D 13/0015* (2013.01); *A41D 13/002* (2013.01); *A41D 27/28* (2013.01);
(Continued)

(58) Field of Classification Search
CPC . A41D 31/06; A41D 13/0053; A61F 13/0253; A43B 23/0235; D04B 21/207
See application file for complete search history.

(56) References Cited

U.S. PATENT DOCUMENTS 6,401,250 B1 6/2002 Mcnabb
10,492,550 B2 12/2019 Blakely et al.
(Continued)

FOREIGN PATENT DOCUMENTS

CN 1571871 A 1/2005
CN 101517155 A 8/2009
(Continued)

OTHER PUBLICATIONS

Office Action received for European Patent Application No. 17728033.6, dated Aug. 16, 2022, 4 pages.

*Primary Examiner* — Dah-Wei D. Yuan
*Assistant Examiner* — Andrew J Bowman
(74) *Attorney, Agent, or Firm* — SHOOK, HARDY & BACON L.L.P.

(57) ABSTRACT

Aspects herein are directed to an apparel item that promotes thermo-regulation through the use of engineered openings, venting, and/or stand-off structures. In exemplary aspects, 20-45% of the apparel item may comprise the engineered openings. Vents may be positioned on the apparel item in areas that experience high amounts of air flow to help channel air into the apparel item. The stand-off structures may be positioned on an inner-facing surface of the apparel item where they help to create a space between the apparel item and the wearer's body surface in which air can flow and help cool the wearer by promoting evaporative cooling.

5 Claims, 36 Drawing Sheets

Related U.S. Application Data

(60) Provisional application No. 62/429,505, filed on Dec. 2, 2016, provisional application No. 62/343,540, filed on May 31, 2016.

(51) Int. Cl.
*A41D 13/002* (2006.01)
*A41D 31/14* (2019.01)
*A41D 31/18* (2019.01)

(52) U.S. Cl.
CPC ..... *A41D 27/285* (2013.01); *A41D 31/145* (2019.02); *A41D 31/185* (2019.02); *A41D 2400/10* (2013.01); *A41D 2500/10* (2013.01); *A41D 2500/20* (2013.01)

(56) References Cited

U.S. PATENT DOCUMENTS

| | | | | |
|---|---|---|---|---|
| 2004/0034307 | A1 | 2/2004 | Johnson et al. | |
| 2005/0204449 | A1 | 9/2005 | Baron et al. | |
| 2006/0080754 | A1 | 4/2006 | Baron et al. | |
| 2008/0014408 | A1 | 1/2008 | Muth et al. | |
| 2011/0239350 | A1 | 10/2011 | Ho et al. | |
| 2012/0137411 | A1* | 6/2012 | Majoros | A41D 13/0053 138/118 |
| 2014/0024989 | A1* | 1/2014 | Ueda | A61F 13/0253 602/44 |
| 2014/0053311 | A1 | 2/2014 | Nordstrom et al. | |
| 2015/0223533 | A1* | 8/2015 | Blakely | A41D 31/06 428/196 |
| 2017/0340037 | A1 | 11/2017 | Bailey et al. | |

FOREIGN PATENT DOCUMENTS

| | | | |
|---|---|---|---|
| CN | 103687988 | A | 3/2014 |
| KR | 20040034307 | A | 4/2004 |
| KR | 20040042073 | A | 5/2004 |
| WO | 1997007899 | | 3/1997 |
| WO | 03041525 | A1 | 5/2003 |
| WO | 2007143980 | A1 | 12/2007 |

* cited by examiner

APPAREL THERMO-REGULATORY SYSTEM

CROSS-REFERENCE TO RELATED APPLICATIONS

This continuation application entitled "Apparel Thermo-Regulatory System," is a continuation application of U.S. Non-Provisional application Ser. No. 15/606,308, filed on May 26, 2017, and entitled "Apparel Thermo-Regulatory System" which claims the benefit of priority of U.S. Prov. App. No. 62/343,540, filed May 31, 2016 and entitled "Apparel Thermo-Regulatory System, and U.S. Prov. App. No. 62/429,505, filed Dec. 2, 2016 and entitled "Apparel Thermo-Regulatory System." The entireties of the aforementioned applications are incorporated by reference herein.

TECHNICAL FIELD

Aspects herein relate to an apparel item configured to promote thermo-regulation.

BACKGROUND

Traditional athletic apparel items may be configured to either provide insulation or help dissipate heat, but are rarely configured to achieve both of these features. Thus, they are often limited to a specific environmental condition (e.g., hot weather or cold weather). Moreover, when configured to help dissipate heat, the amount of heat dissipated is often inadequate to maintain the athlete in optimal temperature ranges.

SUMMARY

Aspects herein relate to an apparel item comprising at least one textile material having at least one opening defined by at least a first edge and a second edge; and at least one elastically resilient trim piece positioned within the opening to maintain the opening in an open state, wherein the elastically resilient trim piece is coupled to at least the first edge of the opening. The opening is formed by incising the at least one textile material, and the opening allows for airflow between an inner surface and an outer surface of the apparel item. The trim piece comprises an arched shape which aids in maintaining the opening in the open state.

Aspects herein further relate to a method of forming an apparel item comprising providing a textile material, forming a plurality of textile segments on at least a portion of the textile material, twisting at least one of the plurality of textile segments, securing the at least one twisted textile segment such that it is maintained in a twisted state and forming the apparel item from the textile material, wherein the apparel item is formed from the textile material such that the twisted textile segment is located in an area of the apparel item subject to a higher amount of air flow or air pressure as compared to other areas of the apparel item. At least one of the plurality of textile segments is formed by incising the textile material. The plurality of textile segments facilitate airflow between an inner surface and an outer surface of the apparel item. Twisting the at least one of the plurality of textile segments comprises disengaging a first end of the textile segment from the textile material, twisting the textile segment; and re-engaging the first end of the textile segment to the textile material. Securing the at least one twisted textile segment such that it is maintained in a twisted state comprises affixing the textile segment to a second textile material positioned adjacent to a first surface of the textile material, wherein the second textile material comprises a non-stretch material. The plurality of textile segments facilitate airflow between an inner surface and an outer surface of the apparel item.

Aspects herein relate to an apparel item comprising a first textile material comprising a first surface and a second surface opposite the first surface, the first textile material further comprising a flap that has a perimeter shape defined by a first edge, a second edge opposite to the first edge, a first end affixed to the first textile material and a second end opposite the first end and affixed to the first textile material; and a second textile material positioned adjacent to the first surface of the first textile material, wherein the first edge of the flap is affixed to the second textile material. The second textile material is a non-stretch material. The attachment of the first edge of the flap to the second textile material maintains the flap in an open state. The first surface is an inner-facing surface of the apparel item. The second surface is an outer-facing surface of the apparel item.

Aspects herein relate to a method of creating tension deformation on a textile material, the method comprising providing a textile material, applying tension in one or more directions to the textile material; and applying a surface treatment to one or more portions of the textile material while the textile material is under tension. The surface treatment applied is one or more of a silicone, a thermoplastic polyurethane, a polyurethane, or a polyurethane resin ink. The tension is applied to the textile material in an x-direction and a y-direction. The tension is applied to the textile material in an x-direction or a y-direction. The method further comprises curing the surface treatment while the textile material is under tension. The method further comprises releasing the tension applied to the textile material. The method further comprises, subsequent to releasing the tension, forming one or more openings in the textile material at locations corresponding to where the surface treatment was applied. The method further comprises applying steam to the textile material after the tension is released. The textile material is positioned on a tension-maintaining apparatus, and the tension-maintaining apparatus is configured to apply the tension to the textile material. The tension-maintaining apparatus is configured to allow for registration between locations where the surface treatment is applied to the textile material and locations where the one or more openings in the textile material are formed. The surface treatment is applied to the textile material in a variable pattern. The surface treatment is applied to the textile material in a repeating pattern. More than one layer of the surface treatment is applied to the one or more portions of the textile material.

Aspects herein further comprise a method of creating tension deformation on a textile material, the method comprising providing a textile material having a first surface and a second surface opposite the first surface; applying a first tension to the first surface of the textile material and applying a second tension to the second surface of the textile material, the second tension being less than the first tension, wherein the first and second tensions are applied in the same direction; and applying a surface treatment to the textile material while the textile material is in the tensioned state. The first tension and second tension are applied by rollers. The method further comprises curing the surface treatment while the textile material is under tension. The method further comprises forming one or more openings in the textile material at locations corresponding to where the surface treatment was applied.

Aspects herein further comprise an apparel item comprising a textile material having a first portion and a second portion, wherein the first portion is maintained in a tensioned state via the application of a surface treatment and wherein the second portion is maintained in a tension-free resting state. The textile material comprises a woven material. The textile material comprises a knit material. The first portion is maintained between 110-160% stretch when in the tensioned state. The surface treatment comprises a cooling agent. The surface treatment is applied to a first surface of the textile material. The first surface comprises one of an inner-facing surface or an outer-facing surface of the apparel item. The first portion and the second portion are positioned adjacent to each other. Standoff structures are created by positioning the first portion adjacent to the second portion. The standoff structures are located on an inner-facing surface or an outer-facing surface of the apparel item. The standoff structures extend in a z-direction with respect to a surface plane of the apparel item.

Aspects herein relate to an apparel item comprising at least one textile element having a plurality of openings extending therethrough such that between 20% to 45% of the surface area of the apparel item comprises the plurality of openings; and one or more stand-off structures located on an inner-facing surface of the apparel item and extending in a z-direction with respect to the surface plane of the apparel item, at least a portion of the plurality of stand-off structures having a height between 2.5 mm and 6 mm. The apparel item comprises an apparel item for an upper torso of a wearer. The plurality of openings are closed when the textile element is in a resting state, and wherein the plurality of openings are open when one or more tensioning forces are applied to the textile element. At least a portion of the plurality of openings are formed by mechanically incising the at least one textile element. The at least one textile element is formed using stimulus-responsive yarns. At least a portion of the plurality of openings are formed by applying a stimulus to the stimulus-responsive yarns such that the stimulus-responsive yarns dissolve. The at least one textile element comprises one or more of a front panel or a back panel of the apparel item. The at least one textile element comprises at least one trim piece. The trim piece comprises a monofilament tape. The trim piece comprises a tubular structure formed using monofilament strands and having a hollow core. The trim piece comprises a first edge; a second edge; and a panel of material interposed between the first edge and the second edge, wherein the panel of material comprises the plurality of openings. The at least one textile element is configured to have a plurality of folds, and wherein the plurality of openings are positioned between the plurality of folds. The one or more stand-off structures comprise a monofilament tape. The monofilament tape comprises a first tape edge; a second tape edge; and a plurality of monofilament strands interposed between the first tape edge and the second tape edge. The monofilament tape is incorporated into the apparel item such that the monofilament strands are in a non-planar relationship with the first and second tape edges and are in a non-planar relationship with a surface plane of the apparel item. The one or more stand-off structures comprise a tubular structure formed using monofilament strands and having a hollow core. The tubular structure is incorporated into a seam on the apparel item. The tubular structure is incorporated into a channel formed on the apparel item. The one or more stand-off structures comprise a seam formed between a first panel edge and a second panel edge of the apparel item, wherein the seam extends in a z-direction with respect to the surface plane of the apparel item. The one or more stand-off structures comprise one or more folds in material used to form the apparel item, wherein the one or more folds extend in a z-direction with respect to the surface plane of the apparel item. At least a portion of the apparel item is formed from one or more moldable yarns, and wherein the portion of the apparel item formed from the moldable yarns is molded to form a structure comprising at least one set of projections that extend in a z-direction with respect to the surface plane of the apparel item. The one or more stand-off structures comprise yarns that have been mechanically manipulated to form nodes that extend in a z-direction with respect to the surface plane of the apparel item. The one or more stand-off structures comprise stimulus-responsive yarns that elongate in a z-direction with respect to the surface plane of the apparel item. The one or more stand-off structures comprise a polyurethane material, a foam material, a thermoplastic polyurethane material, a silicone material, or a rubber material that is applied to the inner-facing surface of the apparel item.

BRIEF DESCRIPTION OF THE DRAWINGS

The present invention is described in detail below with reference to the attached drawing figures, wherein.

DETAILED DESCRIPTION

Figure 2:
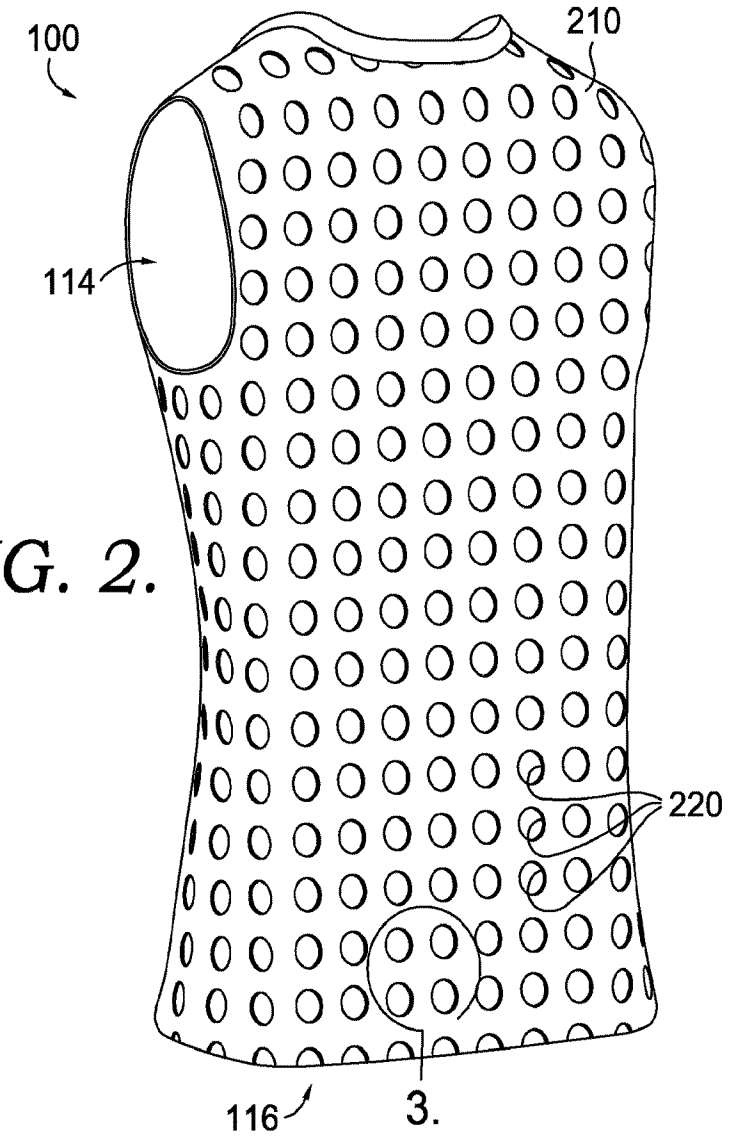
FIG. 2 illustrates a back perspective view of the exemplary vented apparel item of FIG. 1 in accordance with aspects herein.

The subject matter of the present invention is described with specificity herein to meet statutory requirements. However, the description itself is not intended to limit the scope of this disclosure. Rather, the inventors have contemplated that the disclosed or claimed subject matter might also be embodied in other ways, to include different steps or combinations of steps similar to the ones described in this document, in conjunction with other present or future technologies. Moreover, although the terms "step" and/or "block" might be used herein to connote different elements of methods employed, the terms should not be interpreted as implying any particular order among or between various steps herein disclosed unless and except when the order of individual steps is explicitly stated.

Aspects herein are directed to an apparel item having integrated features and/or structures that are configured to promote thermo-regulation over a wide range of environmental conditions. As such, the apparel item described herein is well-suited for athletes who often train in diverse weather conditions. One way of realizing thermo-regulation is by promoting heat retention during rest and/or cooler conditions and optimizing the amount of evaporative heat transfer experienced by the wearer (e.g., the removal of heat due to evaporation of sweat on the wearer's skin) during exercise and/or during hot conditions. In exemplary aspects, evaporative heat transfer may be optimized by utilizing features and/or structures to achieve a predefined level of "openness" or permeability in the apparel item, utilizing venting structures that are strategically located on the apparel item to optimize opportunities for capturing and funneling air into the apparel item, and/or utilizing features and/or structures to create a predefined level of stand-off between the apparel item and the wearer's body surface so that air can effectively circulate.

Continuing, to help promote heat retention during rest and/or cooler conditions, some or all of the features and/or structures described herein may be configured to transition from a first active state to a second resting state when the wearer is no longer active to help the wearer retain body heat. In one example, openings or perforations in the apparel item may transition from an open state to a closed state to decrease the percent openness of the apparel item. Venting structures may transition from an open state to a closed state to decrease the amount of air entering the apparel item. In yet another example, the amount of stand-off produced by structures described herein may decrease. The transitions described may occur in response to, for instance, a drop in body temperature or a decrease in perspiration, and/or in response to a decrease in wearer movement.

As used throughout this disclosure, the term "openness" may comprise the percentage of surface area of an apparel item that is comprised of engineered perforations or openings excluding, for instance, sleeve openings, a neckline opening, and a waist opening when the apparel item is in the form of a top, and leg openings and a waist opening when the apparel item is in the form of a short or pant. In exemplary aspects, apparel items described herein may be configured to have an openness between, for instance, 20% to 45% although values above and below these are contemplated. By having a predetermined amount of openness created by utilizing features and structures described herein, a large volume of air can enter and leave the apparel item thereby helping to promote evaporative heat transfer. For instance, the percent openness of the apparel item may be configured to achieve an air permeability in the range of 100 cubic feet per minute (CFM) to 1200 CFM, 300 CFM to 1100 CFM, or 600 CFM to 1000 CFM as measured at 125 Pa, although levels of air permeability above and below these values are contemplated herein. For instance, a lower level of air permeability may be desired when the apparel item is to be used in cooler weather conditions. On the other hand, when the apparel item is configured for warm weather conditions or intense training, it may be desirable to achieve a level of openness that is generally mimics that achieved by a wearer not wearing an apparel item (i.e., the wearer in a nude condition).

The term stand-off as used herein relates to features and/or structures located on an inner-facing of the apparel item that extend in the z-direction with respect to the inner-facing surface of the apparel item towards a wearer's body surface when the apparel item is worn. To put it another way, the stand-off features and/or structures help to space apart the inner-facing surface of the apparel item from the wearer's body surface to create a predetermined volume of space through which air can circulate and help cool the wearer by promoting, for instance, evaporative heat transfer. To be effective in promoting evaporative heat transfer, the amount of stand-off may be between, for instance, 2.5 mm and 7 mm or between 4 mm and 6 mm. Moreover, to help achieve adequate heat dissipation, it is contemplated herein, that stand-off features or structures may comprise at least 20%, 30%, 40%, 50%, 60%, 70% or 80% of the inner-facing surface of the apparel item.

As used throughout this disclosure, the term "vent" or "venting structure" implies some type of opening extending from an inner-facing surface of the apparel item to an outer-facing surface of the apparel item that forms a fluid communication path between an environment outside of the apparel item and an environment internal to the apparel item. It may also mean a specific configuration optimized to capture air flowing over the apparel item. For example, venting structures described herein may assume a "scoop-like" shape that helps to trap air traveling over the apparel item. The venting structures may be strategically positioned on the apparel item based on, for instance, air flow maps and/or air pressure maps of the human body. By strategically positioning the venting structures, the opportunities to catch and funnel air into the apparel item are optimized. For example, the venting structures may be located on the front and back surfaces of the apparel item where they can act as inflow vents. These areas are typically associated with high amounts of air flow and/or experience greater air pressure as indicated by air flow maps and/or air pressure maps of the human body. The venting structures may also be located on the sides of the apparel item and/or at the shoulder areas of the apparel item where they can act as outflow vents. These areas are typically associated with lower amounts of air flow and/or experience less air pressure as indicated by air flow maps and/or air pressure maps.

Accordingly, aspects herein are directed to an apparel item comprising at least one textile element having a plurality of openings extending therethrough such that between 20% to 45% of the surface area of the textile element comprises the plurality of openings, and one or more stand-off structures located on an inner-facing surface of the apparel item and extending in a z-direction with respect to the surface plane of the apparel item, where at least a portion of the plurality of stand-off structures having a height between 2.5 mm and 6 mm.

As used throughout this disclosure, the term "apparel item" is meant to encompass any number of different articles worn by an athlete during training such as, for example, shirts, pants, vests, hats, socks, jackets, and the like. Further, directional terms as used throughout this disclosure such as upper, lower, superior inferior, lateral, medial, and the like are generally used with respect to the apparel item being in an as-worn configuration by a hypothetical wearer standing in anatomical position. When describing features such as stand-off, the surface plane of the apparel item is assumed to be generally along an x, y plane such that the stand-off occurs in a positive or negative z-direction with respect to the x, y plane.

Continuing, unless indicated otherwise, terms such as "affixed," "secured," "coupled," and the like may mean releasably-affixed or permanently secured and may encompass known affixing technologies such as stitching, bonding, snaps, buttons, hooks, zippers, hook-and-loop fasteners, welding, use of adhesives, and the like. The term "trim piece" as used herein may comprise any structure that is incorporated into the exemplary apparel items described herein. For example, a trim piece may comprise a structure that is formed in a manufacturing process that is separate from that used to form the apparel item, and then is incorporated into the apparel item.

The apparel items described herein may be formed of knitted, woven, or non-woven fabrics. Additionally, as used throughout this disclosure, the term "textile material" means any knitted, woven, or non-woven textile or cloth consisting of a network of natural or artificial fibers. The textile material may be formed by weaving, knitting, crocheting, knotting, felting, braiding, and the like. The term "textile segment" as used herein may comprise any portion of the textile material that has been partially incised from the textile material but yet retains some type of connection to the textile material. For example, a textile segment may be partially incised from the textile material such that one or more portions of the textile segment remain attached to the textile material.

Additionally, apparel items described herein may incorporate one or more trim pieces. In some exemplary aspects, the entirety of an apparel item, or portions thereof, may be formed of fabrics that exhibit a high degree of air permeability (e.g., fabrics having cubic feet/meter (CFM) values or ratings of 100 or above) to facilitate the movement of air in and out of the apparel item. It is also contemplated, that the entirety of an apparel item, or portions thereof, may be formed of fabrics that may exhibit low air-permeability characteristics (e.g., fabrics having CFM values or ratings of 100 or below). By forming the apparel item (or portions thereof) of a fabric(s) having low air-permeability characteristics, ambient air that is funneled into the apparel item may be retained in the apparel item for longer periods of time. This, in turn, may promote, for instance, increased opportunities for evaporative heat transfer. Any and all aspects, and any variation thereof, are contemplated as being within the scope herein.

Additionally, the entirety of the apparel items described herein, or one or more portions of the apparel item may be formed of fabrics exhibiting moisture-management properties (i.e., a fabric that has the ability to transport moisture from an inner-facing surface of the fabric to an outer-facing surface of the fabric where it can evaporate). Alternatively, the entirety of the apparel item or one or more portions thereof may be formed in whole or in part from yarns that exhibit low rates of water/sweat absorption such as, for example, polyester yarns. By using yarns that exhibit low rates of water/sweat absorption, the wearer's perspiration is more likely to remain on the wearer's skin surface which can lead to a greater evaporative heat transfer when air circulates in the stand-off space between the inner-facing surface of the apparel item and the wearer's skin surface. Any and all aspects, and any variation thereof, are contemplated as being within the scope herein.

Features and/or structures that help to contribute to the openness, venting and/or stand-off of the exemplary apparel items described herein will be described below under their own headings. However, although described separately, it is to be understood that some or all of the features and/or structures described herein may work in combination with each other to help achieve a desired level of openness, venting, and/or stand-off.

Engineered Perforations

Exemplary apparel items described herein may utilize engineered perforations to achieve a predetermined level of openness and/or to act as venting structures. As opposed to more traditional mesh-like fabrics where the openings or perforations are formed through the actual knitting (or weaving) process (e.g., openings created by loosely knitting or weaving a material), engineered perforations may be formed by, for instance removing portions of the apparel item to create perforations. In some instances, this may occur by mechanically incising the material forming the apparel item to create perforations, or by utilizing melt-away or dissolvable yarns to create the perforations, and the like. Engineering the perforations as described enables the creation of a larger number of perforations and/or larger-diameter perforations as well as the ability to strategically locate the perforations on the apparel item. This is opposed to traditional mesh-like fabrics where the size, location, and potentially the number of the mesh openings are limited by typical knitting or weaving processes.

Figure 1:
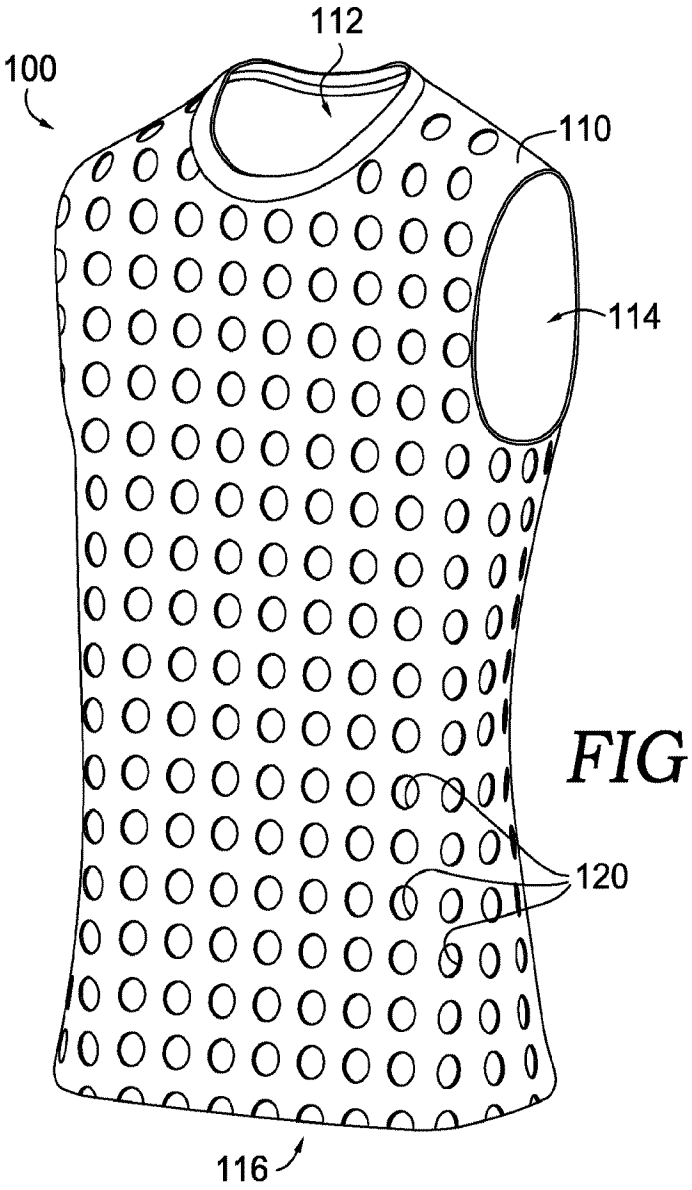
FIG. 1 illustrates a front perspective view of an exemplary vented apparel item having engineered perforations in accordance with aspects herein.

Turning now to FIG. 1, a front perspective view of an exemplary apparel item 100 configured to promote thermoregulation is illustrated in accordance with aspects herein. In exemplary aspects, the apparel item 100 may comprise at least a front panel 110 and a back panel (shown in FIG. 2 as indicated by reference numeral 210), that together help to define at least in part a neckline opening 112, a right sleeve opening (not shown because of the perspective view), a left sleeve opening 114, and a waist opening 116. The vented apparel item 100 may further comprise optional sleeve portions (not shown). Although the apparel item 100 is described as having a front panel 110 and a back panel 210, it is contemplated herein that the apparel item 100 may be formed from a unitary panel (e.g., through a circular knitting, flat knitting, or weaving process) or from one or more additional panels affixed together at one or more seams.

Although the apparel item 100 is depicted as a sleeveless shirt, it is contemplated that the apparel item 100 may take the form of a shirt with cap or one-quarter sleeves, a shirt having full-lengths sleeves, three-quarter sleeves, a jacket, a hoodie, a zip-up shirt or jacket, pants, shorts, socks, a hat, and the like. Any and all aspects, and any variation thereof, are contemplated as being within the scope herein. The description of the apparel item 100 regarding, for instance, the optional sleeve portions, the sleeve openings, the neckline and waist openings, and the different configurations (jacket, sock, hat, etc.) is equally applicable to the other apparel items described herein.

As shown in FIG. 1, the apparel item 100 comprises a plurality of perforations 120 that extend through the thickness of the front panel 110 such that they form a fluid communication path between the environment outside the apparel item 100 and the interior of the apparel item 100 (as used throughout this disclosure, the term "fluid" may comprise air, gases, liquids, and the like). In exemplary aspects, the perforations 120 may comprise generally at least 1% up to at least 60% of the surface area of the front panel 110 although it is contemplated herein that the perforations 120 may comprise more than 60% of the surface area of the front panel 110. In one exemplary aspect, the perforations 120 may comprise between 20% to 45% of the surface area of the front panel 110.

FIG. 2 illustrates a back perspective view of the exemplary apparel item 100 in accordance with aspects herein. As shown in FIG. 2, the apparel item 100 further comprises a plurality of perforations 220 that extend through the thickness of the back panel 210 such that they form a fluid communication path between the environment outside the apparel item 100 and the interior of the apparel item 100. In exemplary aspects, the perforations 220 may comprise generally at least 1% up to at least 60% of the surface area of the back panel 210 although it is contemplated herein that the perforations 220 may comprise more than 60% of the surface area of the back panel 210. In one exemplary aspect, the perforations 220 may comprise between 20% to 45% of the surface area of the back panel 210. It is contemplated herein that when the apparel item 100 comprises additional features such as sleeves, and/or a hood, the perforations may extend to these areas as well. Any and all aspects, and any variation thereof, are contemplated as being within the scope herein.

As briefly described earlier, the perforations 120 and 220 may be formed or engineered in a variety of ways. For instance, the perforations 120 and 220 may be formed by mechanically incising the front panel 110 and/or the back panel 210. Mechanical incision may comprise laser cutting, die cutting, ultrasonic cutting, water jet cutting, and the like. In another exemplary aspect, the perforations 120 and 220 may be created by using stimulus-responsive yarns, fibers, and/or filaments when knitting or weaving the front panel 110 and the back panel 210. Exemplary stimuli used to activate the yarns, fibers, and/or filaments may comprise, for instance, water, sweat, moisture, chemicals, light, ultrasound, radio-frequency waves, heat, cold, and the like. During the material preparation phase, the stimulus-responsive yarns, fibers, and/or filaments may be dissolved or removed by application of the activating stimulus in selected areas to form the perforations 120 and 220. For instance, water, light, a chemical compound, heat, or cold may be applied to selected areas to form the perforations 120 and 220. As described above, forming the perforations 120 and 220 in this manner may enable the creation of a larger number of perforations and/or larger-diameter perforations as opposed to more traditional mesh-like fabrics. Further, by the forming the perforations 120 and 220 as described, the perforations 120 and 220 may be strategically located on the apparel item 100 (i.e., located in a first area but not in a second area).

In other exemplary aspects, the perforations 120 and 220 may be integrally formed from the knitting or weaving process that is used to make the front panel 110 and the back panel 210. In other words, as the front and back panels 110 and 210 are being knit and/or woven, the knitting or weaving process is modified (e.g., stitches dropped) to form the perforations 120 and 220 in select areas. Any and all aspects, and any variation thereof, are contemplated as being within the scope herein.

Figure 3:
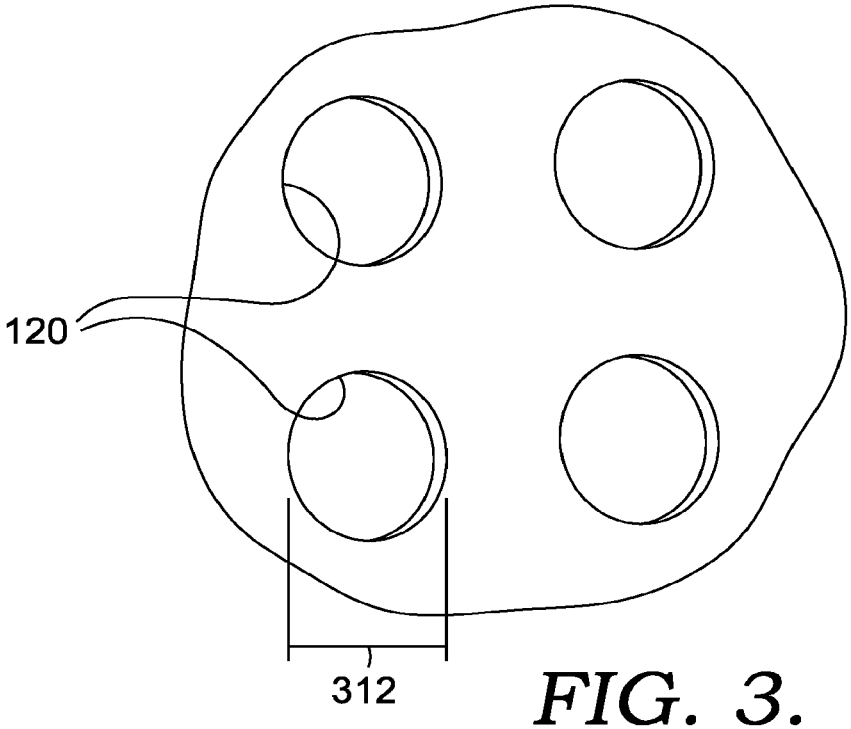
FIG. 3 illustrates a close-up view of the exemplary vented apparel item of FIG. 1 in accordance with aspects herein.

In exemplary aspects, and as generally shown in FIGS. 1 and 2, each of the perforations 120 and 220 may have a generally circular shape with a diameter of approximately 10 mm to 14 mm (shown in FIG. 3 and indicated by the reference numeral 312). Although shown in a circular shape, it is contemplated herein that the perforations 120 and 220 may comprise other shapes such as, for example, squares, diamonds, hexagons, triangles, ovals, and the like. Moreover, it is contemplated herein that the perforations 120 and 220 may be formed or shaped to reflect a company's brand or logo. The perforations 120 and 220 may be aligned by column and/or row as shown in FIGS. 1 and 2, or the perforations 120 and 220 may be randomly located on the front and back panels 110 and 210 of the apparel item 100. Any and all aspects, and any variation thereof, are contemplated as being within the scope herein.

Figure 4:
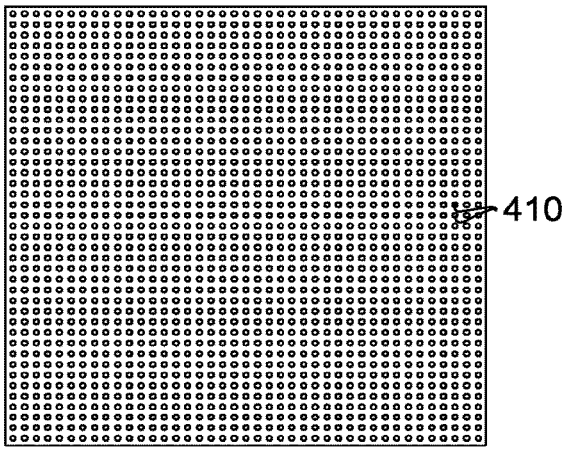
FIGS. 4-7 illustrate exemplary perforation sizes in accordance with aspects herein.
Figure 5:
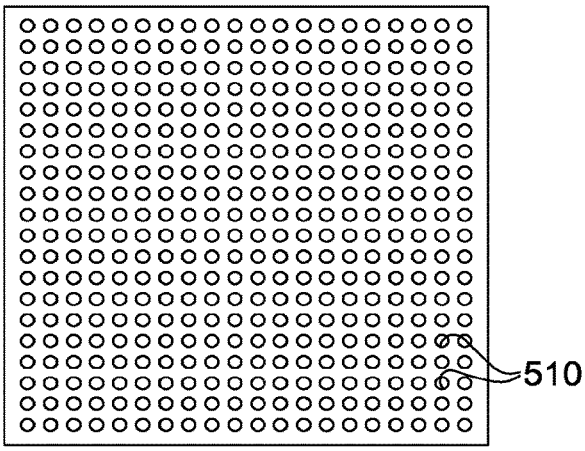
Figure 6:
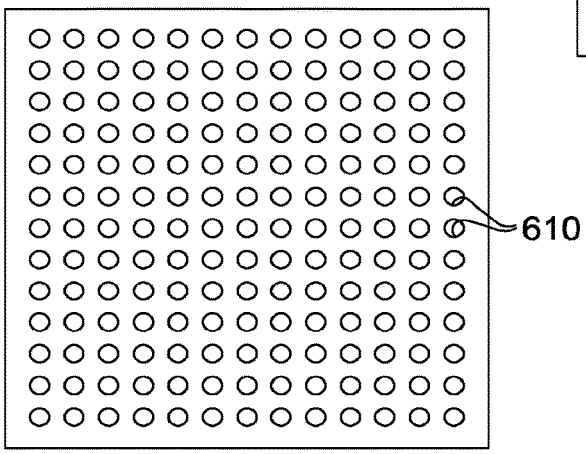
Figure 7:
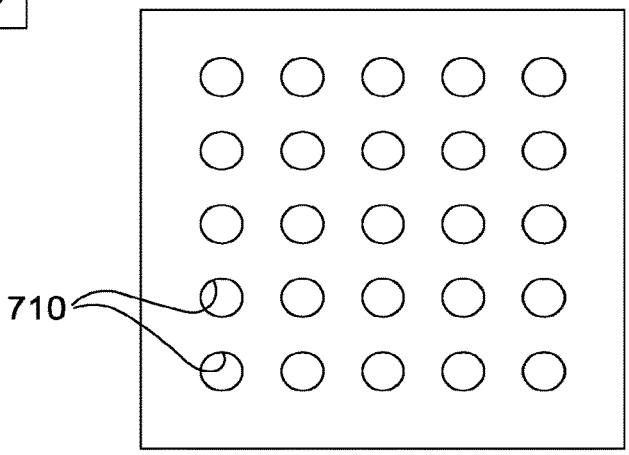

Other dimensions for the perforations 120 and 220 are contemplated herein. FIGS. 4-7 illustrate exemplary perforation sizes in accordance with aspects herein. For instance, FIG. 4 depicts a plurality of perforations 410 each having a diameter of approximately 4 mm. FIG. 5 depicts a plurality of perforations 510 each having a diameter of approximately 6 mm. FIG. 6 depicts a plurality of perforations 610 each having a diameter of approximately 8 mm, and FIG. 7 depicts a plurality of perforations 710 each having a diameter of approximately 12 mm. It is further contemplated herein that the perforations may have dimensions different from those shown in FIGS. 4-7. For instance, the perforations may have diameters anywhere between, for instance, 1.5 mm up to 16 mm. Any and all aspects, and any variation thereof, are contemplated as being within the scope herein.

In exemplary aspects, the diameter of the perforations, such as the perforations 120 and 220, is inversely proportional to the number of perforations/unit area. For example, the smaller the diameter of the perforations, the greater the number of perforations/unit area, and the larger the diameter of the perforation, the smaller the number of perforations/unit area. In each case, the diameter and/or number of the perforations/unit area is determined or selected such that the percentage of surface area of the apparel item comprising the perforations is generally between 20% and 45%. In other words, the diameter and/or number of the perforations/unit area is determined such that the percent openness of the apparel item is generally between 20% and 45%.

Returning to FIGS. 1-2, as shown the perforations 120 and 220 may be uniformly sized and distributed throughout the apparel item 100. However, it is contemplated herein that there may be a gradation in size of the perforations and/or number of perforations/unit area throughout the apparel item 100. For example, the perforations 120 and 220 may have a larger diameter and/or number/unit area when positioned towards the vertical midline of the front and back panels 110 and 210 of the apparel item 100 and may have a smaller diameter and/or number/unit area when positioned towards the sides or lateral margins of the apparel item 100. In another example, the perforations 120 and 220 may have a smaller diameter and/or number/unit area when positioned towards the vertical midline of the apparel item 100 and may have a larger diameter and/or number/unit area when positioned towards the sides of the apparel item 100. Other gradation patterns are contemplated herein such as smaller diameter and/or number/unit area towards the upper margins of the apparel item 100 and larger diameter and/or number/unit area towards the lower margins of the apparel item 100, or vice versa. Any and all aspects, and any variation thereof, are contemplated as being within the scope herein.

It is further contemplated herein that the location of the perforations may differ from that shown in FIGS. 1 and 2. For instance, perforations may be arranged in bands or zones over the front, back, sides, or shoulder areas of the apparel item 100. In this instance, the perforations may act as venting structures located to optimize opportunities for capturing and channeling air flowing over the front, back, and/or sides of the apparel item. In exemplary aspects, when perforations are used as venting structures, the number and/or density of the perforations may still be selected to achieve a predetermined level of openness such as, for example, between 20%-45% openness.

Figure 8B:
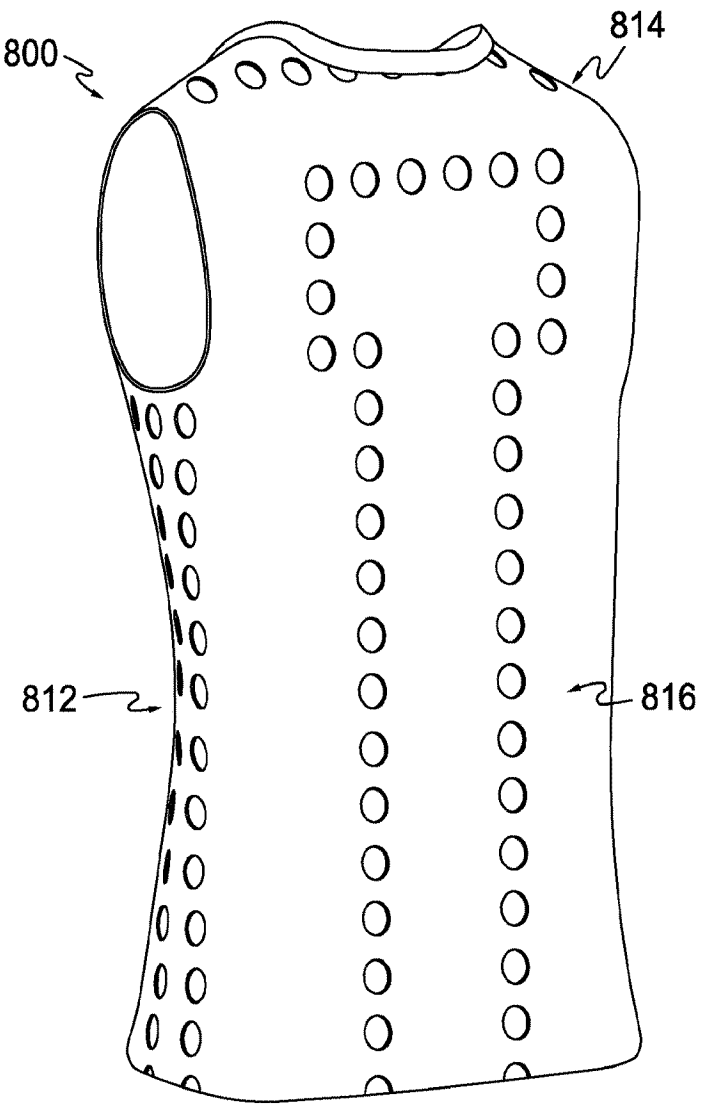
FIG. 8B illustrates a back view of the exemplary apparel item of FIG. 8A in accordance with aspects herein.
Figure 8A:
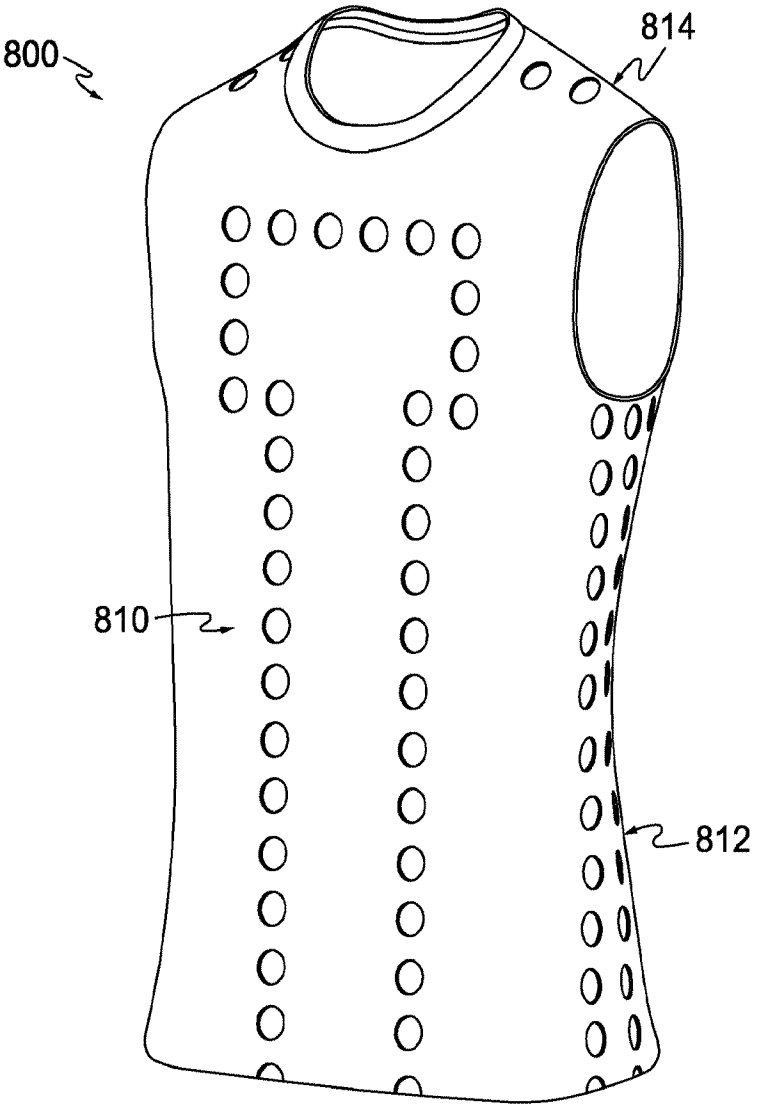
FIG. 8A illustrates a front view of an exemplary apparel item having venting structures in the form of engineered perforations in accordance with aspects herein.

FIGS. 8A and 8B depict front and back view respectively of an apparel item 800 having venting structures in the form of perforations in accordance with aspects herein. With respect to FIG. 8A, the apparel item 800 comprises a first set of perforations 810 located over the front of the apparel item 800 in an inverted U-shaped configuration. A similarly configured second set of perforations 816 is positioned on the back of the apparel item 800 as shown in FIG. 8B. The location of the perforations 810 and 816 may be based on air flow maps and air pressure maps that may indicate that these portions of the apparel item 800 experience a high degree of air flow (or air pressure). As such, the perforations 810 and 816 may act as inflow vents. Although shown with relatively larger-sized perforations, it is contemplated herein that smaller-sized perforations may be used such as perforations having a diameter between, for instance, 2.5 mm to 10 mm. Additional sets of perforations may optionally be located at other areas of the apparel item 800 such as the perforations 812 located along the sides of the apparel item 800 and/or perforations 814 located at the shoulder regions of the apparel item 800. In exemplary aspects, since these areas are typically exposed to less air flow and/or lower air pressure, the perforations 812 and 814 may act as outflow vents allowing air within the apparel item 800 to exit.

Figure 9B:
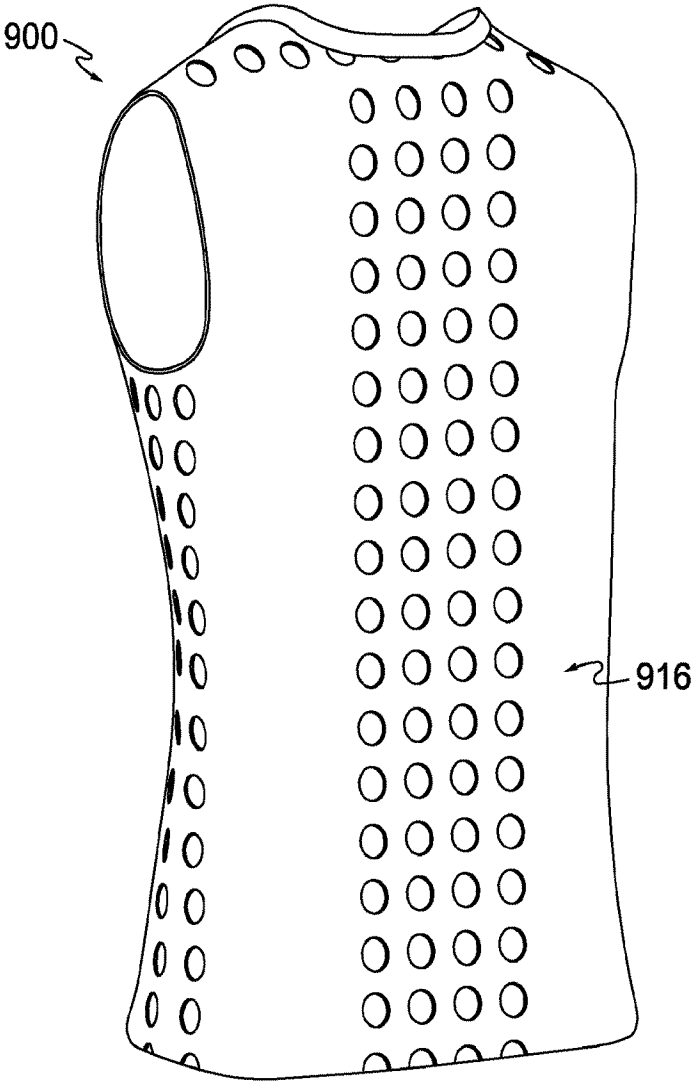
FIG. 9B illustrates a back view of the exemplary apparel item of FIG. 9A in accordance with aspects herein.
Figure 9A:
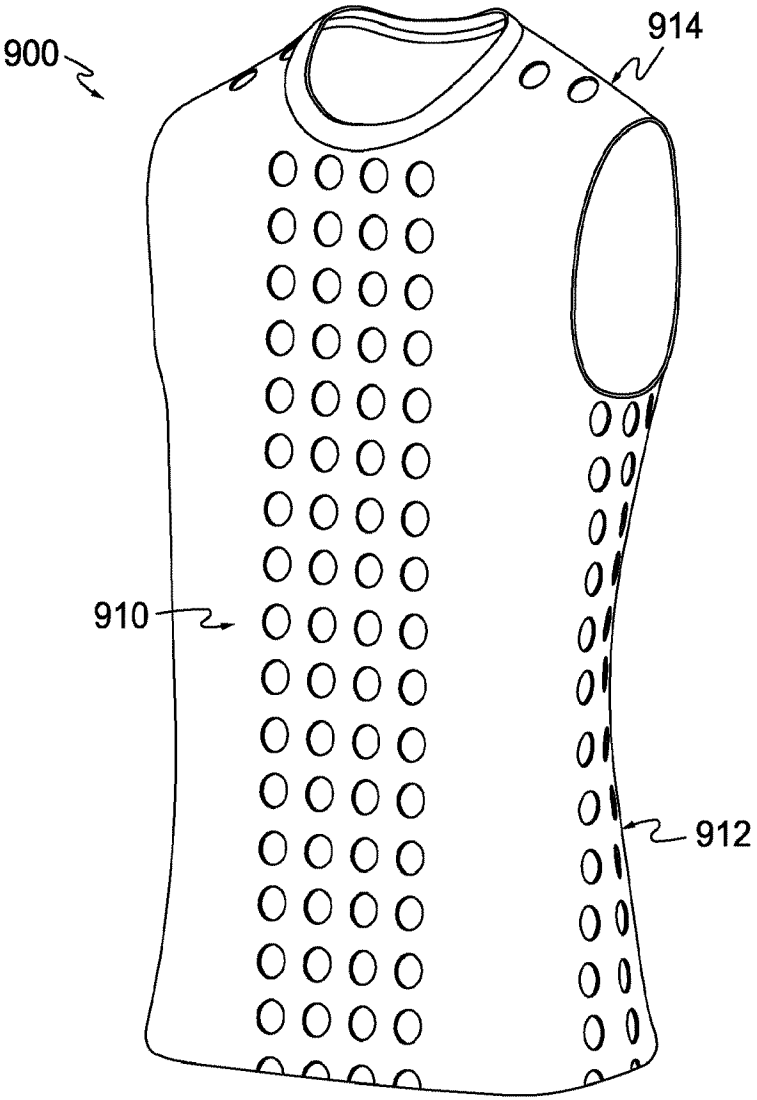
FIG. 9A illustrates a front view of an exemplary apparel item having venting structures in the form of engineered perforations in accordance with aspects herein.

FIGS. 9A and 9B depict another exemplary configuration of perforations on an apparel item 900 in accordance with aspects herein. FIG. 9A, which depicts a front view of the apparel item 900, has a set of perforations 910 configured as a vertical band over the front of the apparel item 900. Similarly, FIG. 9B, which depicts a back view of the apparel item 900, has a set of perforations 916 configured as a vertical band over the back of the apparel item 900. Optional additional sets of perforations may be located over the sides of the apparel item 900 (perforations 912) and/or over the shoulder regions of the apparel item 900 (perforations 914). Similar to the apparel item 900, the perforations 910, 912, 914, and 916 may comprise different sizes than those shown.

Figure 10:
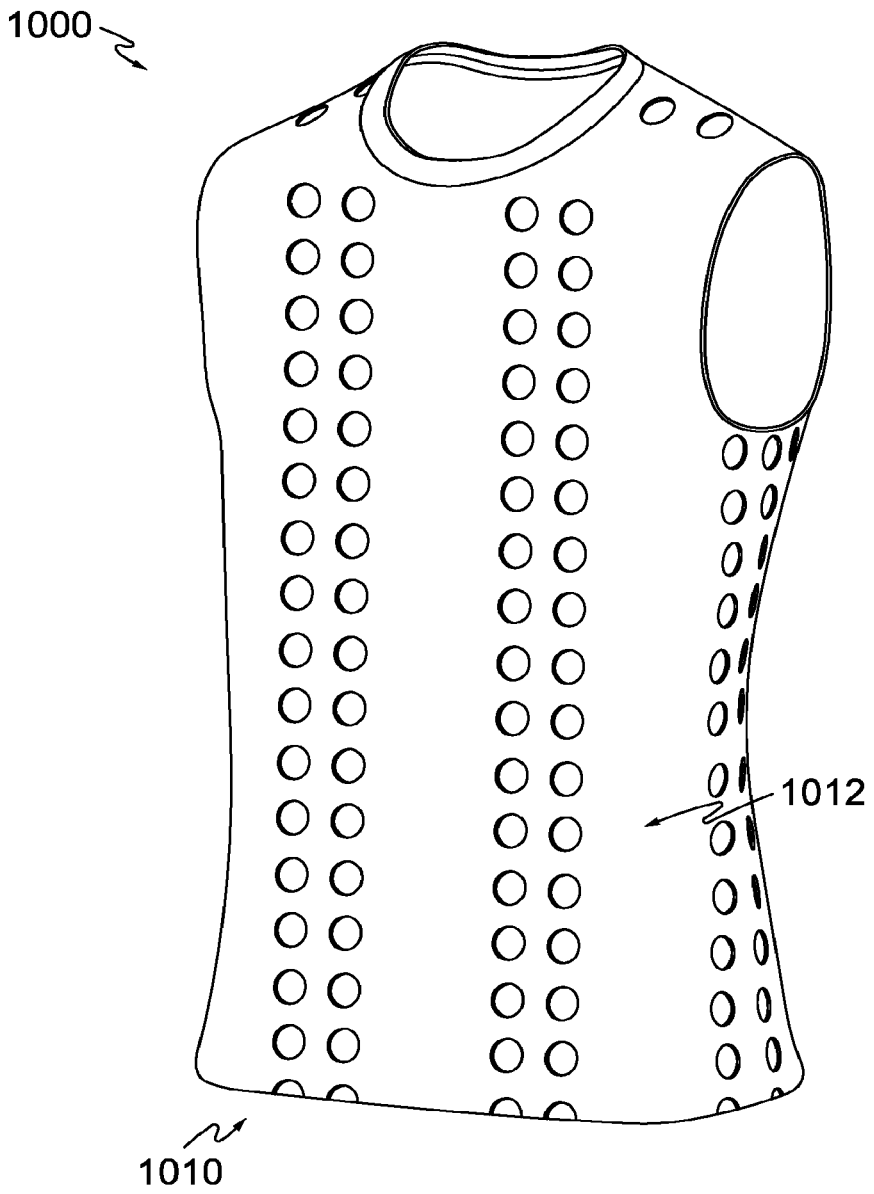
FIG. 10 illustrates a front view of an exemplary apparel item having venting structures in the form of engineered perforations in accordance with aspects herein.

FIG. 10 depicts yet another alternative configuration for the perforations in accordance with aspects herein. FIG. 10 illustrates a front view of an apparel item 1000 having a first vertical band of perforations 1010 located on a right side of the apparel item 1000, and a second vertical band of perforations 1012 on a left side of the apparel item 1000. The apparel item 1000 may optionally comprise perforations located at the shoulder regions and/or the side regions. A back view of the apparel item 1000 may comprise perforations having a similar configuration as those shown on the front (e.g., two vertical bands), or the back of the apparel item 1000 may comprise perforations configured in a different pattern such as that shown in FIG. 8B or FIG. 9B. It is contemplated herein that additional configurations for the perforations may be used herein. Any and all aspects, and any variation thereof, are contemplated as being within the scope herein.

Perforations, such as the engineered perforations described herein, may also be utilized on socks and/or protective apparel such as shin guards, thigh pads, shoulder pads, and the like. Using shin guards as an example, engineered perforations may be located along the length of the shin guard to facilitate air flow between the interior of the shin guard and the environment external to the shin guard. In one exemplary configuration, perforations may be located along the length of the shin guard on either side of a hypothetical vertical midline that bisects the shin guard into generally equal right and left halves with respect to the shin guard being in an as-worn configuration. This is just one exemplary configuration, and it is contemplated that the engineered perforations may be positioned at other locations on the exemplary shin guard.

Turning back to FIGS. 1 and 2, the gradation pattern, the diameter and/or number/unit area, and/or the location of the perforations 120 and 220 may also be dependent upon, for instance, heat maps, sweat maps, and/or contact maps (maps of how the apparel item 100 contacts the wearer's body) of the human body. As an example, the perforations 120 and 220 may be concentrated in areas of the apparel item 100 that are positioned adjacent to high heat or sweat-producing areas when the apparel item 100 is worn.

Further, the gradation pattern, the diameter, the number/unit area, and/or the location of the perforations 120 and 220 may also be dependent upon what sport or athletic activity the apparel item 100 is intended to be utilized. As an example, for athletic activities such as running, air typically flows over the front of the wearer. Thus, by positioning a greater number, larger diameter, and/or a larger number/unit area of perforations over the front of the apparel item 100 and a smaller number, smaller diameter, and/or small number/unit area of perforations over the sides and/or shoulder areas of the apparel item 100, air flowing into the apparel item 100 may be optimized. For athletic activities such as basketball that involve a lot of forward running and backward running, a larger number, larger diameter, and/or larger number/unit area of perforations may be positioned over the front and the back of the apparel item 100 and a smaller number, smaller diameter, and/or small number/unit area of perforations may be positioned over the sides and/or shoulder areas of the apparel item 100.

When it is contemplated that the apparel item 100 will be utilized in cooler environmental conditions, the number, diameter, and/or number/unit area of the perforations 120 and 220 may be reduced to decrease the percent openness of the apparel item 100. In another example, the perforations 120 and 220 may be located at areas of the apparel item 100 that are not exposed to significant air flow during exercise such as primarily along the sides of the apparel item 100.

In one exemplary aspect, the perforations 120 and 220 may be configured to dynamically transition from a closed state to an open state in response to, for instance, movements initiated by the wearer, in response to sweat or moisture produced by the wearer, in response to increases in ambient temperature, in response to increases in the wearer's body temperature, and the like. This is useful because when an athlete is at rest, the athlete often desires to retain body heat so as to keep her muscles warm. However, when the athlete starts generating heat due to exercise, it is beneficial to dissipate this heat so that the athlete can exercise in optimal temperature ranges. For instance, the apparel item 100 may be configured to transition from near zero percent openness to, for instance, openness in the range of 20%-45% in response to wearer movement or other stimuli thus allowing the apparel item 100 to be used in a wide variety of environmental conditions.

In one example, a material (e.g., a laminate) may be applied to the perimeter of the perforations, where the material may comprise, for instance, a shape memory polymer (SMP). The SMP material may be programmed to have a first shape at a first temperature or moisture level and a second shape at a second temperature or moisture level. Thus, when predetermined temperature and/or moisture levels are reached, the SMP material may change shape causing the perforations to transition from a closed state to an open state. Once the temperature and/or moisture levels drop below the predetermined level, the SMP material may change back to its first shape transitioning the perforations back to a closed state.

In another example, an adaptive yarn may be used to form all or part of the apparel item, where the adaptive yarn transforms dimensionally when exposed to different stimuli such as, for instance, temperature or moisture. For instance, the adaptive yarn may be concentrated on one surface of the apparel item and a dimensionally stable yarn may be concentrated on a second opposite surface of the apparel item. A series of slits may be formed in the apparel item, where the slits remain in a relatively closed state when the wearer is in a resting state. However, upon exposure to a stimulus (e.g., moisture, heat), the adaptive yarn may increase in size. The increase in size of the yarn may be constrained by the dimensionally stable yarn thus causing the slits to curl toward the dimensionally stable second surface creating an opening or perforation through which air can travel.

In yet another example, the apparel item may be formed of a composite material having a first surface material comprising a series of perforations that is coupled by a responsive material to a second surface material also having perforations. In exemplary aspects, the first surface material may comprise an outer-facing surface of the apparel item, and the second surface material may comprise an inner-facing surface of the apparel item. Further, the responsive material may comprise a shape memory polymer. The responsive material may respond to different stimuli such as temperature and/or moisture by contracting or expanding. This contraction or expansion may cause a planar shifting of the first and second surface materials, which, in turn, may cause the perforations in each of the two layers to align or become offset from one another thus dynamically opening and closing the perforations.

As described, the exemplary apparel item may utilize engineered perforations to achieve a predetermined level of openness. The level of openness may be selected to allow relatively large volumes of air to enter the apparel item and to help cool the wearer by promoting evaporative heat transfer. Alternatively, the level of openness may be selected to help retain heat during rest and/or during training in cooler weather conditions. Moreover, the exemplary apparel item described herein may utilize engineered perforations as venting structures. The perforations may be strategically located at portions of the apparel item that are exposed to high air flow. The perforations, in this aspect, may help to capture and funnel air into the apparel item where the air may facilitate evaporative heat transfer.

Honeycomb Structure

Apparel items described herein may utilize a honeycomb structure comprising a latticework of holes or perforations formed in a material, where the holes or perforations dynamically open and close in response to tensioning forces generated by a wearer of the apparel item. When in an open state, the latticework of holes acts to increase the openness of the apparel item. Further, the honeycomb structure may act as a venting structure when located on the apparel item in areas that experience high air flow.

Figure 11A:
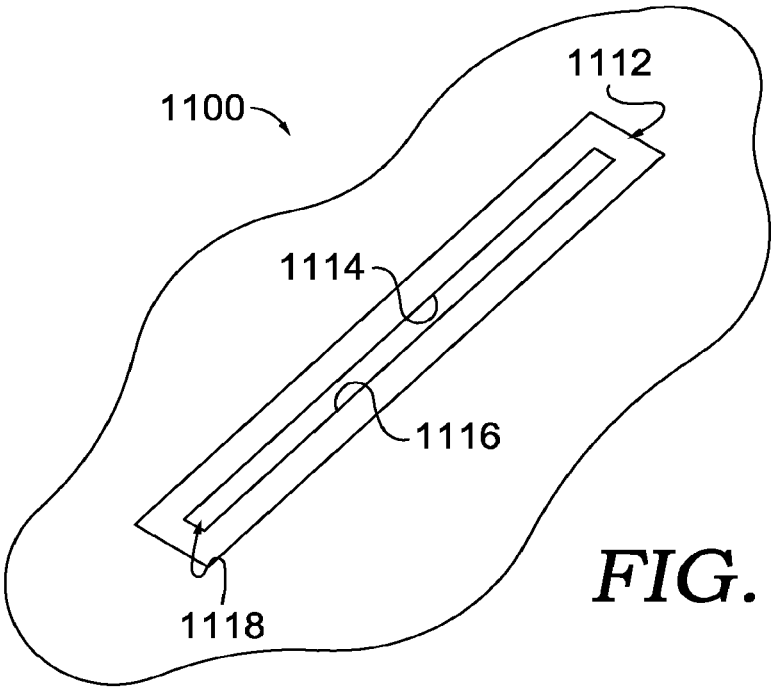
FIGS. 11A-11B illustrate an exemplary textile element having a structure that transitions from a closed state to an open state to reveal openings in accordance with aspects herein.
Figure 11B:
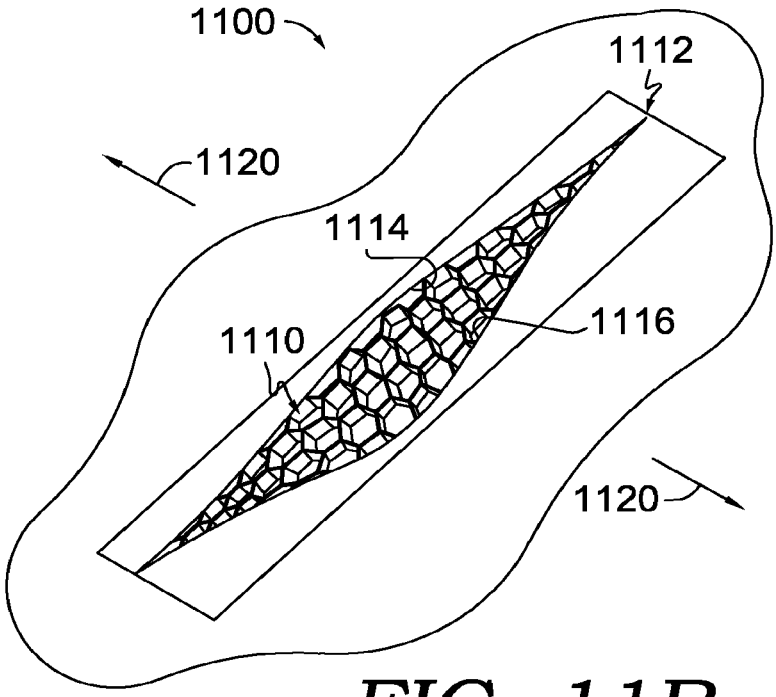

FIGS. 11A and 11B depict an exemplary honeycomb structure located on a portion of a textile 1100. In exemplary aspects, the textile 1100 may be used to form at least a portion of an apparel item. In exemplary aspects, the textile 1100 may include an insert in the form of, for example, a trim piece 1112. FIG. 11A depicts the trim piece 1112 having at least a first opening edge 1114 and a second opening edge 1116 spaced apart from the first opening edge 1114 to form a slit-type opening 1118. The slit-type opening 1118 is shown in a closed state with respect to FIG. 11A and in an open state with respect to FIG. 11B. The trim piece 1112 may be incorporated into the textile 1100 by incising or removing a portion of the textile 1100 and inserting and affixing the trim piece 1112 within the resulting space. In another aspect, the trim piece 1112 may be positioned between two adjoining panels of an apparel item. For instance, the trim piece 1112 may be inserted at a seam line between different panels that form the apparel item. In still another example, the honeycomb structure shown in FIGS. 11A and 11B may comprise an integral part of the apparel item. For instance, the honeycomb structure may be integrally formed by, for instance, modifying or altering a knitting or weaving process used to form the apparel item. Any and all aspects, and any variation thereof, are contemplated as being within the scope herein.

FIG. 11A depicts the textile 1100 in a resting state. In other words, FIG. 11A depicts the textile 1100 before any tensioning forces are applied. FIG. 11B depicts the textile 1100 after tensioning forces 1120 are applied. In exemplary aspects, the slit-type opening 1118 is oriented on the textile 1100 such that the tensioning forces 1120 commonly generated by a wearer exercising are generally perpendicular to the long-axis of the slit-type opening 1118. The tensioning forces 1120 may be initiated, in exemplary aspects, upon the wearer beginning an exercise movement. The tensioning forces 1120 help to draw the first opening edge 1114 away from the second opening edge 1116 thereby causing the slit-type opening 1118 to expand and expose openings 1110. Once exposed, ambient air can travel through the textile 1100 via the openings 1110. Thus, as seen, when the trim piece 1112 is in an open state, the openings 1110 help to increase the percent openness of the apparel item in which the trim piece 1112 is incorporated.

In exemplary aspects, the openings 1110 may be formed in a honeycomb-type pattern as shown in FIG. 11B using a material that exhibits a degree of resiliency such that the material returns to its resting state when the tensioning forces 1120 are removed (e.g., when the wearer stops exercising). The tendency of the material to return to its resting state helps to bias the first opening edge 1114 and the second opening edge 1116 back toward each other thereby closing the trim piece 1112. By transitioning back to a closed state when the tensioning forces 1120 are removed, the percent openness of the apparel item may be reduced and the apparel item may be better suited to retain body heat produced by the wearer.

Figure 11C:
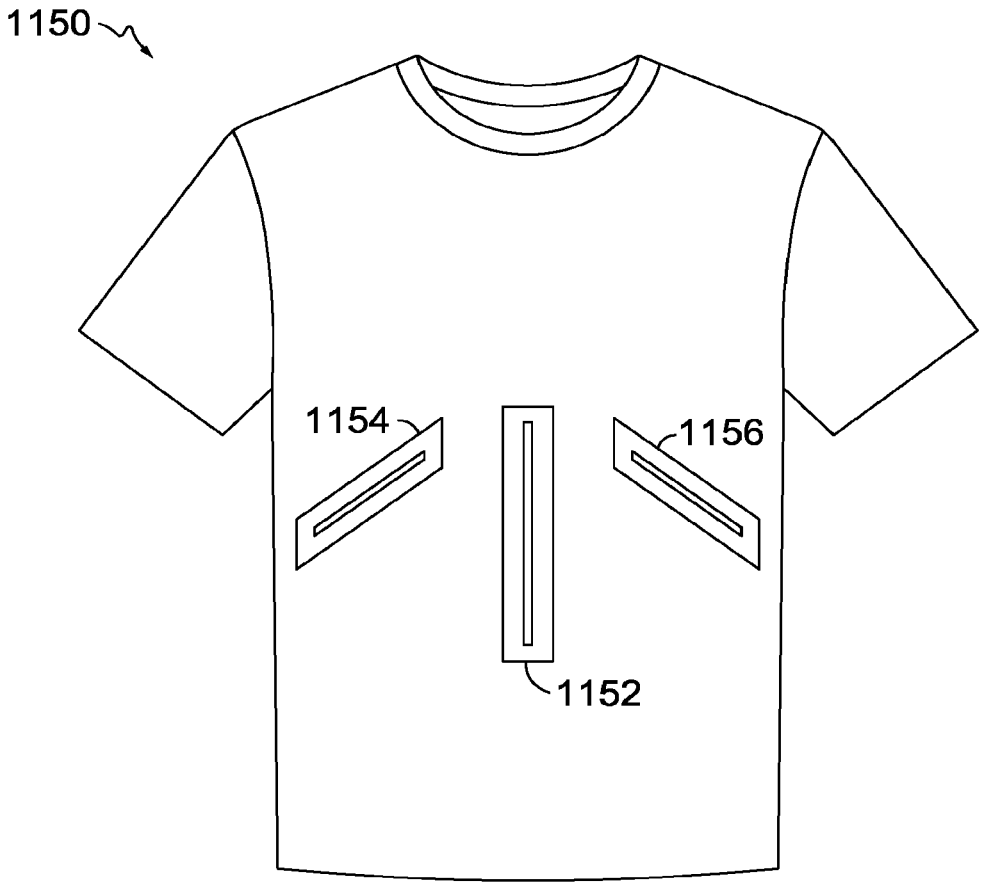
FIG. 11C illustrates an exemplary apparel item incorporating the exemplary textile element of FIGS. 11A and 11B in accordance with aspects herein.

As mentioned, the honeycomb structure described herein may also be used as a venting structure. For example, FIG. 11C depicts an apparel item 1150 having a number of different honeycomb structures in the form of trim pieces. For instance, trim piece 1152 is positioned at a front midline of the apparel item 1150, and trim pieces 1154 and 1156 are positioned along the sides of the apparel item 1150. More specifically, the trim pieces 1154 and 1156 are diagonally oriented from a superior-medial aspect of the apparel item 1150 to an inferior-lateral aspect of the apparel item 1150 along the front of the apparel item 1150. Although shown as inserts, it is contemplated herein that the honeycomb structures may be integrally formed from the material used to form the apparel item 1150.

The location of the trim pieces 1152, 1154, and 1156 may be based on, for example, air flow maps and/or air pressure maps of the human body and may further be based on the direction of tensioning forces produced by a wearer during exercise. For instance, the front of a wearer often experiences high air flow during exercise. Moreover, this location may be subject to tensioning forces as the wearer exercises. By positioning the trim pieces 1152, 1154, and 1156 along the vertical midline and sides of the apparel item 1150, for example, the tensioning forces produced by the wearer may transition the trim pieces 1152, 1154, and 1156 from a closed state to an open state. Because of the trim pieces' positioning in a high air flow location, the opportunity to catch and funnel air into the apparel item 1150 is enhanced. The location of the trim pieces 1152, 1154, and 1156 is exemplary only and it is contemplated herein that the trim pieces 1152, 1154, and 1156 may be positioned at other locations based on, for example, air flow or air pressure maps (e.g., the back of the apparel item 1150 or along the shoulders of the apparel item 1150). Moreover, the number of trim pieces is exemplary only and it is contemplated herein that there may be more or fewer trim pieces than those shown. Any and all aspects, and any variation thereof, are contemplated as being within the scope herein.

As described, the honeycomb structure may act to increase the openness of an apparel item and/or act as a venting structure. The ability of the honeycomb structure to transition from a closed state to an open state in response to tensioning forces helps the wearer to dissipate heat when exercising and retain heat while at rest.

Stand-Off Nodes

Apparel items described herein may utilize stand-off nodes or structures located on an inner-facing surface of the apparel item and extending in a z-direction with respect to the surface plane of the apparel item to provide a space between the apparel item and the wearer's body surface in which air can effectively circulate and cool the wearer. The stand-off nodes or structures may also be formed in a separate processing step and be subsequently applied to the exemplary apparel item, and/or the stand-off nodes or structures may be formed using one or more finishings or treatments applied to the apparel item.

When formed in a separate processing step and subsequently applied to the apparel item, the stand-off nodes may be formed from a polyurethane material, a thermoplastic polyurethane material, a silicone material, a reactive or adaptive material, a laser cut spacer mesh material, a foam material, and the like. The stand-off nodes may then be applied to the inner-facing surface of the apparel item via a heat transfer process, an adhesive, ultrasonic welding, mechanically affixing (e.g., stitching), and the like. In one exemplary aspect, the stand-off nodes may be applied to one or more panels of material, and the panels of material may then be incorporated into the apparel item. When the stand-off nodes are formed from a reactive or adaptive material, such as a shape memory polymer, the stand-off nodes may dynamically transition from a not-present state to a present-state, and/or a low-height state to a high-height state, in response to different stimuli such as moisture, sweat, light, heat, and the like. Any and all aspects, and any variation thereof, are contemplated as being within the scope herein.

With respect to forming the stand-off nodes via one or more finishings or treatments applied to the apparel item, it is contemplated herein that the stand-off nodes may comprise a printable ink applied to the apparel item that swells or enlarges in response to a stimulus such as water, a puff adhesive transfer, an embroidery pattern, a foam material, a puff ink, flocking, and the like. One exemplary treatment or finishing comprises a polyvinyl alcohol (PVA) ink (such as polygum RP5 produced by Unikasei of Kyoto, Japan) that is applied to a textile material, cured, and then washed off. It has been found that the application of the PVA ink causes a permanent deformation in the textile material that is maintained even after the PVA ink is washed off. The "deformed" areas may comprise stand-off nodes.

With respect to the different finishings or treatments described herein, the finishing or treatment may comprise a material that is capable of transitioning from a first state to a second state in response to different stimuli thereby causing the stand-off nodes to dynamically transition from a not-present state to a present-state, and/or a low-height state to a high-height state. Any and all aspects, and any variation thereof, are contemplated as being within the scope herein.

Figure 55A:
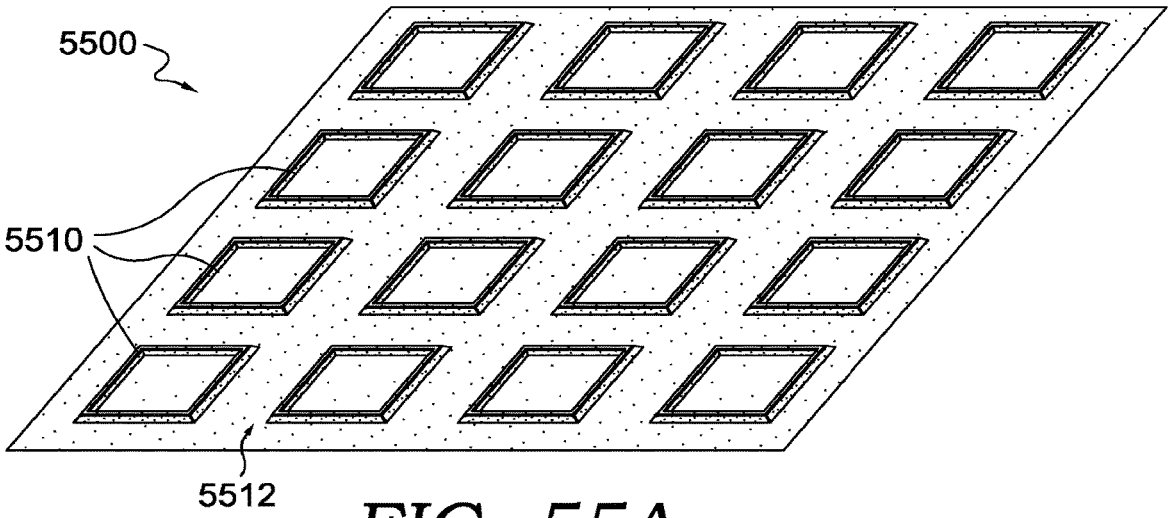
FIG. 55A illustrates an exemplary textile material having an exemplary pattern of hydrophilic material in a first state in accordance with aspects herein.
Figure 55B:
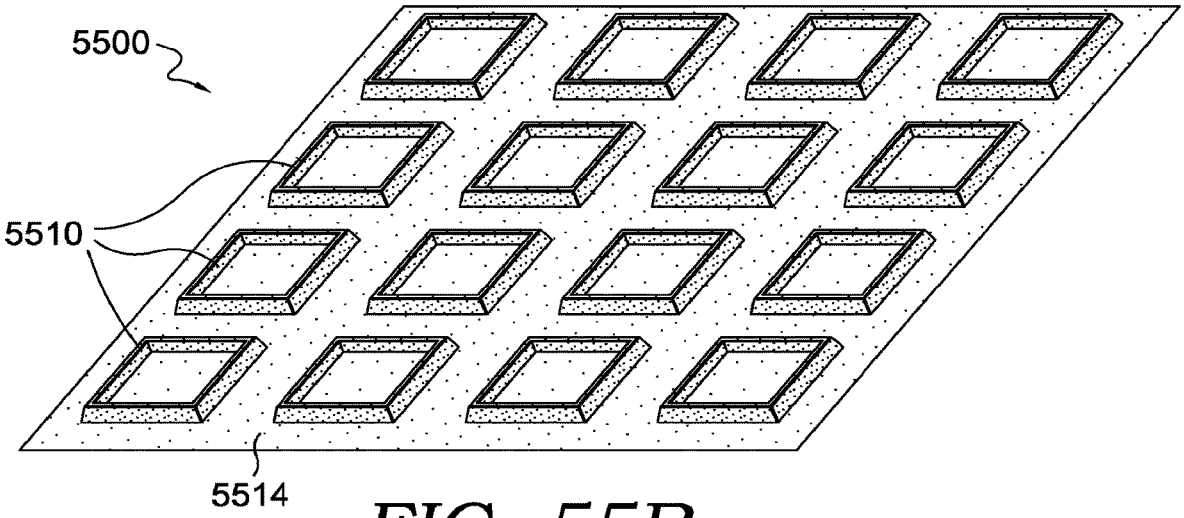
FIG. 55B illustrates the exemplary textile material of FIG. 55A where the exemplary pattern of hydrophilic material is in a second state in accordance with aspects herein.

In one exemplary aspect, and as shown in FIGS. 55A and 55B, a hydrophilic coating may be applied to one surface of a textile material 5500 in an exemplary pattern 5510 in accordance with aspects herein. When the textile material 5500 is incorporated into a garment, such as an upper torso garment, the pattern 5510 may be positioned on an inner-facing surface of the garment. Further, the pattern 5510 may extend over an entirety of at least the torso portion of the garment, or the pattern 5510 may be limited to one or more areas generally known to be associated with high cling based on, for instance, cling maps of the human body. Exemplary locations may comprise the upper chest region and/or the side regions of the garment. The pattern 5510 shown in FIGS. 55A and 55B is exemplary only, and it is contemplated that the hydrophilic coating may be applied in other patterns in accordance with aspects herein.

With respect to FIG. 55A, the pattern 5510 is shown in a first state, where the first state comprises one in which the textile material 5500 has not been exposed to moisture (e.g., water, sweat, and the like). As shown, the pattern 5510 extends in the z-direction with respect to the surface plane of the textile material 5500 by a first amount 5512. With respect to FIG. 55B, the pattern 5510 is shown in a second state, where the second state comprises one in which the textile material 5500 has been exposed to moisture. In this figure, the pattern 5510 extends in the z-direction a second amount 5514 that is greater than the first amount 5512. In other words, in response to moisture, the pattern 5510 swells or enlarges via the absorption of, for instance, water, to further extend away from the surface plan of the textile material 5500 to form stand-off structures. Thus, when the textile material 5500 is incorporated into a garment worn by a wearer, the pattern 5510 would dynamically change based on moisture (e.g., sweat) produced by the wearer. When the wearer begins sweating, the pattern 5510 would transition from the first state to the second state, and when the wearer is no longer sweating, and the garment begins drying, the pattern 5510 would transition back to the first state.

Figure 12:
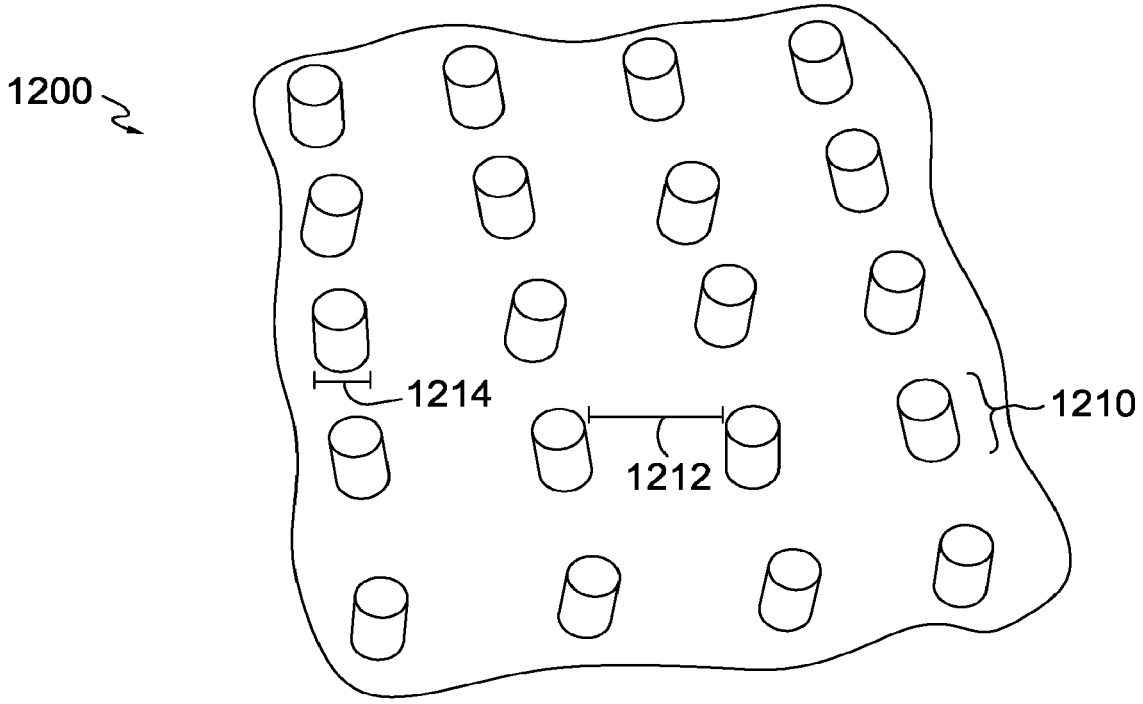
FIG. 12 illustrates exemplary stand-off nodes in accordance with aspects herein.

FIGS. 12-16 depict close-up views of exemplary stand-off nodes in accordance with aspects herein. The stand-off nodes shown in these figures may be formed from any of the processes described above. With respect to FIG. 12, a series of stand-off nodes 1200 are shown. The discussion regarding FIG. 12 is equally applicable to any of the stand-off nodes shown in, for example, FIGS. 13-16.

In exemplary aspects, each stand-off node 1200 may have a height (H) 1210 between 2.5 mm and 8 mm, between 3 mm and 7 mm, or between 4 mm and 6 mm, although heights above and below these values are contemplated herein. Spacing (D) 1212 between adjacent nodes 1200 may, in exemplary aspect, be equal to or greater than twice the height 1210 of the nodes 1200 (e.g., $D \geq 2H$). Continuing, each node 1200 may have a diameter or width (T) that is less than or equal to one-tenth, one-half, or one-third the distance 1212 between adjacent nodes 1200 (e.g., $T \leq D/10$ or $D/5$ or $D/3$). The nodes 1200 may be in linear alignment by rows and columns as shown in FIG. 12, or the nodes 1200 may be arranged in a staggered pattern.

By configuring the stand-off nodes 1200 to have the height (H) 1210 described herein, a sufficient-sized space or void is created between the inner-facing surface of the apparel item and the wearer's skin to allow air to freely circulate. When the stand-off nodes 1200 have a height less than, for instance, 2.0 mm, air movement may be minimized. In some instances, this may be useful to achieve an insulating effect. To put it another way, a smaller height for the stand-off nodes 1200 may be selected, such as, for example, 0.5 mm to 2.0 mm, to achieve an insulating effect.

Continuing, by spacing the stand-off nodes 1200 by the distance (D) 1212 described herein, air circulation may be further enhanced. For instance, if the stand-off nodes 1200 were spaced closely together, the stand-off nodes 1200 may resist or block air flow. Moreover, by configuring the stand-off nodes 1200 to have the diameter or width (T) 1214 described herein, the stand-off nodes 1200 may be sized such that they do not block air flow. Thus, the height, spacing, and width of the stand-off nodes 1200 are selected to achieve an optimal air flow pattern that contributes to heat-dissipating characteristics of the apparel item. Further, as explained above, when the stand-off nodes are formed using adaptive yarns or fibers, the dimensions associated with the stand-off nodes such as height, width, and/or spacing may dynamically change in response to the presence or absence of stimuli or in response to a level or intensity of the stimuli.

Air pressure maps, air flow maps, sweat maps, and contact maps of the human body may be used to guide the location of the nodes 1200. For example, when the apparel item is in the form of a shirt, the nodes 1200 may be concentrated in areas of the apparel item known to have a high amount of contact with the wearer's skin such as the sides of the apparel item, and/or the center front or center back of the apparel item. By locating the nodes 1200 in these areas, the perception of cling may be reduced.

Figure 17:
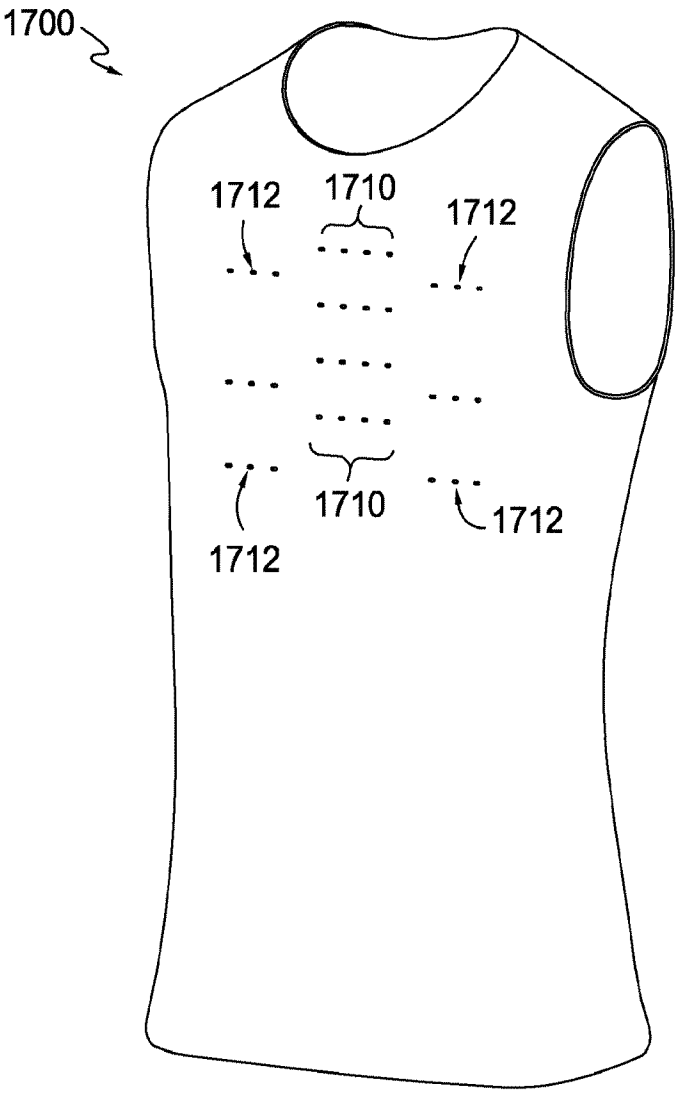
FIG. 17 illustrates a front perspective view of an inner-facing surface of an exemplary apparel item having stand-off nodes in accordance with aspects herein.

The nodes 1200 may further be located in areas of the apparel item that are positioned adjacent to portions of the wearer's torso that experience a high degree of air flow or air pressure and/or experience a high degree of sweating. An example of this is shown in FIG. 17 which depicts a front view of an inner-facing surface of an exemplary apparel item 1700 in accordance with aspects herein. The apparel item 1700 comprises a series of stand-off nodes 1710 located over the center front of the apparel item 1700. When worn by a wearer, this area typically corresponds to a high heat and/or sweat-producing area. The apparel item 1700 further comprises sets of stand-off nodes 1712 located closer to the side or lateral margins of the apparel item 1700. These areas may also comprise relatively high heat and/or sweat producing areas.

By positioning the nodes 1710 and 1712 at locations corresponding to high heat and/or sweat-producing areas, the movement of air between the inner-facing surface of the apparel item 1700 and the wearer's skin may be enhanced with a resulting increase in evaporative heat transfer. It is further contemplated herein that there may be areas of the apparel item 1700 that do not contain stand-off nodes. For instance, when the apparel item 1700 is configured to be more loose-fitting, the lower front torso area of the apparel item 1700 may not experience a significant amount of contact with the wearer's body surface. As such, and as shown in FIG. 17, this area may not have stand-off nodes, or may have a reduced number of stand-off nodes because the natural draping of the fabric automatically creates stand-off in this area. A similar pattern of stand-off nodes may be located on the inner-facing surface of the back panel of the apparel item 1700.

Figure 18:
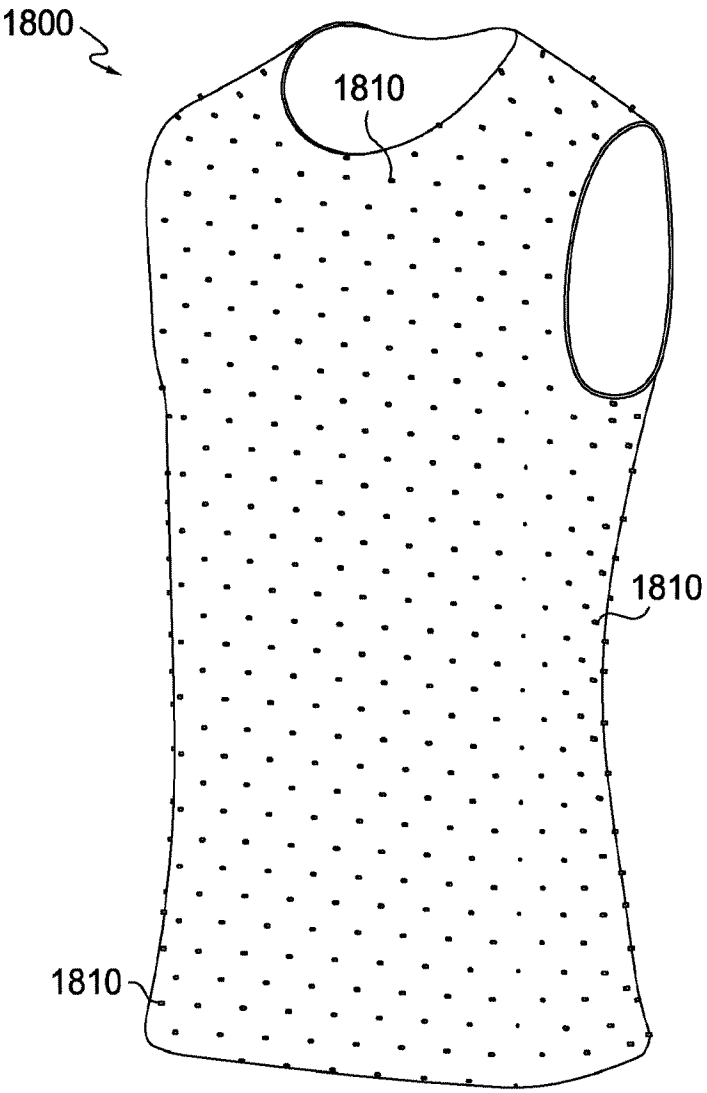
FIG. 18 illustrates a front perspective view of an inner-facing surface of an exemplary apparel item having stand-off nodes in accordance with aspects herein.

Alternatively, apparel items contemplated herein may comprise stand-off nodes located over the majority of their inner-facing surfaces. This aspect is shown in FIG. 18 which depicts a front view of an inner-facing surface of an exemplary apparel item 1800 in accordance with aspects herein. The apparel item 1800 comprises stand-off nodes 1810 located over the majority of the inner-facing front surface of the apparel item 1800. A similar pattern of stand-off nodes may be located on the inner-facing surface of the back panel of the apparel item 1800. This pattern may be advantageous when the apparel item 1800 comprises a form-fitting layer since the majority of the inner-facing surface of the apparel item 1800 could potentially be in contact with the wearer's body surface. Any and all aspects, and any variation thereof, are contemplated as being within the scope herein.

Returning to the shin guard example discussed above with respect to the engineered perforations, stand-off nodes may also be utilized in shin guards and other types of protective equipment. The stand-off nodes may be positioned on the inner-facing surface of the shin guard such that they provide stand-off from the wearer's shin and promote needed air movement in this space. In one exemplary aspect, the stand-off nodes may extend generally along the length of the shin guard at an anterior aspect of the shin guard. Besides facilitating air flow, the stand-off nodes may also act to attenuate any impact forces applied to the shin guard.

In yet another aspect, when an apparel item is contemplated as being used in colder-weather conditions, the location and size of the stand-off nodes may be adjusted to provide more of an insulating effect. For instance, the height of the stand-off nodes may be selected to be 2.0 mm or less. It has been found that resistance to evaporation may actually be increased when using stand-off nodes having a height of 2.0 mm or less as compared to apparel items not utilizing stand-off. For instance, a base shirt not having any type of venting or stand-off may exhibit a resistance to evaporation that is less than a shirt having stand-of nodes of approximately 2.0 mm. These "low-height" stand-off nodes may be positioned on the apparel item at areas needing greater insulation such as, for instance, over the front and back surfaces of the apparel item.

It is also contemplated herein, that there may be a gradation in spacing and/or dimensions associated with the nodes, such as the nodes 1200, when the nodes are incorporated in an apparel item. This may also be based on, for instance, air pressure maps, air flow maps, sweat maps, and contact maps of the human body. For instance, in one exemplary aspect, the nodes may have a smaller height and/or width when located closer to a venting structure, and the nodes may gradually increase in height as the distance from the venting structure increases. In another example, the nodes may be spaced more closely together when located closer to the venting structure and may be spaced further apart as the distance from the venting structure increases to minimize any impedance to air flow in this area. In yet another example, nodes having a smaller height (e.g., less than or equal to 2.0 mm) may be located in areas for which a higher level of insulation is desired, and nodes having a height greater than, for instance, 2.0 mm may be located in areas for which a greater amount of air flow is needed. These are examples only and other gradation patterns are contemplated herein. Any and all aspects, and any variation thereof, are contemplated as being within the scope herein.

Figure 13:
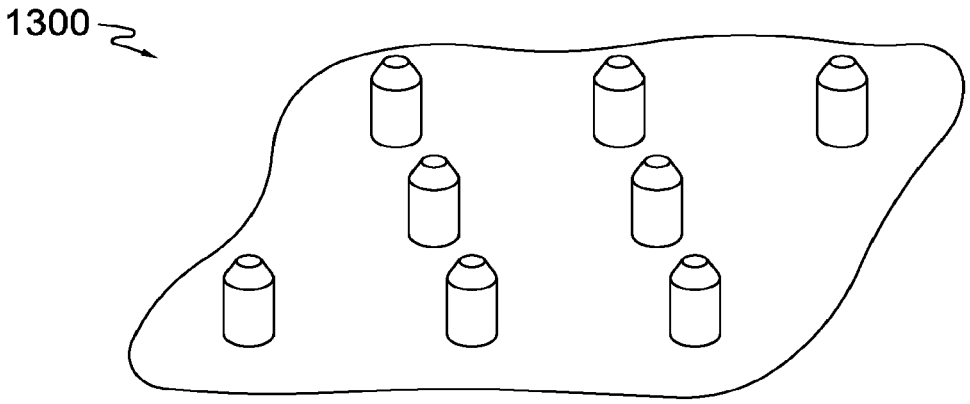
FIGS. 13-16 illustrate alternative shape configurations for stand-off nodes in accordance with aspects herein.
Figure 14:
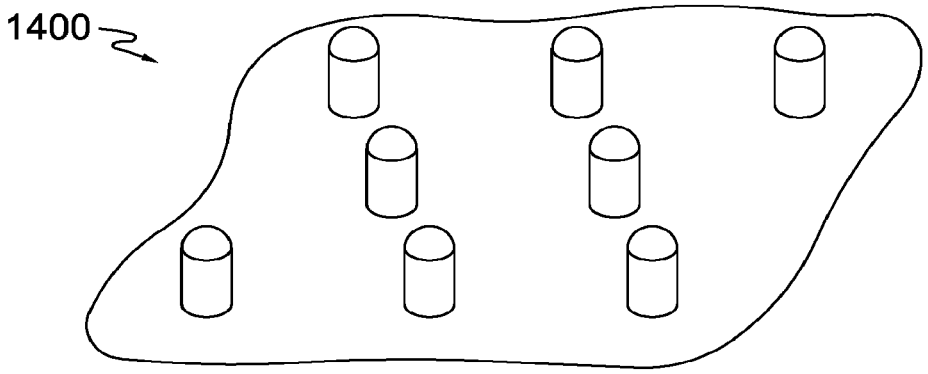

The stand-off nodes may have a number of exemplary shapes. For instance, with respect to FIG. 12, the stand-off nodes 1200 comprise a generally cylindrical shape with a flat top. FIG. 13 depicts another shape configuration for stand-off nodes 1300. In this figure, the nodes 1300 are cylindrical and the top of the nodes 1300 have more of a squared-off shape. Further, the stand-off nodes 1300 are shown in a staggered pattern instead of being aligned by rows and columns. FIG. 14 depicts cylindrical stand-off nodes 1400 having a rounded top. This shape configuration may minimize the surface area of the stand-off nodes that comes into contact with the wearer's skin and thus promote wearer comfort.

Figure 15:
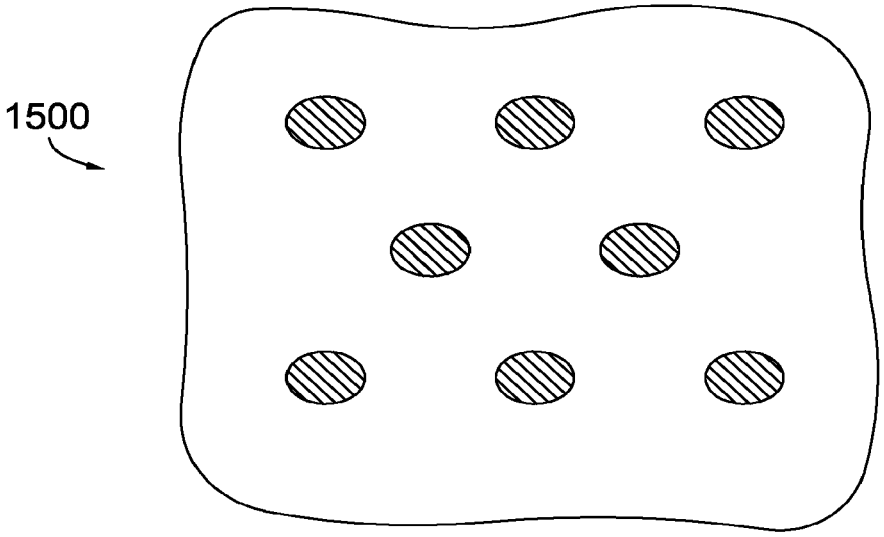
Figure 16:
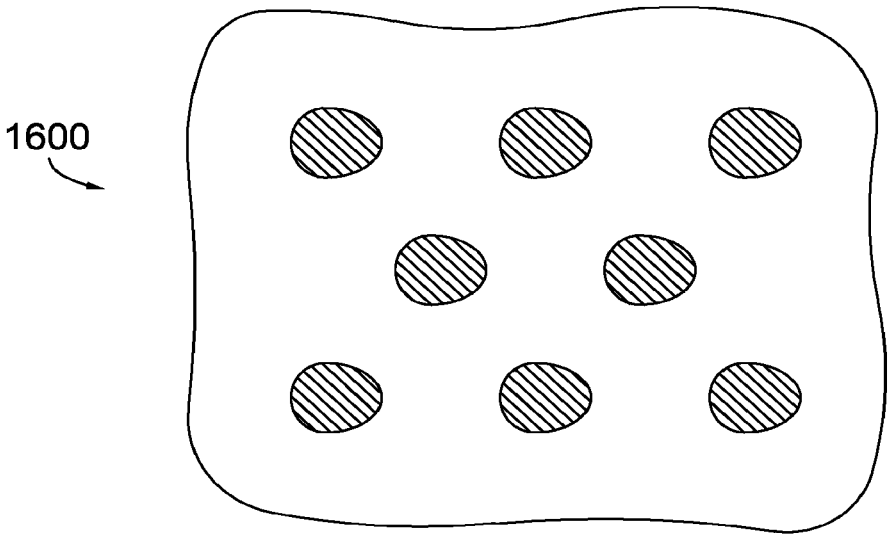

FIG. 15 is a top-down view of stand-off nodes 1500. While the stand-off nodes depicted in FIGS. 12-14 may have a circular cross-section, the stand-off nodes 1500 may have an ellipsoid cross-section or they may have an ovoid cross-section such as that shown for stand-off nodes 1600 in FIG. 16. In exemplary aspects, the long axis of the stand-off nodes 1500 or 1600 may be aligned on the inner-facing surface of the apparel item such that the long axis is in the direction of air-flow (as opposed to being perpendicular to air flow) as indicated by, for instance, air flow maps of the human body. By configuring the stand-off nodes 1500 or 1600 so that their long axes are aligned with determined air flow patterns within the apparel item described herein, the air may experience less impedance or blockage due to the presence of the stand-off nodes as the air circulates in the space between the inner-facing surface of the apparel item and the wearer's skin and more effective air flow patterns may result. It is contemplated herein that the stand-off nodes may assume other exemplary shapes and/or have other cross-sectional shapes such as square, triangular, rectangular, irregular, curvilinear, and the like. Any and all aspects, and any variation thereof, are contemplated as being within aspects herein.

As described, the exemplary apparel item may utilize stand-off nodes to achieve a predetermined level of stand-off. In aspects, the level of stand-off may be selected to allow relatively large volumes of air to circulate in the space between the inner-facing surface of the apparel item and the wearer's skin surface to help to cool the wearer by promoting evaporative heat transfer. In other aspects, the level of stand-off may be selected to help retain air in the space between the inner-facing surface of the apparel item and the wearer's skin surface to help insulate the wearer.

Monofilament Structures

Apparel items described herein may utilize a number of monofilament structures to increase the percent openness of the apparel item, act as venting structures, and/or to create stand-off. The monofilament structures may take the form of, for instance, a monofilament tape and a monofilament pipe structure.

Figure 19A:
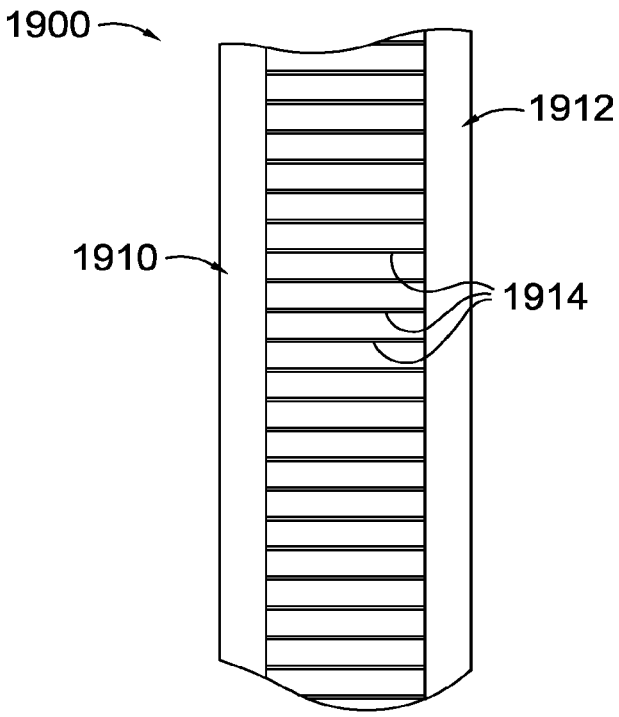
FIG. 19A illustrates a close-up view of a portion of an exemplary monofilament tape in accordance with aspects herein.

A portion of a monofilament tape, referenced generally by the numeral 1900, is depicted in FIG. 19A in accordance with aspects herein. In general, the monofilament tape 1900 comprises a first tape edge 1910 that is spaced apart from a second tape edge 1912. A plurality of monofilament strands 1914 formed from, for instance, nylon, are positioned between the first tape edge 1910 and the second tape edge 1912 such that the monofilament strands 1914 are evenly spaced along the length of the tape 1900. As depicted in FIG. 19A, the monofilament strands 1914 are spaced closely together with a small amount of open space left between each monofilament strand 1914. The open spaces comprise a fluid communication path from a first surface of the tape 1900 (e.g., an outer surface) to a second surface of the tape 1900 (e.g., an inner surface) through which ambient air (or other gases or liquids) can travel.

Figure 19B:
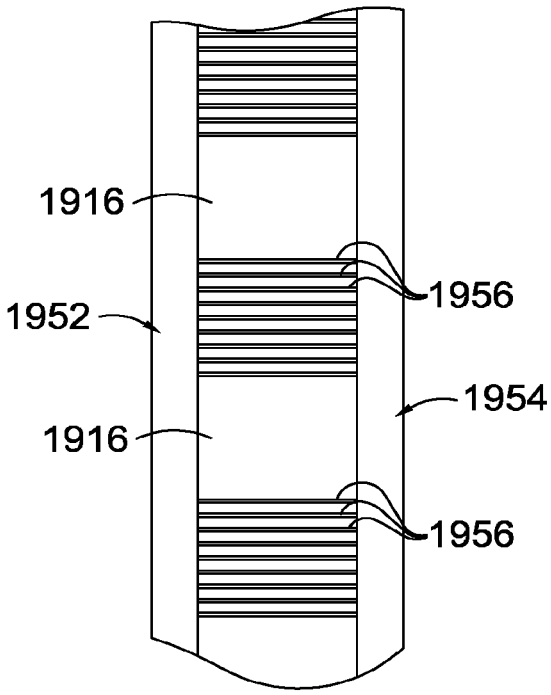
FIG. 19B illustrates an alternative configuration for the exemplary monofilament tape in accordance with aspects herein.

FIG. 19B depicts another exemplary monofilament tape 1950 having a first tape edge 1952 spaced apart from a second tape edge 1954 by monofilament strands 1956. Instead of the monofilament strands 1956 being evenly spaced along the length of the tape 1950, the monofilament strands 1956 are clustered into groups and larger-sized spaces 1916 are formed between adjacent groups. It is contemplated herein that different yarns may be intermingled with the monofilaments to increase wearer comfort when the tape 1900 and/or 1950 is incorporated into an apparel item. For instance, large denier polyester, cotton, or blended yarns may replace some of the monofilament strands to increase wearer comfort. Moreover, specialty yarns, fibers, or filaments may be intermingled with the monofilaments to provide functional properties to the monofilament tape. For example, metallic monofilaments or monofilaments having metallic-like properties may be utilized to reflect heat either away from the wearer or toward the wearer.

In one exemplary aspect, when the monofilament tape is incorporated into an apparel item, the monofilament tape may act as a venting structure. In exemplary aspects, the monofilament tape may be incorporated into apparel item by positioning the tape edges between different panels of the apparel item (e.g., at a seam line) and affixing the tape edges to the panel edges. As well, the monofilament tape may be incorporated by incising a portion of the apparel item and inserting the tape edges into the incised portion and securing the tape edges by, for example, bonding, adhesives, stitching, welding, and the like. Any and all aspects, and any variation thereof, are contemplated as being within the scope herein.

Figure 20:
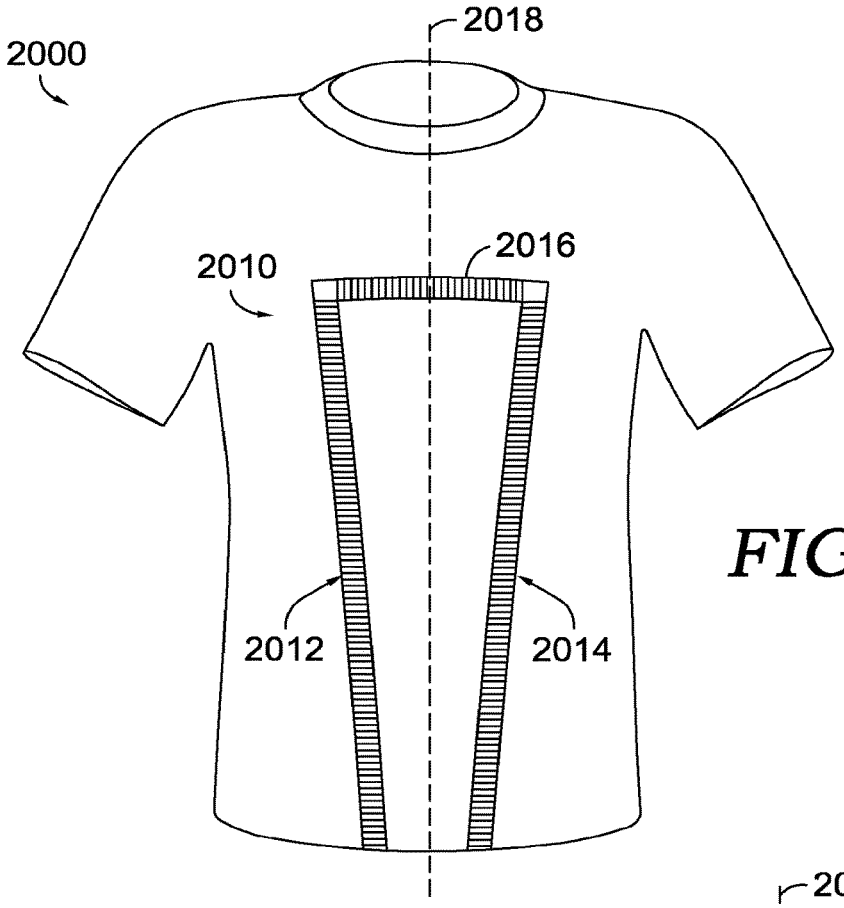
FIG. 20 illustrates a front view of an exemplary apparel item incorporating the exemplary monofilament tape of FIG. 19A in accordance with aspects herein.
Figure 21:
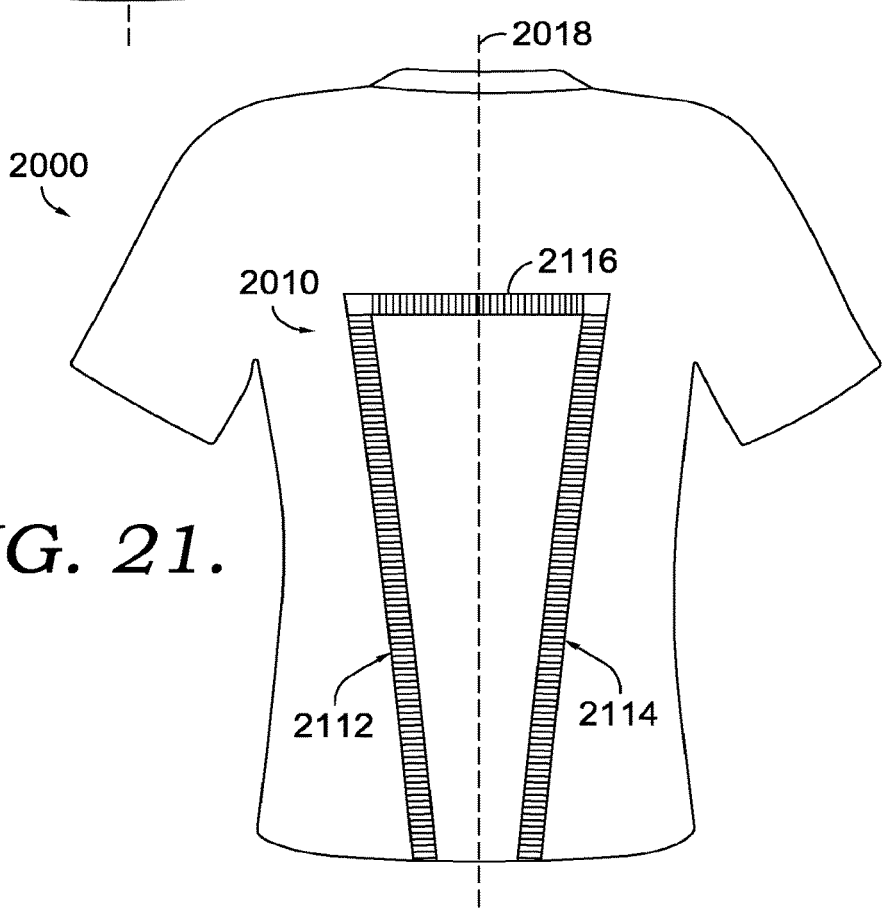
FIG. 21 illustrates a back view of the exemplary apparel item of FIG. 20 in accordance with aspects herein.

An exemplary apparel item 2000 utilizing a monofilament tape 2010 as a venting structure is depicted in FIGS. 20 and 21 which respectively depict front and back views of an outer-facing surface of the apparel item 2000 in accordance with aspects herein. As illustrated in FIG. 20, the monofilament tape 2010 is incorporated into the front of the apparel item 2000 in an inverted U-shaped configuration comprising, for instance, a first segment 2012, a second segment 2014, and a third segment 2016. The location of the different segments 2012, 2014, and/or 2016 may be based on, for instance, air flow maps and/or air pressure maps of the human body. In exemplary aspects, the first, second, and/or third segments 2012, 2014, and/or 2016 may be located in areas of high air flow and/or air pressure such that they act as inflow vents that capture air traveling over the front of the apparel item 2000 and funnel the air into the apparel item 2000.

In exemplary aspects, the first segment 2012 may be located on a first side of a hypothetical vertical midline 2018 bisecting the apparel item 2000 into generally equal right and left halves. The first segment 2012 may have a generally vertical orientation, or the first segment 2012 may be skewed from the vertical orientation such that it angles inwardly towards the midline 2018 as the vent travels towards from a top or superior edge to a bottom or inferior edge of the apparel item 2000 and as shown with respect to FIG. 20. The skewing may reflect the natural tapering that occurs from the chest area of a wearer to the waist area of the wearer. When the apparel item 2000 is in an as-worn configuration, the first segment 2012 is configured to be positioned adjacent to a front right torso area of the wearer.

Continuing, the second segment 2014 is generally located on a second side of the hypothetical vertical midline 2018.

The second segment 2014 may have a generally vertical orientation, or the second segment 2014 may be skewed from the vertical orientation such that it angles inwardly towards the midline 2018 as the segment 2014 travels from a top or superior edge towards a bottom or inferior edge of the apparel item 2000 to reflect the natural tapering that occurs from the chest area of the wearer to the waist area of the wearer. When the apparel item 2000 is in an as-worn configuration, the second segment 2014 is configured to be positioned generally adjacent to a front left torso area of the wearer. In an exemplary aspect, both the first and second segments 2012 and 2014 may extend to a bottom margin of the apparel item 2000, and in another exemplary aspect, the first and second segments 2012 and 2014 may terminate a predetermined distance from the bottom margin of the apparel item 2000. Any and all aspects, and any variation thereof, are contemplated as being within the scope herein.

In exemplary aspects, the third segment 2016 has a generally horizontal orientation. A first end of the third segment 2016 is located adjacent to an upper end of the first segment 2012, and a second end of the third segment 2016 is located adjacent to an upper end of the second segment 2014. This configuration causes the third segment 2016 to be located generally at a top portion of the apparel item 2000 such that it is positioned adjacent to an upper chest area of a wearer when the apparel item 2000 is worn.

Turning now to FIG. 21, a back view of the outer-facing surface of the apparel item 2000 of FIG. 20 is provided in accordance with aspects herein. In exemplary aspects, the back of the apparel item 2000 may comprise a similar inverted U-shaped configuration of monofilament tape 2010. Again, this configuration may be based on, for example, air flow maps and/or air pressure maps of the human body. For example, in some exercise situations that may involve a wearer running backward (e.g., soccer and basketball), air flow may be increased over the back of the wearer. By positioning the monofilament tape 2010 tape in this area, opportunities for capturing and funneling this air flow may be increased.

In exemplary aspects, the U-shaped configuration may comprise a fourth segment 2112, a fifth segment 2114, and/or a sixth segment 2116. In exemplary aspects, the fourth segment 2112 is located at the first side of the vertical midline 2018. The fourth segment 2112 may have a generally vertical orientation, or the fourth segment 2112 may be skewed from the vertical orientation such that it angles inwardly towards the vertical midline 2018 as the segment 2112 travels from a top or superior edge towards a bottom or inferior edge of the apparel item 2000 and reflects the natural tapering from the upper back area of the wearer to the waist area of the wearer. When the apparel item 2000 is in an as-worn configuration, the fourth segment 2112 is configured to be positioned adjacent to a back left torso area of the wearer.

The fifth segment 2114 is located to the right of the vertical midline 2018. The fifth segment 2114 may have a generally vertical orientation, or the fifth segment 2114 may be skewed from the vertical orientation such that it angles inwardly towards the midline 2018 as the segment 2114 travels from a top or superior edge towards a bottom or inferior edge of the apparel item 2000 and as shown with respect to FIG. 21. When the apparel item 2000 is in an as-worn configuration, the fifth segment 2114 is configured to be positioned adjacent to a back right torso area of the wearer. In an exemplary aspect, both the fourth and fifth segments 2112 and 2114 may extend to a bottom margin of the apparel item 2000, and in another exemplary aspect, the fourth and fifth segments 2112 and 2114 may terminate a predetermined distance from the bottom margin of the apparel item 2000. Any and all aspects, and any variation thereof, are contemplated as being within the scope herein.

Continuing, the sixth segment 2116 may have a generally horizontal orientation. In exemplary aspects, a first end of the sixth segment 2116 is generally located adjacent to an upper end of the fourth segment 2112, and a second end of the sixth segment 2116 is located adjacent to an upper end of the fifth segment 2114. This configuration causes the sixth segment 2116 to be located generally at a top portion of the apparel item 2000 such that it is positioned adjacent to an upper back area of a wearer when the apparel item 2000 is worn.

Figure 22:
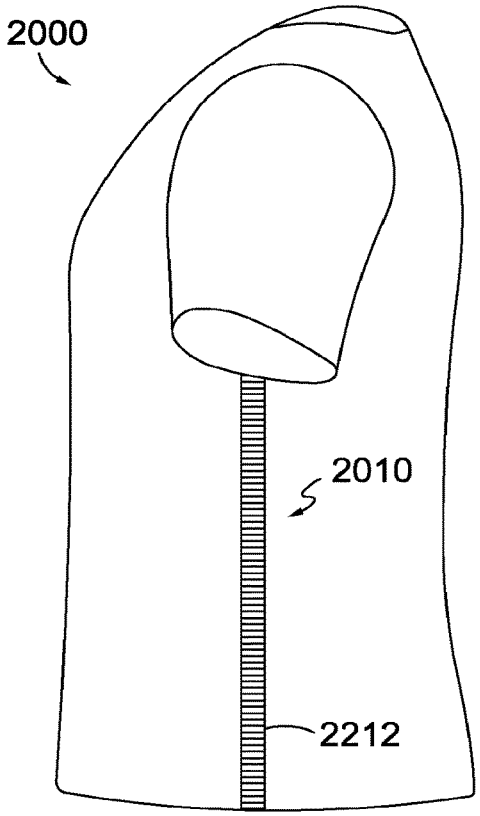
FIGS. 22-23 illustrate side views of the exemplary apparel item of FIG. 20 in accordance with aspects herein.
Figure 23:
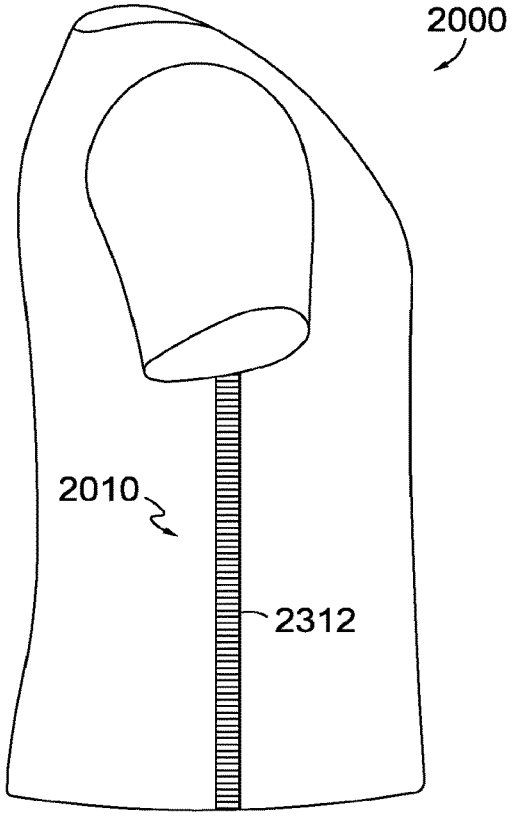

Turning now to FIGS. 22 and 23, a left side view and a right side view respectively of the apparel item 2000 are provided in accordance with aspects herein. In exemplary aspects, the monofilament tape 2010 may optionally be positioned along a mid-axillary line of the apparel item 2000 as a seventh segment 2212 shown in FIG. 22 and an eighth segment 2312 shown in FIG. 23. Based on air flow maps and/or air pressure maps, these locations may represent areas of relatively low air flow and/or air pressure. Thus, by positioning the segments 2212 and 2312 at these locations, the segments 2212 and 2312 may act as outflow vents by which air that is in the apparel item 2000 may exit the apparel item 2000.

Figure 24:
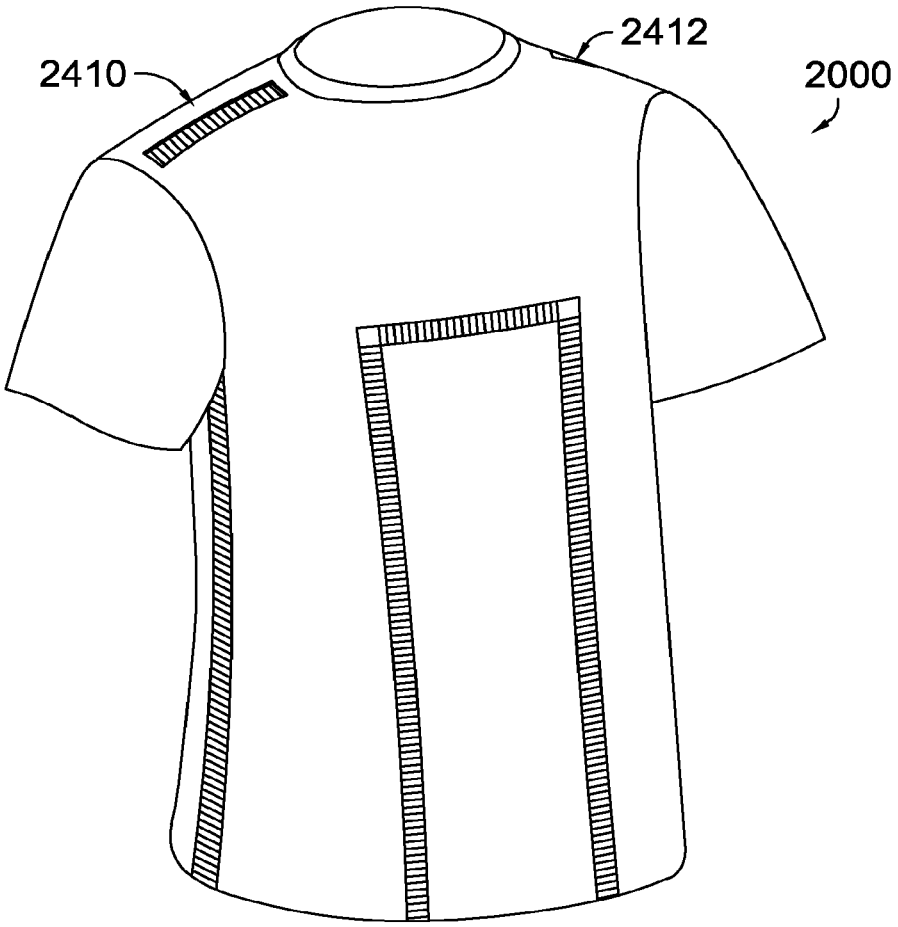
FIG. 24 illustrates a front perspective view of the exemplary apparel item of FIG. 20 indicating an additional location of the exemplary monofilament tape in accordance with aspects herein.

FIG. 24 depicts an optional additional location for the monofilament tape 2010. In an exemplary aspect, additional segments of the tape 2010 may be located at a shoulder area of the apparel item 2000. For instance, a first shoulder segment 2410 may be located at a right shoulder region of the apparel item 2000, and a second shoulder segment 2412 may be located at a left shoulder region of the apparel item 2000. Similar to the segments 2212 and 2312, the segments 2410 and 2412 may be located at areas of the apparel item 2000 that experience relatively low air flow and/or air pressure and thus may represent outflow vents by which air that is in the apparel item 2000 may exit the apparel item 2000. The location of the different segments of tape 2010 on the apparel item 2000 is exemplary only and it is contemplated herein that the tape 2010 may be incorporated at different and/or additional locations not shown.

As described earlier with respect to FIGS. 19A and 19B, spaces are formed between each of the monofilament strands where the spaces act as a communication path between a first surface of the tape and a second opposite surface of the tape. Thus, besides acting as a venting structure when incorporated into an apparel item such as the apparel item 2000, the monofilament tape described herein may also be used to increase the percent openness of the apparel item.

Figure 25A:
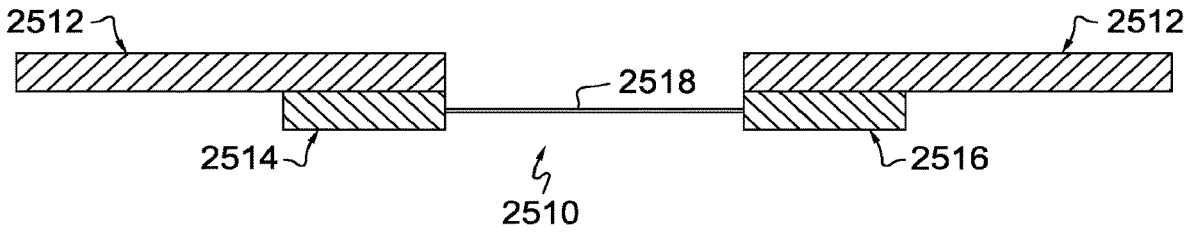
FIG. 25A illustrates a cross-sectional view of an exemplary monofilament tape incorporated into a textile in a non-tensioned state in accordance with aspects herein.
Figure 25B:
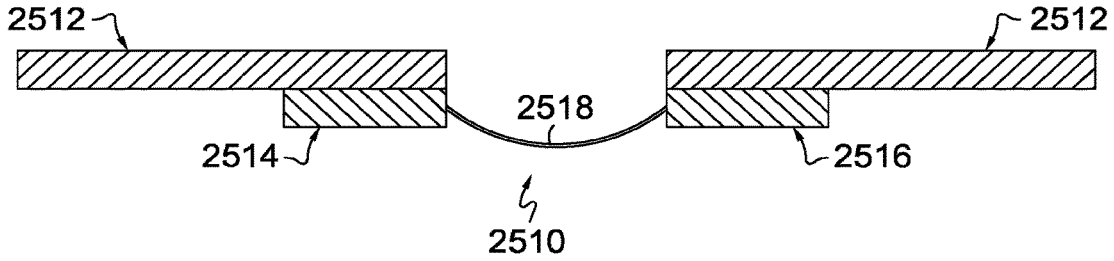
FIG. 25B illustrates a cross-sectional view of the exemplary monofilament tape of FIG. 25A where the monofilament tape is incorporated into the textile in a tensioned state in accordance with aspects herein.

In exemplary aspects, the monofilament tape may also be used to create stand-off between the inner-surface of an apparel item and a wearer's body surface. In a resting or non-tensioned state, the monofilament tape is generally flat or planar. Thus, when incorporated into an apparel item such as the apparel item 2000, the surface plane of the tape is generally parallel to the surface plane of the apparel item (i.e., it does not extend in the z-direction). To create stand-off, the tape may be incorporated into an apparel item such that the tape edges are biased toward one another causing the monofilament strands to bend or curve. This is depicted in FIGS. 25A and 25B which are cross-sectional views of a tape 2510 incorporated into a textile 2512 in accordance with aspects herein. With respect to FIG. 25A, the tape 2510 is incorporated into the textile 2512 in a non-tensioned state. More specifically, a first tape edge 2514 is affixed to a first edge of the textile 2512, and a second tape edge 2516 is affixed to a second edge of the textile 2512 such that the monofilament strands 2518 span the edges of the textile 2512. Because the tape 2510 is incorporated into the textile 2512 in a non-tensioned state, the monofilament strands 2518 are in a planar relationship with respect to the surface plane of the textile 2512.

FIG. 25B depicts the tape 2510 incorporated into the textile 2512 in a tensioned state. More specifically, the first and second tape edges 2514 and 2516 are positioned closer to one another as compared to FIG. 25A. In exemplary aspects, the monofilaments strands 2518 exhibit a degree of rigidity due to, for instance, the denier of the strand and/or their composition (e.g., nylon). Thus, when the tape edges 2514 and 2516 are biased toward each other, the monofilament strands 2518 assume a non-planar relationship with both the tape edges 2514 and 2516 and with the textile 2512. In other words, the strands 2518 bow or curve outward (i.e., extend in the z-direction). When the textile 2512 is formed into an apparel item, the curved portion of the monofilament strands 2518 may be positioned facing inward or toward a body surface of a wearer when the apparel item is worn. The curved monofilament strands 2518 may then be used to create stand-off from the wearer's body.

Figure 26:
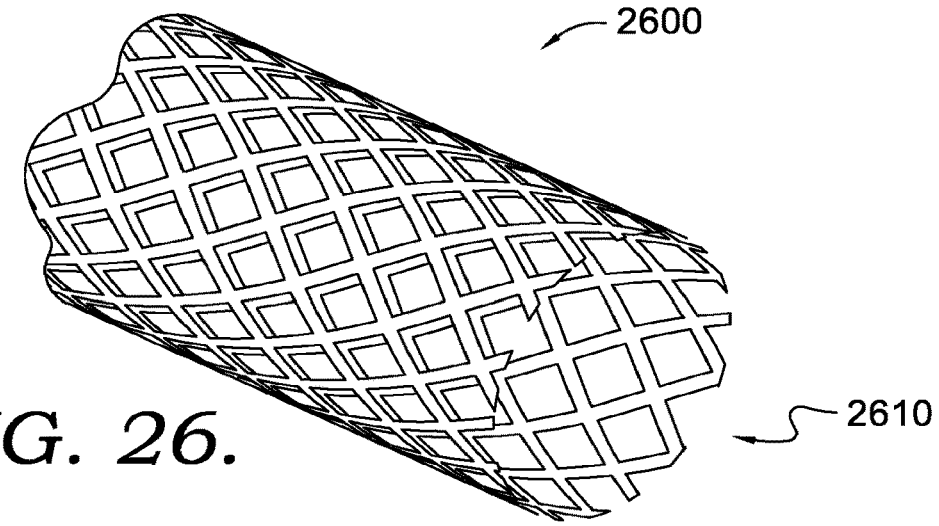
FIG. 26 illustrates a perspective view of an exemplary monofilament pipe structure in accordance with aspects herein.

Aspects herein further contemplate using monofilament pipe structures to, for instance, create stand-off and/or to increase openness of an apparel item. In general, monofilament pipe structures comprise monofilament strands (nylon, metallic monofilaments, and the like) that are manipulated to form a tubular structure having a hollow core. An exemplary monofilament pipe structure 2600 is shown in FIG. 26 in accordance with aspects herein. Individual monofilament strands are manipulated (e.g., braided, knitted, woven, molded, or the like) to form an open latticework tube structure having a hollow core as indicated by reference numeral 2610. As such, air can move freely through the pipe structure 2600. Moreover, the pipe structure 2600 is configured to be bendable and stretchable.

Figure 27:
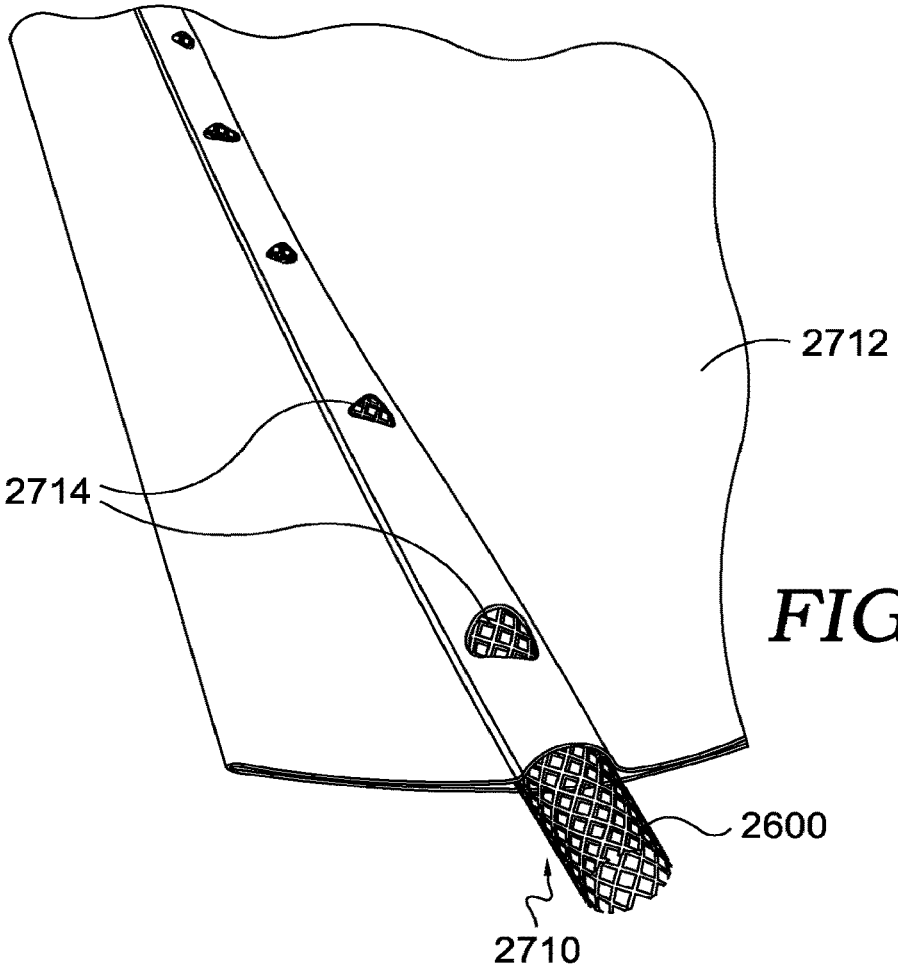
FIG. 27 illustrates a textile incorporating the exemplary monofilament pipe structure of FIG. 26 in accordance with aspects herein.

In exemplary aspects, the pipe structure 2600 may be incorporated into an apparel item by positioning the pipe structure 2600 within a channel and/or by positioning the pipe structure 2600 within a seam on the apparel item. For example, FIG. 27 depicts the pipe structure 2600 incorporated into a channel 2710 formed on a textile 2712. In exemplary aspects, the channel 2710 may be formed between two layers of material as shown in FIG. 27, or the channel 2710 may be formed in a single layer of material by, for example, modifying a knitting or weaving process to create the channel 2710. Continuing, openings 2714 may be created in the textile 2712 such that the pipe structure 2600 is exposed at one or more locations along the channel 2710. Thus, a fluid communication path is established between an environment outside the textile 2712 and the pipe structure 2600.

When the textile 2712 is formed into an apparel item, the pipe structure 2600 may be used to create stand-off due to its tube-like structure. Moreover, since it is bendable and stretchable, it may be incorporated into the apparel item at locations that are positioned adjacent to curved surfaces of the wearer's body. Moreover, use of the pipe structure 2600 in combinations with the openings 2714 in the textile 2712 may contribute to the present openness of the apparel item.

As described, monofilament tapes and monofilament pipe structures may be incorporated into apparel items to create stand-off, to act as venting structures, and/or to increase the percent openness of the apparel item.

Slit Structures

Apparel items described herein may use slit structures to, for instance, increase the percent openness of the apparel item and/or to act as venting structures. Further, the slit structures may be configured to transition from a closed state to an open state in response to tension forces generated by the wearer.

Figure 28:
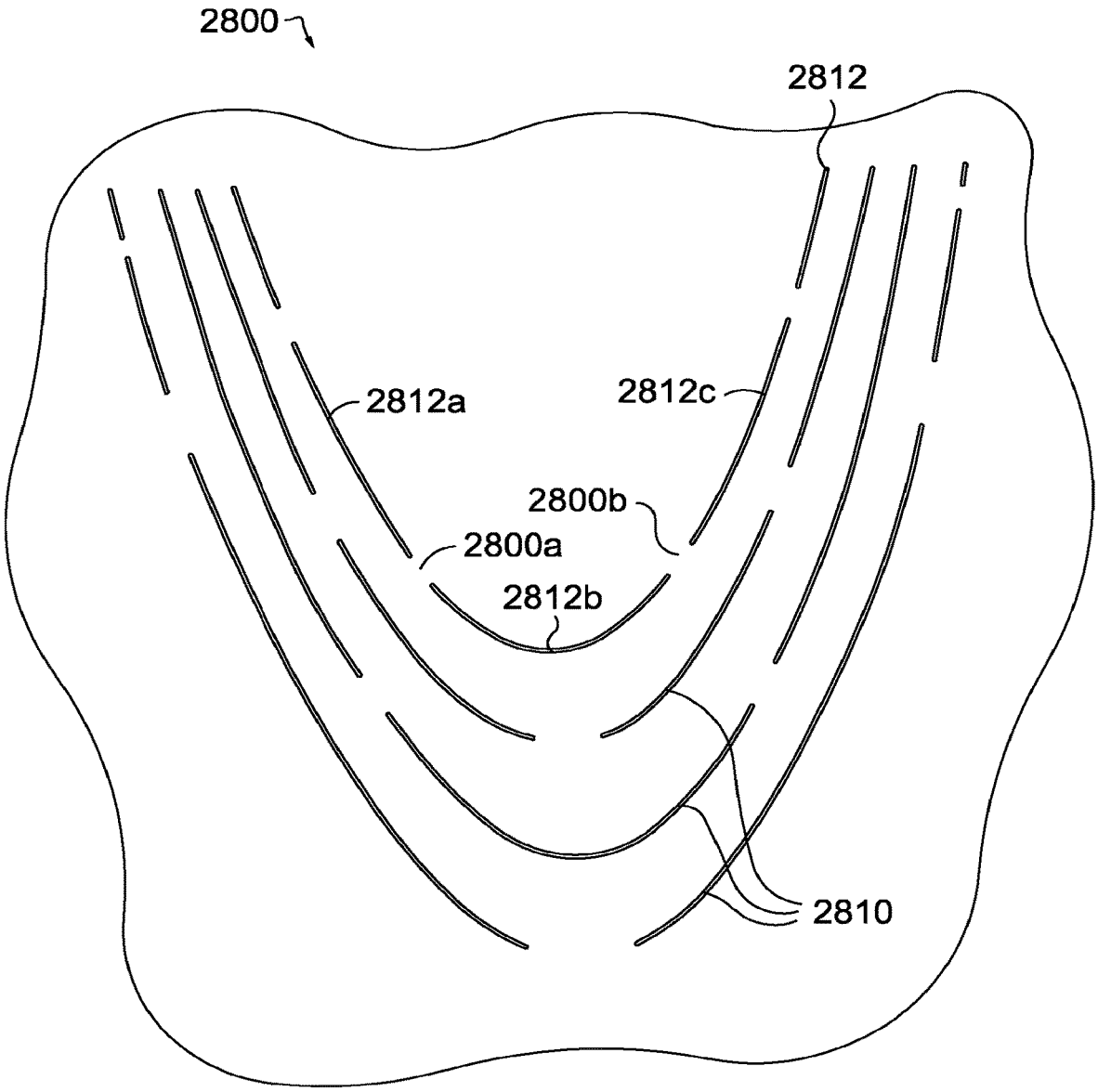
FIG. 28 illustrates an exemplary slit structure configured to be incorporated into an apparel item in accordance with aspects herein.

A first exemplary slit structure is depicted in FIG. 28 in accordance with aspects herein. A portion of a textile 2800 is shown having slits 2810. The slits 2810 extend through the thickness of the textile 2800 such that a fluid communication path is formed between a first surface of the textile 2800 and a second opposite surface of the textile 2800. The slits 2810 may be formed by, for instance, mechanical cutting, laser cutting, water-jet cutting, and the like. In an additional aspect, when the textile 2800 is formed using reactive or stimulus-responsive yarns, the slits 2810 may be formed by dissolving the reactive yarns in selected locations.

Continuing, a particular slit, such as slit 2812, may be formed in a discontinuous manner such that portions of the textile 2800 along the slit path are not incised. For instance, the slit 2812 comprises a first segment 2812*a*, a second segment 2812*b*, and a third segment 2812*c* with textile portions 2800*a* and 2800*b* connecting the different slit segments. To put it another way, a particular slit may be formed in a discontinuous manner such that portions of the textile 2800 connect the different segments. This construction helps to maintain the structural integrity of the textile 2800 both in a non-tensioned state and in a tensioned state.

Figure 29:
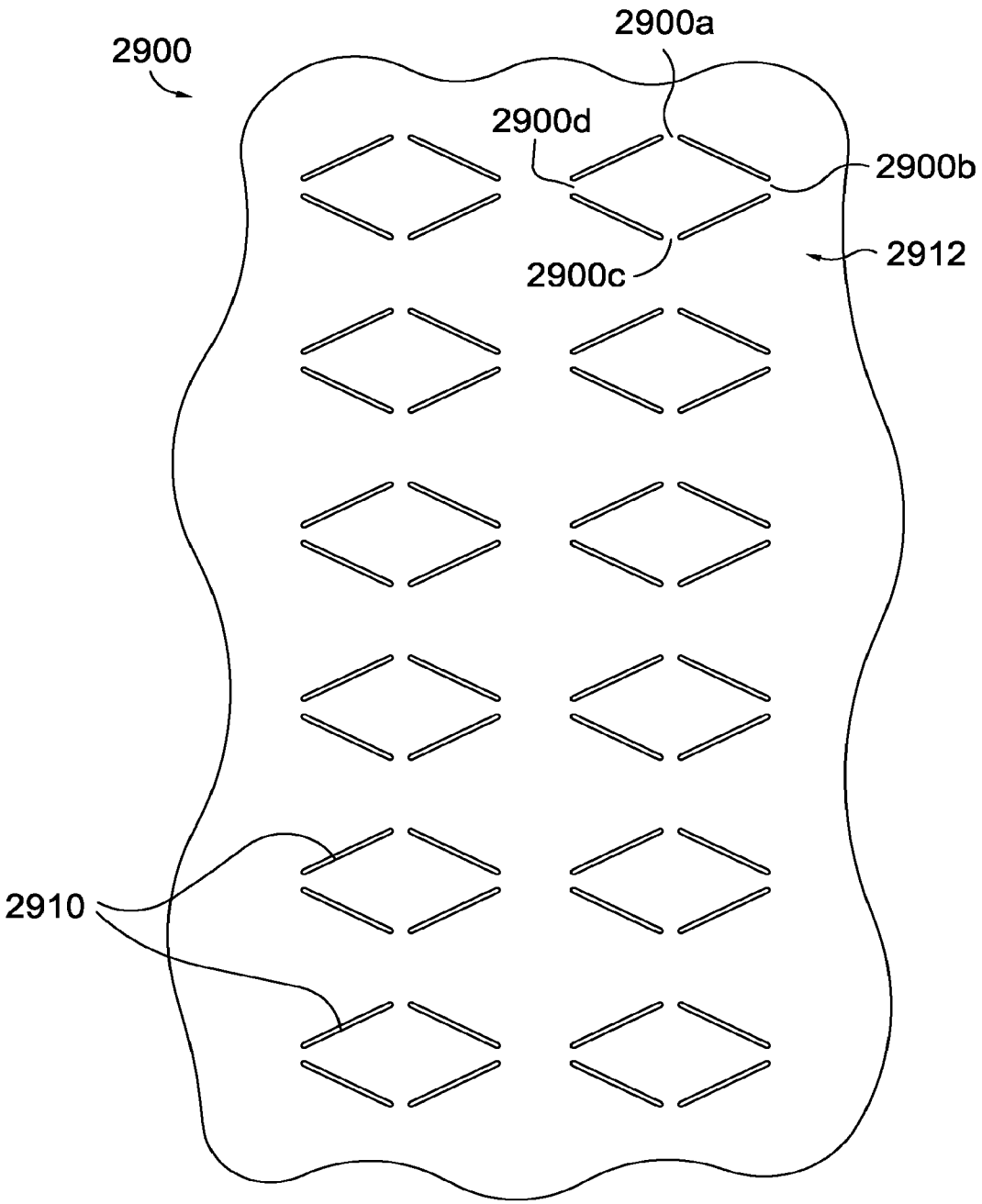
FIG. 29 illustrates an alternative slit structure configured to be incorporated into an apparel item in accordance with aspects herein.

FIG. 29 illustrates another exemplary slit structure in accordance with aspects herein. A portion of a textile 2900 is shown having a plurality of slits 2910. The slits 2910 extend through the thickness of the textile 2900 to form a fluid communication path from a first surface of the textile 2900 to a second opposite surface of the textile 2900. Each slit 2910, such as slit 2912 is discontinuously formed such that portions of the textile 2900 remain between the different slit segments as indicated by the reference numerals 2900*a*, 2900*b*, 2900*c*, and 2900*d*. Again, this configuration helps to maintain the structural integrity of the textile 2900 when both in a tensioned and non-tensioned state. The slit structures depicted in FIGS. 28 and 29 are exemplary only, and it is contemplated herein that alternative patterns may be used. For instance, the slit structures may comprise a series of horizontal slits, vertical slits, circular slits, and the like. Any and all aspects, and any variation thereof, are contemplated as being within aspects herein.

In exemplary aspects, a liner layer may be positioned adjacent to the slit structures on one side of the textile. The liner layer may be useful when larger slits are used as a further means to maintain the structural integrity of the textile. In exemplary aspects, the liner layer may comprise a material permeable to air such as, for example, a mesh material.

Figure 30A:
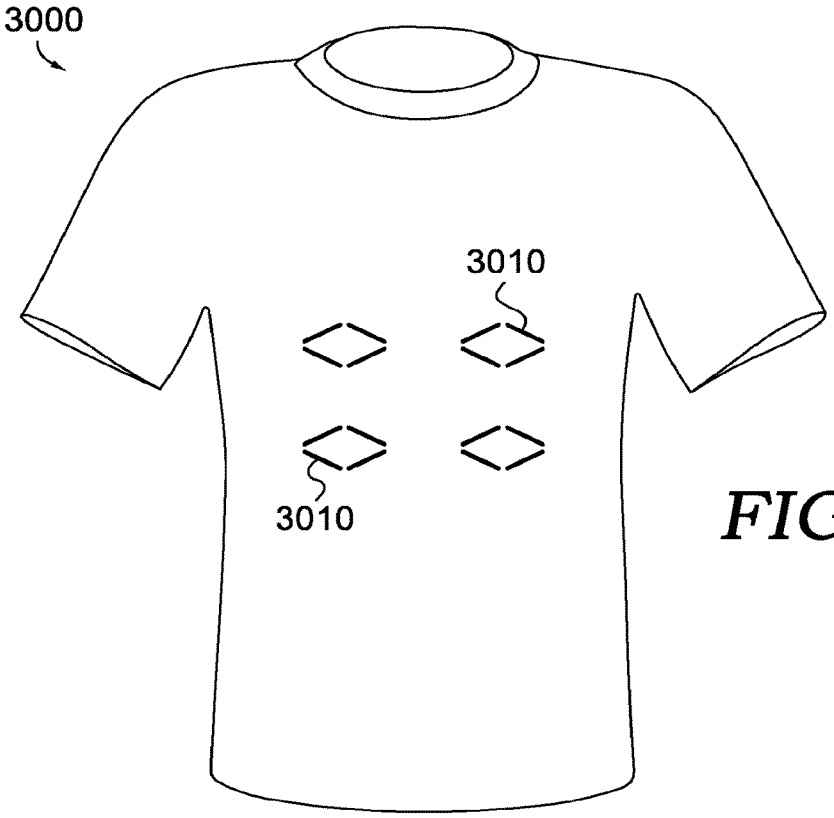
FIG. 30A illustrates an exemplary apparel item in a resting state where the apparel item incorporates the slit structure of FIG. 29 in accordance with aspects herein.
Figure 30B:
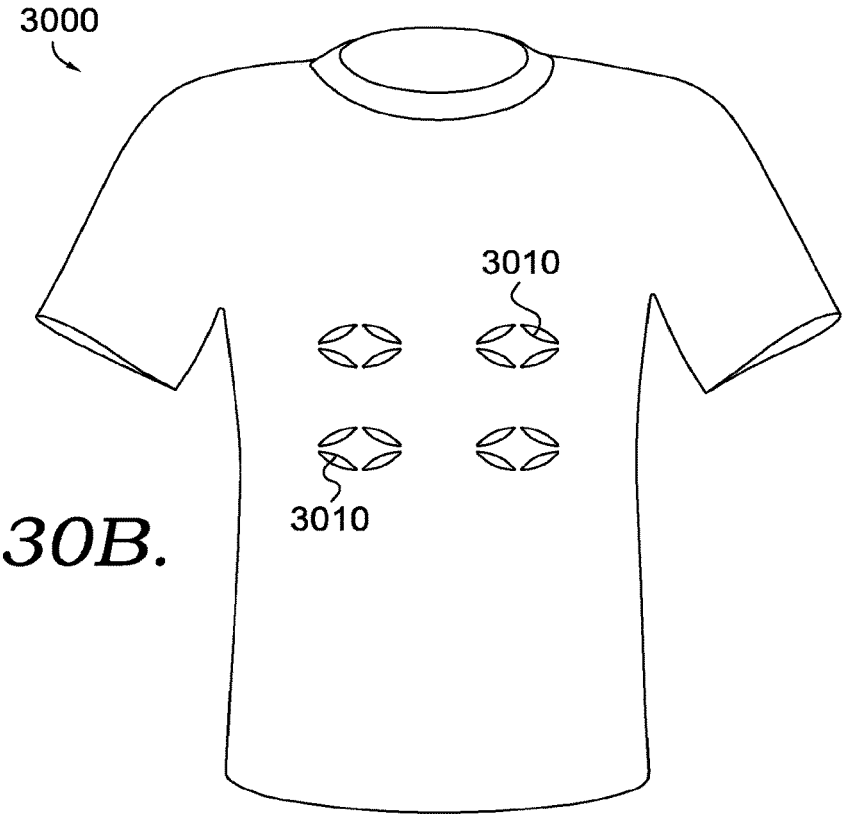
FIG. 30B illustrates the exemplary apparel item of FIG. 30A in a tensioned state in accordance with aspects herein.

When the textile having the slit structures is incorporated into an apparel item, the slits may increase the percent openness of the apparel item. Further, the slit structures may be positioned at areas of high air flow and/or high air pressure to act as venting structures. A depiction of this is shown in FIGS. 30A and 30B which illustrate an apparel item 3000 having slits 3010 positioned primarily over the front of the apparel item 3000 in accordance with aspects herein. More specifically, FIG. 30A represents the apparel item 3000 in a resting or non-tensioned state and FIG. 30B represents the apparel item 3000 in a tensioned state. As mentioned above, the front of an apparel item often represents an area of high air flow and/or air pressure during exercise or movement.

With respect to FIG. 30A, because the slits 3010 extend through the thickness of the material forming the apparel item 3000 they allow for movement of air between the exterior and the interior of the apparel item 3000 even when the wearer is resting or not exercising (i.e. when the apparel item 3000 is in a non-tensioned state). FIG. 30B illustrates the apparel item 3000 in a tensioned state. This may be due to, for example, the wearer initiating movement or beginning to exercise. The wearer's movements cause tension at various locations on the apparel item 3000. Some of these tensioning forces cause the edges of the slits 3010 to pull apart thereby increasing the sizes of the slits and allowing a greater quantity of air to be exchanged between the interior and the exterior of the apparel item 3000. Further, when in an open state such as shown in FIG. 30B, the slit edges may act as scoops helping to capture air traveling over the front of the apparel item 3000. It is contemplated herein that additional slit structures may be located along the sides and back of the apparel item 3000.

As described, the slit structures may help to increase the percent openness of the apparel item and may act as venting structures. Their ability to transition from a closed state when the wearer is resting to an open state when the wearer moves, may assist the wearer in retaining body heat when at rest and dissipating body heat during exercise.

Figure 37:
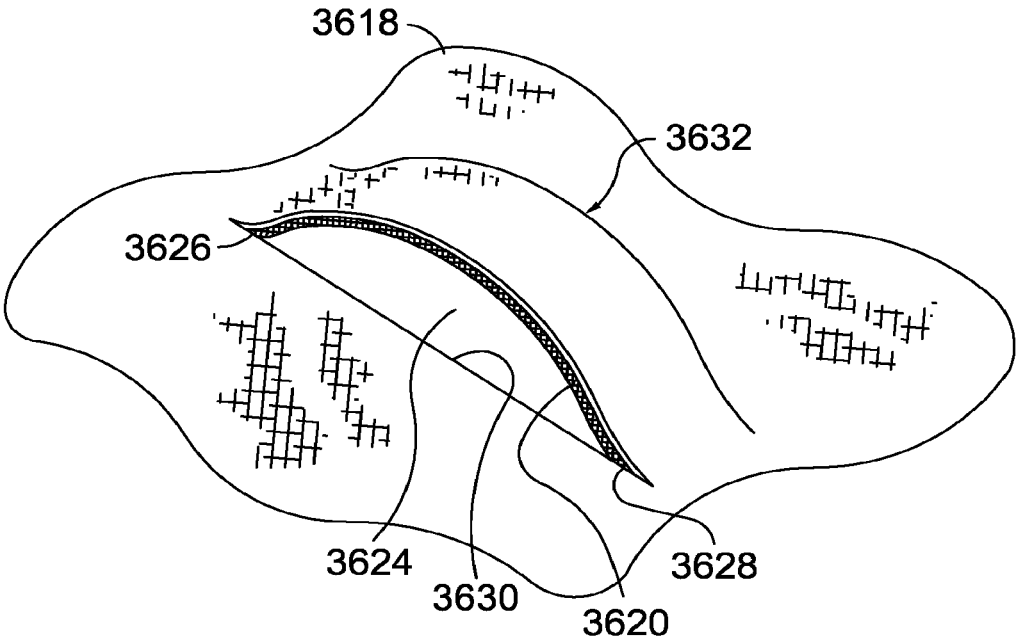
FIG. 37 illustrates an exemplary textile material comprising a trim piece positioned within an opening in the textile material in accordance with aspects herein.

FIG. 37 illustrates an exemplary textile material 3618 comprising a trim piece positioned within a slit or opening in the textile material 3618 in accordance with aspects herein. The textile material 3618 may comprise a panel of material that is knit, woven, or non-woven. A portion of the textile material 3618 is shown comprising an opening 3624 defined by a first end 3626, a second end 3628, a first edge 3630, and a second edge 3632. The opening 3624 may be formed by incising the textile material 3618 to create the first and second edges 3630 and 3632. Alternatively, the opening 3624 may be formed by modifying a knitting or weaving process used to form the textile material 3618 to create the opening 3624. The textile material 3618 can be incised through a variety of means including mechanical incision, water jet cutting, ultrasonic cutting, laser cutting, and the like.

After the opening 3624 is formed, at least one elastically resilient trim piece 3620 may be positioned within the opening 3624 to maintain the opening 3624 in an open state. The elastically resilient trim piece 3620 comprises a material that is able to deform in response to a force and return to its resting state once the force is removed. Exemplary materials may comprise, for example, monofilaments that are knitted, woven, braided, or otherwise manipulated to create the trim piece 3620. This is just one example, and other materials are contemplated herein for creating the trim piece 3620. In exemplary aspects, the trim piece 3620 may be formed to have an "arched" shape in a resting state. The arched shape may help to keep the opening 3624 in an open state. Moreover, by forming the trim piece 3620 from an elastically resilient material, the trim piece 3620 may flex, bend, straighten, and the like in response to external forces. For instance, when the trim piece 3620 is incorporated into an apparel item, the ability of the trim piece 3620 to flex and bend may help improve wearer comfort and help improve the wearer's freedom-of movement.

The opening 3624 in the textile material 3618 facilitates airflow between an inner surface and an outer surface of an apparel item formed from the textile material 3618. Further, the opening 3624 may be positioned at areas of high air flow and/or high air pressure, such as a front torso area of an apparel item, to act as a venting structure. Additionally, the opening 3624 and trim piece 3620 may vary in size and shape. The structure and shape depicted in FIG. 37 is exemplary only, and it is contemplated herein that alternative configurations may be used. Any and all aspects, and any variations thereof are contemplated as being within aspects herein.

Figure 38:
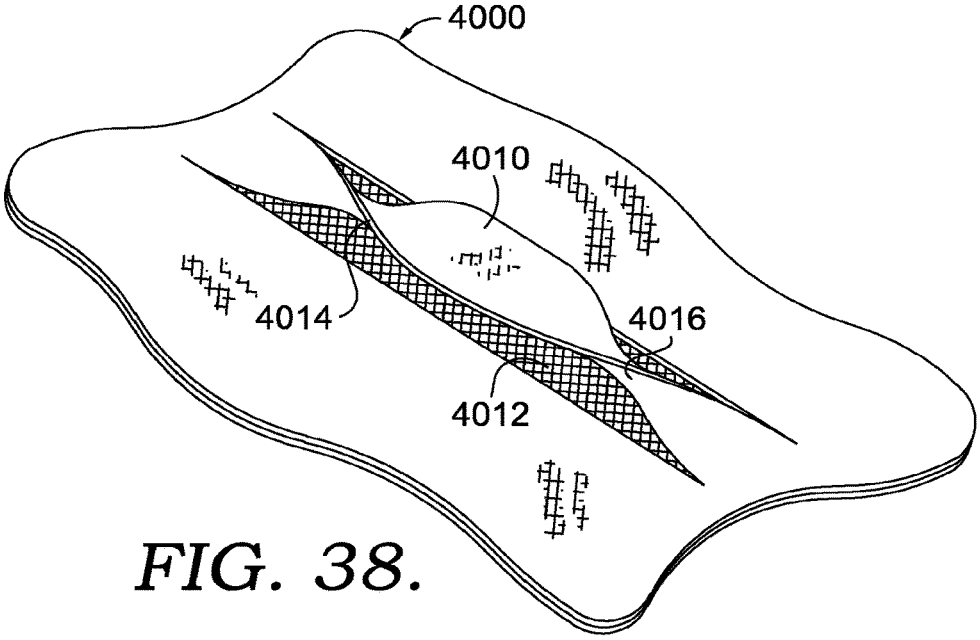
FIG. 38 illustrates an exemplary textile material comprising a textile segment that has been incised from the textile material and twisted in accordance with aspects herein.
Figure 39:
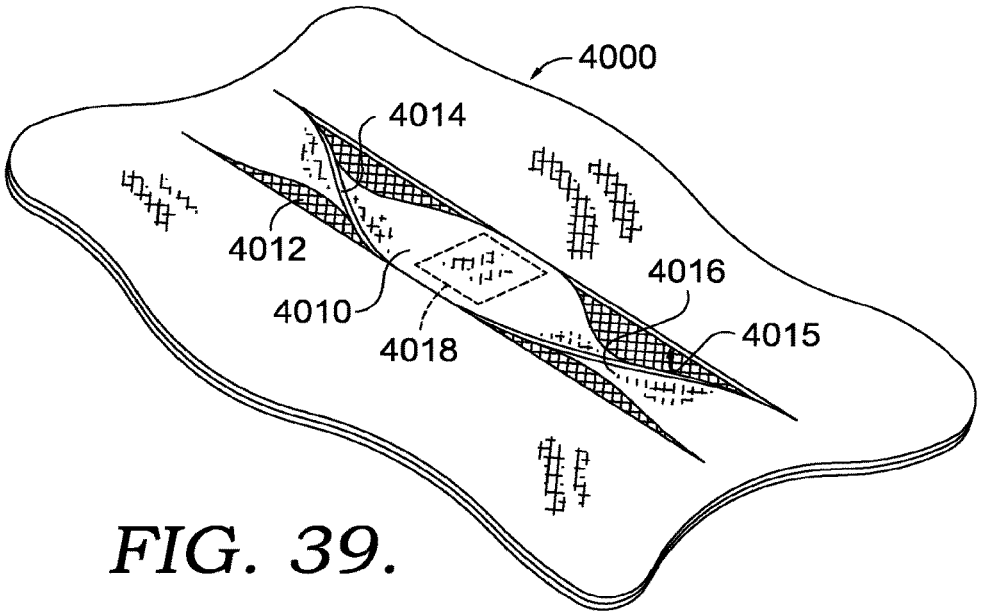
FIG. 39 illustrates the exemplary textile material of FIG. 38 where the twisted textile segment has been affixed to a second textile material in accordance with aspects herein.

FIG. 38 illustrates another exemplary textile material 4000 in accordance with aspects herein. As mentioned above, the textile material may comprise a panel of material that is knit, woven, or non-woven. A portion of the textile material 4000 is shown having a textile segment 4010 that has been formed from the textile material 4000. In one exemplary aspect, the textile segment 4010 may be formed by partially incising the textile material 4000 to form the textile segment 4010 (e.g., incising the textile material 4000 along two opposing sides). In other aspects, the textile segment 4010 may be formed by modifying the knitting, weaving or other manufacturing process used to form the textile material 4000. In exemplary aspects, the textile segment 4010 may be twisted to form twisted folds at a first location 4014 and a second location 4016. As shown in FIG. 39, after the textile segment 4010 has been twisted, the textile segment 4010 may be maintained in a twisted state by affixing the twisted textile segment 4010 to a second textile material 4012 positioned adjacent to a first surface 4015 of the textile material 4000. In exemplary aspects, the second textile material 4012 may comprise a material permeable to air, such as, for example, a mesh material. Moreover, in exemplary aspects, at least the second textile material 4012 may comprise a material exhibiting a low degree of stretch (e.g., a non-stretch material), so as to minimize distortion of the twisted textile segment 4010 when the textile material 4000 is subject to tensioning forces.

Continuing, the textile segment 4010 may be engaged with or affixed to the second textile material 4012 through any method which permanently (or releasably) affixes the textile segment 4010 to the second textile material 4012. For example, an adhesive may be used to affix textile segment 4010 at its center 4018 to the second textile material 4012. Additionally, the textile segment 4010 may be affixed by being sewn, being welded, being bonded, and the like onto the second textile material 4012.

The folds created by twisting the textile segment 4010, such as the twisted folds, help to not only create a vent-type structure but also help to create stand-off between the textile material 4000 and the second textile material 4012. By forming the second textile material 4012 from a mesh-like material, this configuration facilitates airflow between an inner surface and outer surface of an apparel item incorporating the textile material 4000. The structure shown in FIGS. 38 and 39 may be located on an apparel item in areas that experience a high degree of air flow or air pressure. Exemplary locations may comprise, for instance, the front portions of an apparel item (e.g., along the central front torso area of a top). The structures depicted in FIGS. 38-39 are exemplary only, and it is contemplated herein that alternative configurations may be used. Any and all aspects, and any variations thereof, are contemplated as being within aspects herein.

Figure 40:
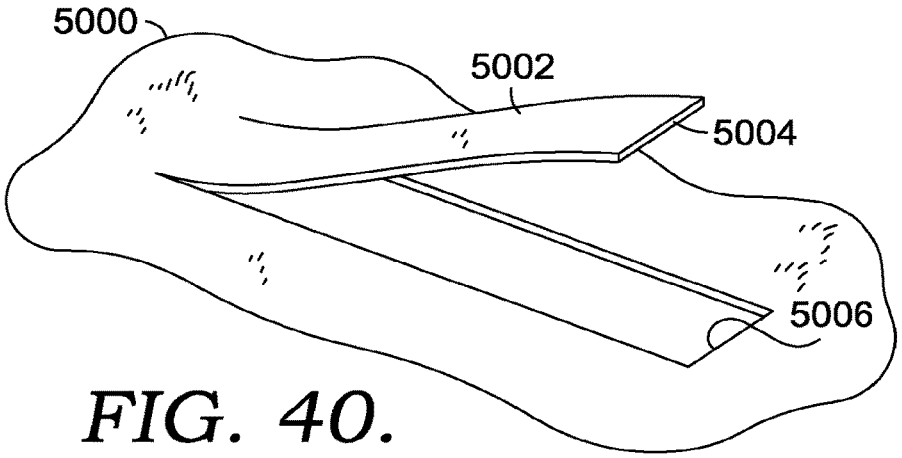
FIG. 40 illustrates an exemplary textile material comprising a textile segment where the first end of the textile segment is disengaged from the textile material in accordance with aspects herein.
Figure 41:
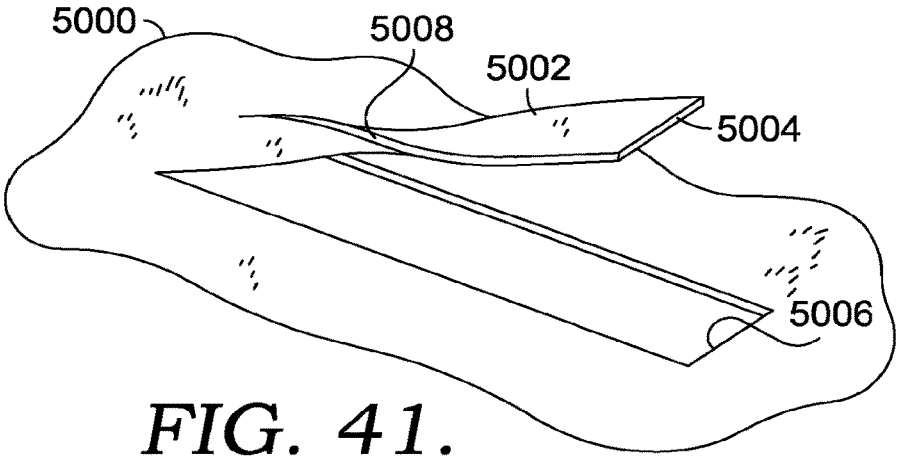
FIG. 41 illustrates the exemplary textile material of FIG. 40 where the textile segment is twisted in accordance with aspects herein.
Figure 42:
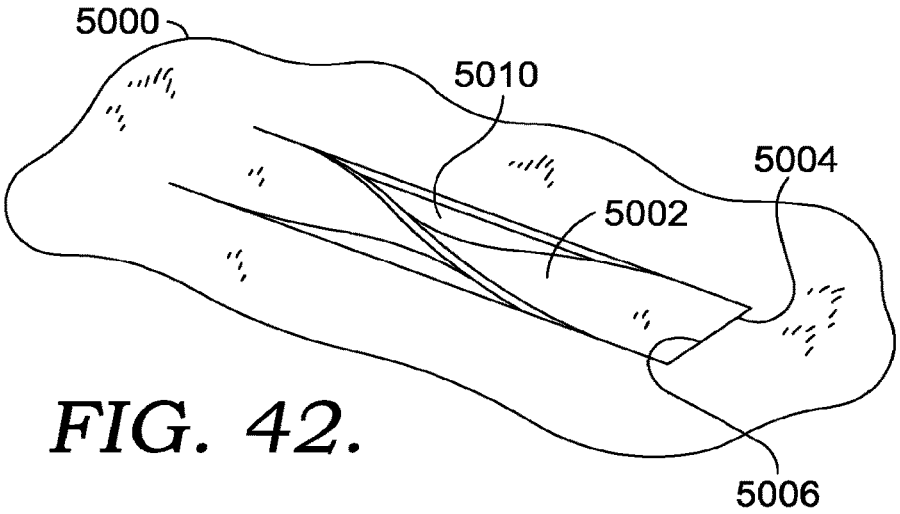
FIG. 42 illustrates the exemplary textile material of FIG. 41 where the first end of the textile segment is re-engaged with the textile material in accordance with aspects herein.

FIGS. 40-42 illustrate another exemplary textile material 5000 having a textile segment 5002 in accordance with aspects herein. Once again, the textile material 5000 may comprise a panel of material that is knit, woven, or non-woven. In FIG. 40, a first end 5004 of the textile segment 5002 is disengaged from the textile material 5000 at a disengagement point 5006. The first end 5004 may be disengaged by laser cutting, mechanical incising, water-jet cutting, ultrasonic cutting, and the like. Following the disengagement of the textile segment 5002 from the textile material 5000 at the disengagement point 5006, the textile segment 5002 is twisted at 5008 as shown in FIG. 41. After the textile segment 5002 has been twisted, the first end 5004 of the textile segment 5002 may be re-engaged to the textile material at 5006 at the disengagement point 5006 as shown in FIG. 42. The textile segment 5002 may be re-attached to the textile material 5000 at the disengagement point 5006 using, for example, an adhesive, welding, bonding, or by sewing the first end 5004 to the disengagement point 5006. The incising of the textile segment 5002, twisting of the textile segment 5002 and re-attachment to the textile material 5000 creates a vent structure or opening 5010 that facilitates airflow between an outer surface and inner surface of an apparel item formed from the textile material 5000. Moreover, airflow may be further facilitated by the folds created by twisting the textile segment 5002. The folds help to create stand-off between the textile material 5000 and an underlying surface such as, for example, a wearer's body surface. In exemplary aspects, the textile material 5000 in FIGS. 40-42 may comprise a non-stretch material to minimize distortion of the twisted textile segment 5002 when the textile material 5000 is subject to tensioning forces. The structure shown in FIGS. 40-42 may be located on an apparel item in areas that experience a high degree of air flow or air pressure. Exemplary locations may comprise, for instance, the front portions of an apparel item (e.g., along the central front torso area of a top). The structures depicted in FIG. 40-42 are exemplary only, and it is contemplated herein that alternative configurations may be used. Any and all aspects, and any variations therefor, are contemplated as being within aspects herein.

Figure 43:
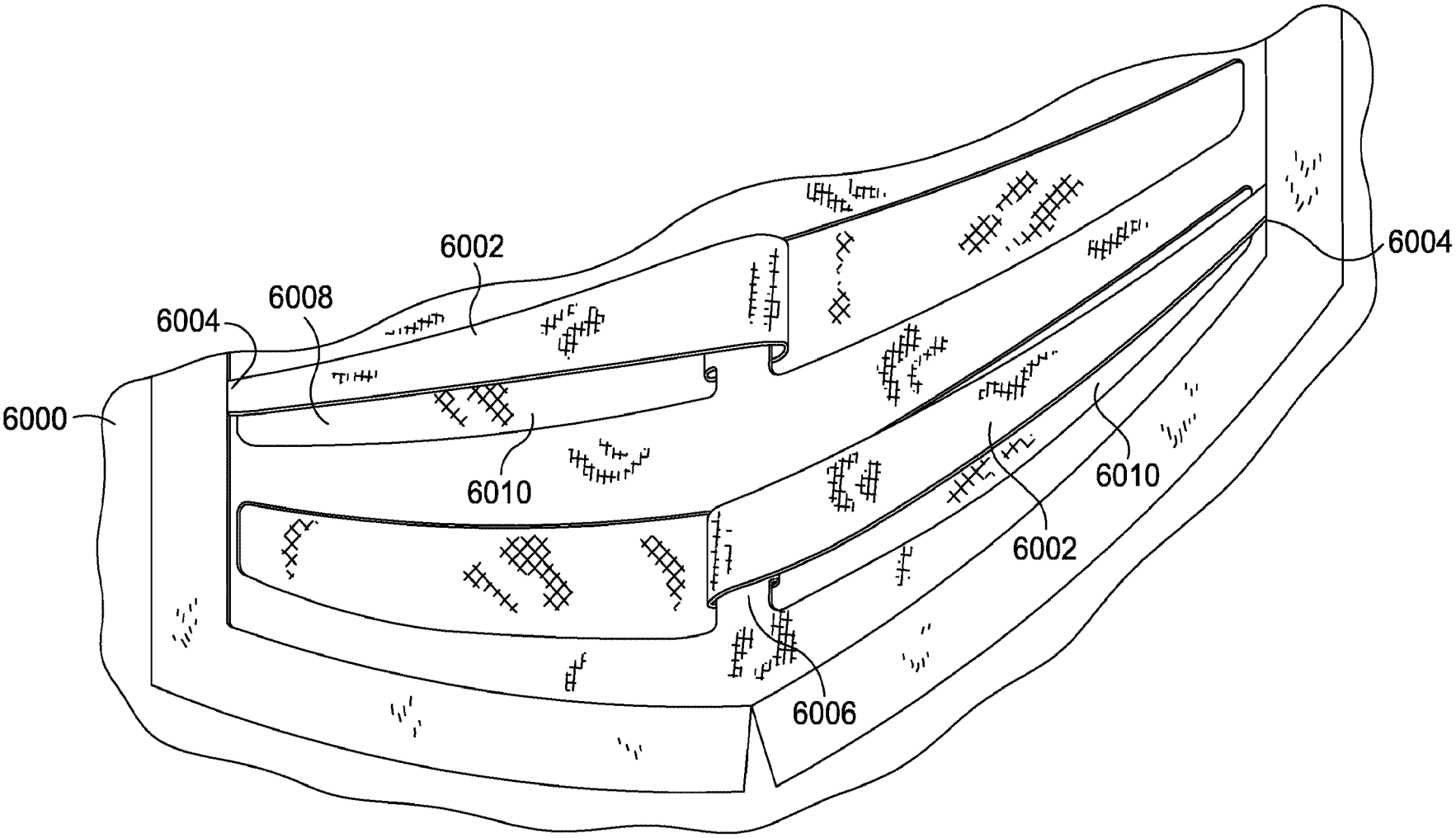
FIG. 43 illustrates an exemplary textile material comprising a plurality of textile segments where the textile segments are incised from the textile material at a first end, twisted around a central anchoring portion and re-engaged to the textile material at the first end in accordance with aspects herein.

FIG. 43 illustrates another exemplary textile material 6000 in accordance with aspects herein. The textile material 6000 may comprise a panel of material that is knit, woven, or non-woven. The textile material 6000 comprises several textile segments 6002 which have been disengaged from the textile material 6000 at a respective first end 6004. After disengagement, the first ends 6004 are twisted around a central fixed strap or anchoring strap 6006. Following this, the textile segments 6002 are reattached to the textile material 6000 at their respective first ends 6004. This configuration creates multiple openings 6008 for facilitating air flow.

As further shown in FIG. 43, in exemplary aspects there may be a second textile material 6010 positioned adjacent to the textile material 6000. The second textile material may comprise a material permeable to air such as, for example, a mesh material. This configuration facilitates airflow between an outer surface and inner surface of an apparel item formed from the textile material 6000 while helping to maintain the structural integrity of the textile material 6000 and while providing a degree of modesty to apparel items formed from the textile material 6000. The structure shown in FIG. 43 may be located on an apparel item in areas that experience a high degree of air flow or air pressure. Exemplary locations may comprise, for instance, the front portions of an apparel item (e.g., along the central front torso area of a top). The structure depicted in FIG. 43 is exemplary only, and it is contemplated herein that alternative configurations may be used. Any and all aspects, and any variations therefor, are contemplated as being within aspects herein.

Figure 44:
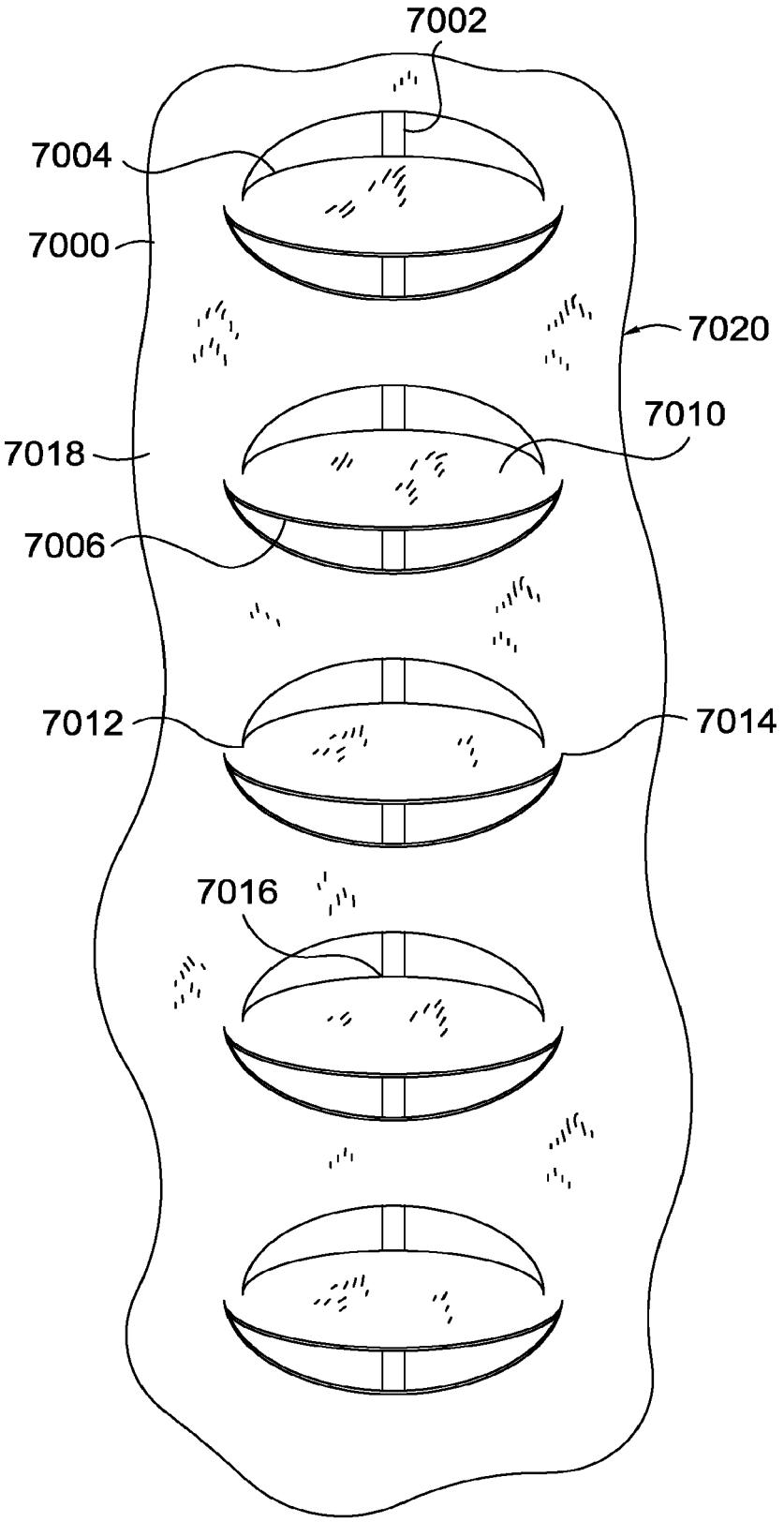
FIG. 44 illustrates an exemplary textile material comprising a flap that is affixed to a second textile material in accordance with aspects herein.

FIG. 44 illustrates yet another exemplary textile configuration in accordance with aspects herein. FIG. 44 comprises a first textile material 7000 and a second textile material 7002. The first textile material 7000 comprises a first surface 7020 and a second surface 7018 opposite the first surface 7020. In exemplary aspects, the first surface 7020 of the textile material 7000 may comprise an inner-facing surface of an apparel item formed from the textile material 7000, while the second surface 7018 of the textile material 7000 may comprise an outer-facing surface of the apparel item. The first textile material 7000 may further comprise a plurality of flaps 7010 that have been incised or formed from the first textile material 7000. Each flap 7010 may comprise a first edge 7004 and a second edge 7006 (seen en face) opposite the first edge 7004. Additionally, each flap 7010 comprises a first end 7012 extending from the textile material 7000 and a second end 7014 opposite the first end 7012 extending from the textile material 7000.

Continuing, the second textile material 7002 may be positioned adjacent to the first surface 7020 of the first textile material 7000. In exemplary aspects, the second textile material 7002 may comprise an expanse of material. In other exemplary aspects, and as shown in FIG. 44, the second textile material 7002 may comprise a strip of material. Using a strip of material may help in making apparel items formed from the textile materials 7000 and 70002 lightweight and more breathable. The first edge 7004 of each flap 7010 may be affixed to the second textile material 7002 at attachment points 7016. The attachment of the first edge 7004 of the flaps 7010 to the second textile material 7002 biases the flaps 7010 to an open state which facilitates air flow between an inner and outer surface of an apparel item incorporating the textile configuration shown in FIG. 44. The textile configuration shown in FIG. 44 may be located on an apparel item in areas that experience a high degree of air flow or air pressure. Exemplary locations may comprise, for instance, the front portions of an apparel item (e.g., along the central front torso area of a top). The structure depicted in FIG. 44 is exemplary only, and it is contemplated herein that alternative structures may be used. Any and all aspects, and any variations thereof, are contemplated as being within aspects herein.

Directional Pleats and Seams

Apparel items described herein may utilize directional pleats and seams to create stand-off when the seams and/or pleats are positioned on an inner-facing surface of the apparel item. When positioned on an outer-facing surface of the apparel item, the directional seams and pleats may be utilized to direct air flow over the apparel item. For instance, they may be used to direct air flow to an opening or venting structure in the apparel item where it can be channeled into the apparel item.

Figure 31:
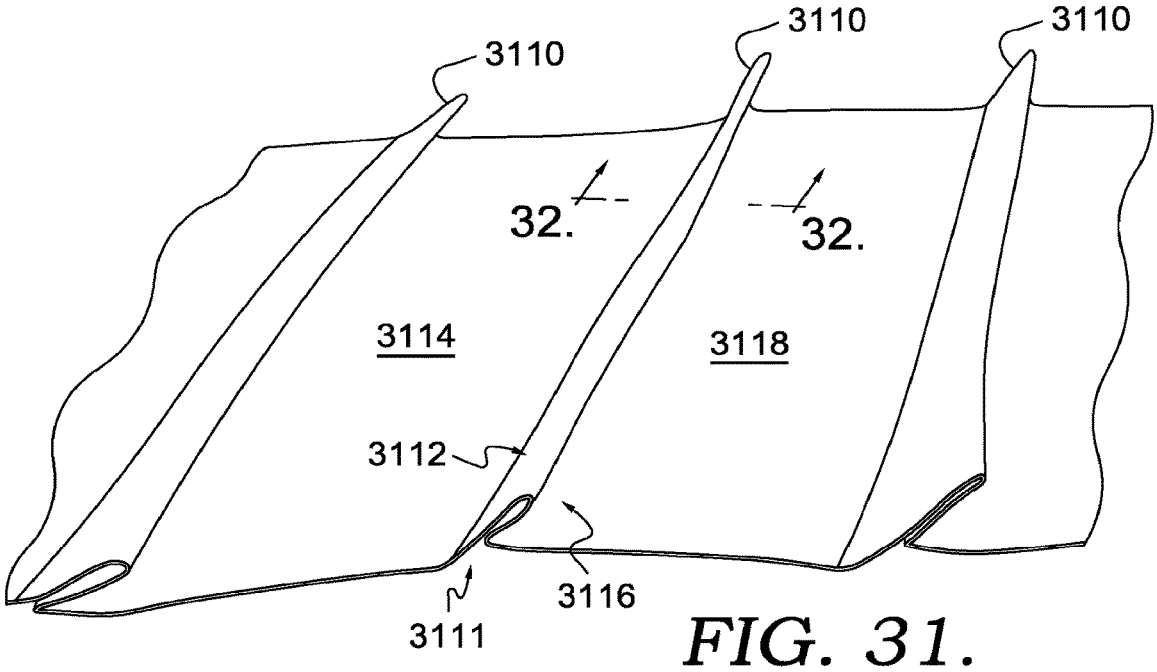
FIG. 31 illustrates an exemplary directional seam configured to be incorporated into an apparel item in accordance with aspects herein.

FIG. 31 depicts a perspective view of an exemplary textile having directional seams 3110 in accordance with aspects herein. In exemplary aspects, a directional seam, such as directional seam 3111 may be formed by affixing a first edge 3112 of a first panel of material 3114 to a first edge 3116 of a second panel of material 3118 such that the edges 3112 and 3116 extend in the z-direction with respect to the surface plane of the first and second panels of material 3114 and 3118 along the length of the seam 3111.

Figure 32:
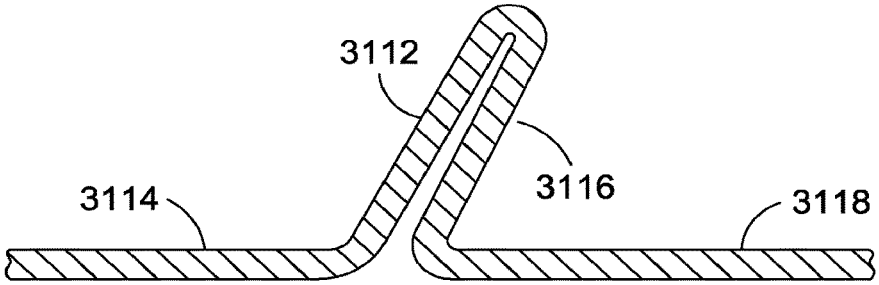
FIG. 32 illustrates a cross-sectional view of the exemplary directional seam of FIG. 31 taken along cut line 32-32 in accordance with aspects herein.

FIG. 32 depicts a cross-sectional view of the directional seam 3111 taken along cut line 32-32 of FIG. 31 in accordance with aspects herein. As shown, the first edge 3112 of the first panel of material 3114 may be folded over the first edge 3116 of the second panel of material 3118. The two edges 3112 and 3116 may be coupled together using, for instance, stitching, bonding, adhesives, and the like. Further, as shown, the two edges 3112 and 3116 are in a non-planar relationship with the surface planes of the remaining portions of the first and second panels of material 3114 and 3118. The depiction of the seam 3111 in FIG. 32 is exemplary only, and it is contemplated herein that the first edge 3112 of the first panel of material 3114 may not overlap the first edge 3116 of the second panel of material 3118, or that the first edge 3116 of the second panel of material 3118 overlaps the first edge 3112 of the first panel of material 3114. Any and all aspects, and any variation thereof, are contemplated as being within aspects herein.

Figure 33:
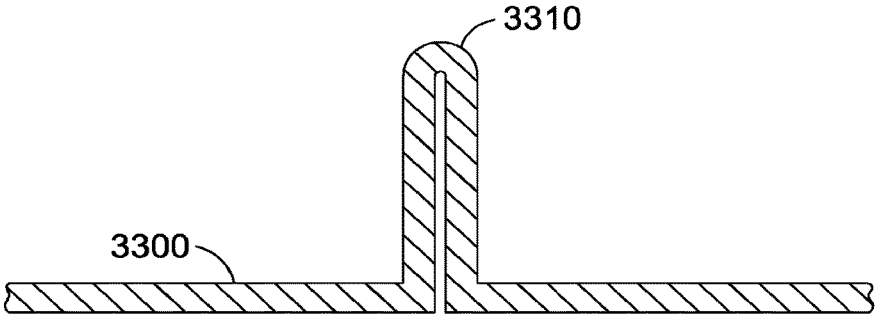
FIG. 33 illustrates an exemplary directional pleat configured to be incorporated into an apparel item in accordance with aspects herein.

Instead of a directional seam, such as the seam 3111, directional pleats may also be formed and used in exemplary apparel items described herein. For example, FIG. 33 depicts a cross-sectional view of a directional pleat 3310 formed on a textile 3300 in accordance with aspects herein. In this aspect, the textile 3300 is folded to create the pleat 3310. Facing sides of the pleat 3310 may be affixed together such that the pleat 3310 extends in a z-direction with respect to the surface plane of the textile 3300.

When incorporated into an apparel item, the directional seams and/or pleats may be positioned on an inner-facing surface of the apparel item to provide stand-off from the wearer's body surface. For example, similar to the stand-off nodes discussed above, the directional seams or pleats may be configured to have a height between 2.5 mm to 6 mm to create a space through which air can effectively circulate and cool the wearer. Moreover, the directional seams or pleats may also help to reduce the perception of cling when positioned on the inner-facing surface of the apparel item. The directional pleats or seams may be positioned at various locations on the inner-facing surface of the apparel item in accordance with aspects herein. For instance, when configured to provide stand-off, the pleats or seams may be positioned in areas of the garment that are positioned adjacent to high heat-producing areas of the wearer such as the chest or back area. In another example, when configured to reduce the perception of cling, the pleats or seams may be positioned along the sides of the apparel item. Any and all aspects, and any variation thereof, are contemplated as being within aspects herein.

Figure 34:
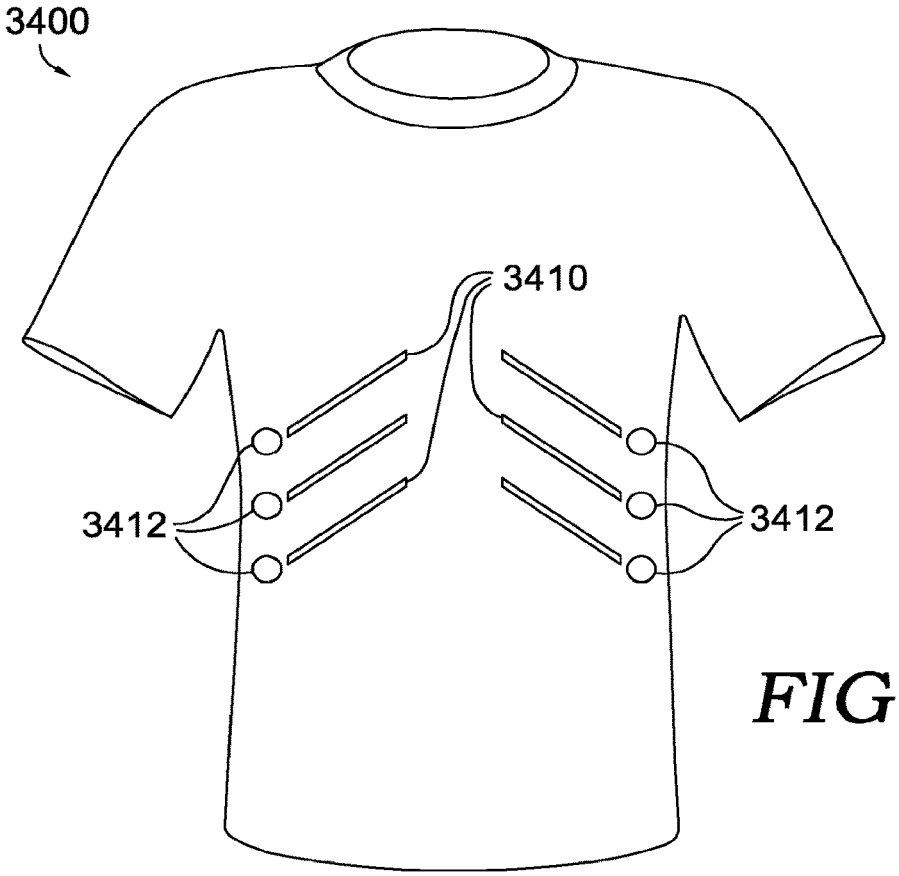
FIG. 34 illustrates an exemplary apparel item incorporating a directional pleat or seam in accordance with aspects herein.

The directional seams or pleats may also be positioned on an outer-facing surface of the apparel item such as shown in FIG. 34. FIG. 34 illustrates an apparel item 3400 having a plurality of directional seams/pleats 3410 positioned over the front of the apparel item 3400. The positioning of the directional seams/pleats 3410 may be based on air flow maps of the human body. In one exemplary aspect, the directional seams/pleats 3410 may be used to guide air flowing over the front of the apparel item 3400 to venting structures 3412 positioned along the sides of the apparel item 3400. Although perforations are shown as the venting structures 3412, it is contemplated herein that any of the venting structures discussed herein may be used. The location and configuration of the directional seams/pleats 3410 and the venting structures 3412 shown in FIG. 34 is exemplary only and other locations and configurations are contemplated as being within aspects herein.

As described, the directional pleats or seams may be used to create stand-off when positioned on the inner-facing surface of the apparel item, and may be used to direct air flow when positioned on the outer-facing surface of the apparel item.

Molded Structures

Apparel items described herein may use molded structures to create stand-off, openness as well as to act as venting structures. In exemplary aspects, the molded structures may be formed utilizing the fabric that forms the apparel item. In other aspects, the molded structures may comprise a trim piece that is incorporated into the apparel item. At a high level, the molded structure may comprise an open framework having projections that extend away from, for example, an outer-facing surface of the apparel item (i.e., extend in a positive z-direction) and projections that extend away from an inner-facing surface of the apparel item (i.e., extend in a negative z-direction). In aspects, the projections that extend away from the outer-facing surface of the apparel item may act as venting structures, and the projections that extend away from the inner-facing surface of the apparel item may provide stand-off. Moreover, the open framework of the structure may help to increase the percent openness of the apparel item.

Figure 35:
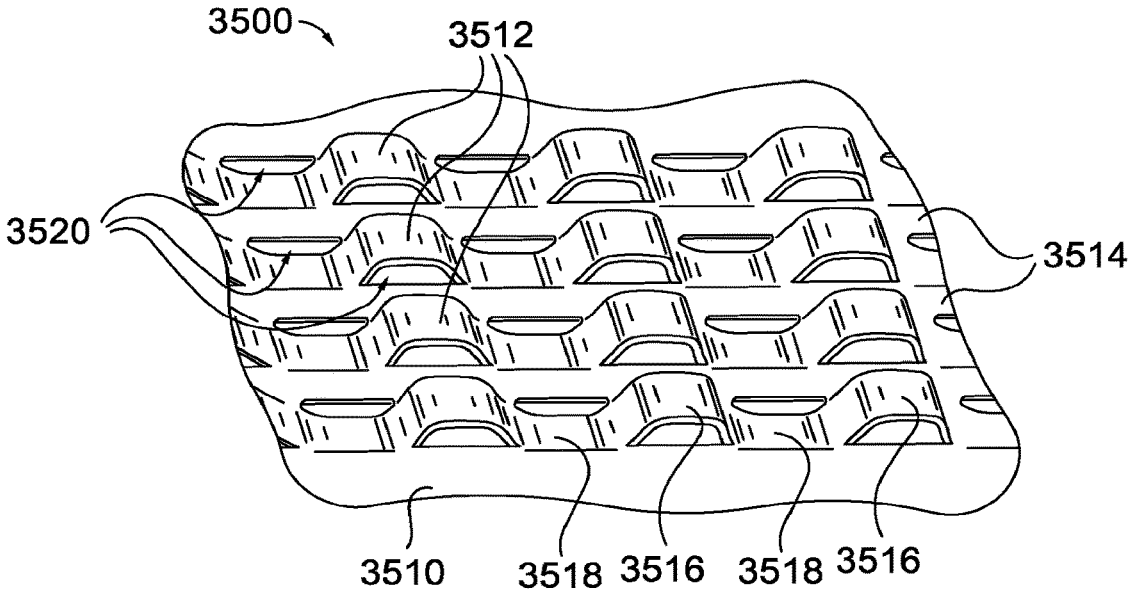
FIG. 35 illustrates an exemplary molded structure configured to be incorporated into an apparel item in accordance with aspects herein.

An exemplary molded structure is depicted in FIG. 35 and is referenced generally by the numeral 3500. In one exemplary aspect, the molded structure 3500 may be formed from a textile 3510 using a molding process such as a heat-molding process. For instance, the textile 3510 may be formed, at least in part, from fiber, filaments, or yarns that are heat settable or moldable. For example, the textile 3510 may be formed in whole or in part from thermoplastic polyurethane (TPU) yarns that partially melt when subjected to heat and re-set when cooled. In one exemplary aspect, rows of TPU yarns may be knit or woven into the textile 3510 in parallel courses. The textile 3510 may then be incised or cut to form openings (discussed below), where the direction of the TPU courses may be along the incision path. The textile 3510 may then be heat molded to partially melt the TPU yarns. In another exemplary aspect, the molded structure 3500 may be formed from a polyurethane film and then incorporated into the textile 3510 using, for instance, stitching, bonding, adhesives, and the like.

Continuing, in an additional example, the molded structure 3500 may be formed by using an additional textile layer and affixing that layer to the textile 3510 using an adhesive film. The composite textile may then cut using, for instance, a laser, and then molded using positive and negative molds. In yet another example, the textile 3510 may comprise a "dryfire" fabric (i.e., a flame retardant fabric) that changes from a pliable fabric to a semi-rigid fabric when exposed to heat. A molding process may be used to apply heat to the textile 3510 in order to form the molded structure 3500.

In one exemplary aspect, the molded structure 3500 comprises a first series of parallel courses 3512 that alternate with a second series of parallel courses 3514, where the courses 3512 are generally not affixed to the courses 3514. Each course 3512 comprises a first set of projections 3516 that extend away from a first surface of the textile 3510, and a second series of projections 3518 that extend away from a second opposite surface of the textile 3510. In other words, the projections 3516 extend in, for instance, a positive z-direction while the projections 3518 extend in a negative z-direction (or vice versa). In exemplary aspects, for a particular course 3512, the projections 3516 alternate with the projections 3518. In exemplary aspects, the courses 3514 do not comprise projections. In other words, the courses 3514 are in a planar relationship with the surface plane of the textile 3510 while the courses 3512 are in a generally non-planar relationship with the surface plane of the textile 3510. Because of the configuration of the first and second courses 3512 and 3514 (e.g., one being in a planar relationship with the surface plane of the textile 3510 and the other being in a non-planar relationship with the textile 3510), openings 3520 are formed by the projections 3516 extending away from the first surface of the textile 3510 and the projections 3518 extending away from the second surface of the textile 3510.

When incorporated into an apparel item, the first surface of the textile 3510 may comprise an outer-facing surface of the apparel item, and the second surface of the textile 3510 may comprise an inner-facing surface of the apparel item. As such, the projections 3516 would extend outwardly from the apparel item, and the projections 3518 would project inwardly (i.e., toward a body surface of a wearer when the apparel item is worn). Thus, the projections 3516 may act as venting structures helping to capture air traveling over the apparel item and funneling the air into the apparel item via, for example, the openings 3520. This action may be enhanced by the scoop-like configuration of the projections 3516. The projections 3518, in exemplary aspects, may act to create stand-off between the apparel item and the wearer's body surface. Thus, in exemplary aspects, the projections 3518 may be configured to have a height between 2.5 mm and 6 mm. Moreover, the openings 3520 may contribute to the percent openness of the apparel item. The configuration of the molded structure 3500 is exemplary only and it is contemplated herein that other molded structures may be used Textile Yarn Manipulation Apparel items described herein may be formed of a textile or material having yarns that have been mechanically manipulated to create dimension in the z-direction in order to, for instance, create stand-off and/or to direct air flow. In other words, yarns in selected areas of the textile may be manipulated to extend away from the surface plane of the textile. This may be accomplished by, for instance, a weaving process, a knitting process, a braiding process, a twisting process, a looping process, and the like. The manipulated yarns may take the form of discrete nodes, one or more linear or curvilinear segments, and the like. Additionally, or alternatively, the yarns may also be mechanically manipulated to form holes that may act to increase the percent openness of the apparel item.

In exemplary aspects, the mechanically manipulated yarns may comprise performance yarns such as yarns configured to wick or transport moisture away from the body surface of the wearer. Reactive or adaptive yarn may also be used where the adaptive yarn dimensionally transforms when exposed to stimuli such as water, sweat, moisture, heat, and the like. Activation of the yarn may cause the yarn to swell or elongate thereby increasing dimension or height in the z-direction. Upon removal of the stimulus, the adaptive yarn may transition back causing a reduced dimension in the z-direction. This may be useful for dynamically altering the presence and/or height of the mechanically manipulated yarns in response to different training and/or weather conditions. For example, sweat, heat or moisture generated by the wearer when exercising or when in hot conditions may cause the mechanically manipulated yarns to reach a predetermined height. However, when resting or when exercising in cooler conditions, the yarns would not be activated or may be activated to only a small extent (e.g., activated to have a height of 2 mm or less) to decrease dimension in the z-direction.

Once the textile is formed into the apparel item, the mechanically manipulated yarns that create dimension in the z-direction may be positioned on an inner-facing surface of the apparel item to provide, for example, stand-off between the apparel item and the wearer's body surface and/or to reduce cling. In exemplary aspects, the yarns may be manipulated to achieve a stand-off height between 2.5 mm and 6 mm. When located on the inner-facing surface of the apparel item, the mechanically manipulated yarns may be positioned at the center front, center back, or along the sides of the apparel item to provide stand-off and/or to reduce cling in these areas The mechanically manipulated yarns may also be positioned on an outer-facing surface of the apparel item in order to, for example, direct air that is flowing over the apparel item. For instance, when the manipulated yarns take the form of one or more linear segments, the segments may be positioned on the apparel item such that they direct air flow to one or more vent structures. This is similar to the directional pleats/seams discussed above with respect to FIG. 34.

Pleat Structures

Apparel items described herein may utilize pleat structures to provide stand-off, direct air flow, and/or to increase the percent openness of the apparel item. In exemplary aspects, the pleat structures may expand and contract in response to the presence or absence of tensioning forces produced by the wearer. In exemplary aspects, the expansion of the pleat structure may expose holes or openings in the pleat structure to increase the percent openness of the apparel item.

Figure 36A:
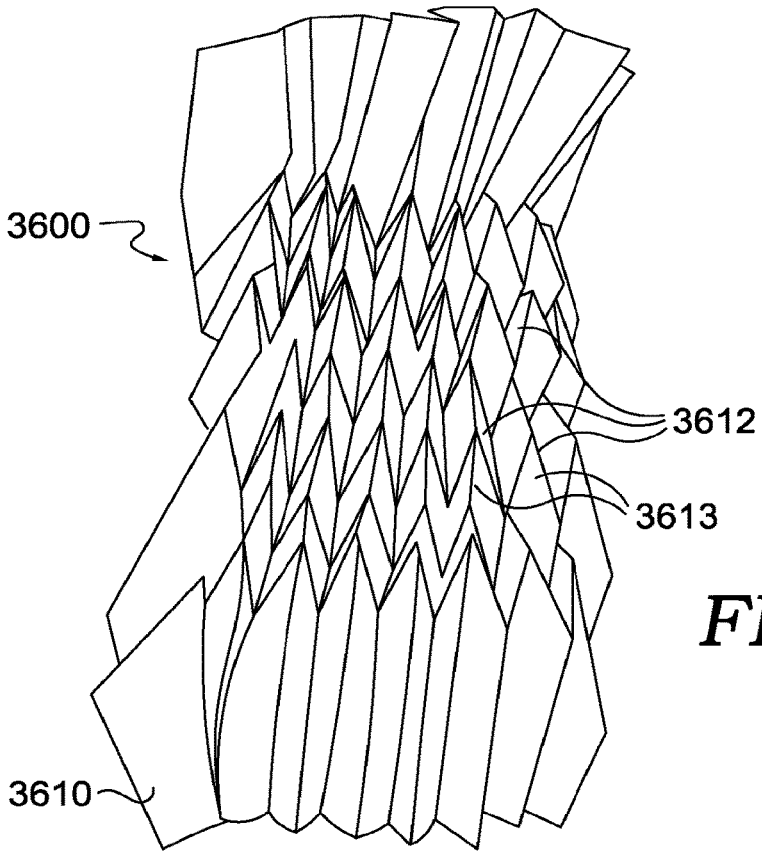
FIG. 36A illustrates an exemplary pleat structure in a resting state where the pleat structure is configured to be incorporated into an apparel item in accordance with aspects herein.
Figure 36B:
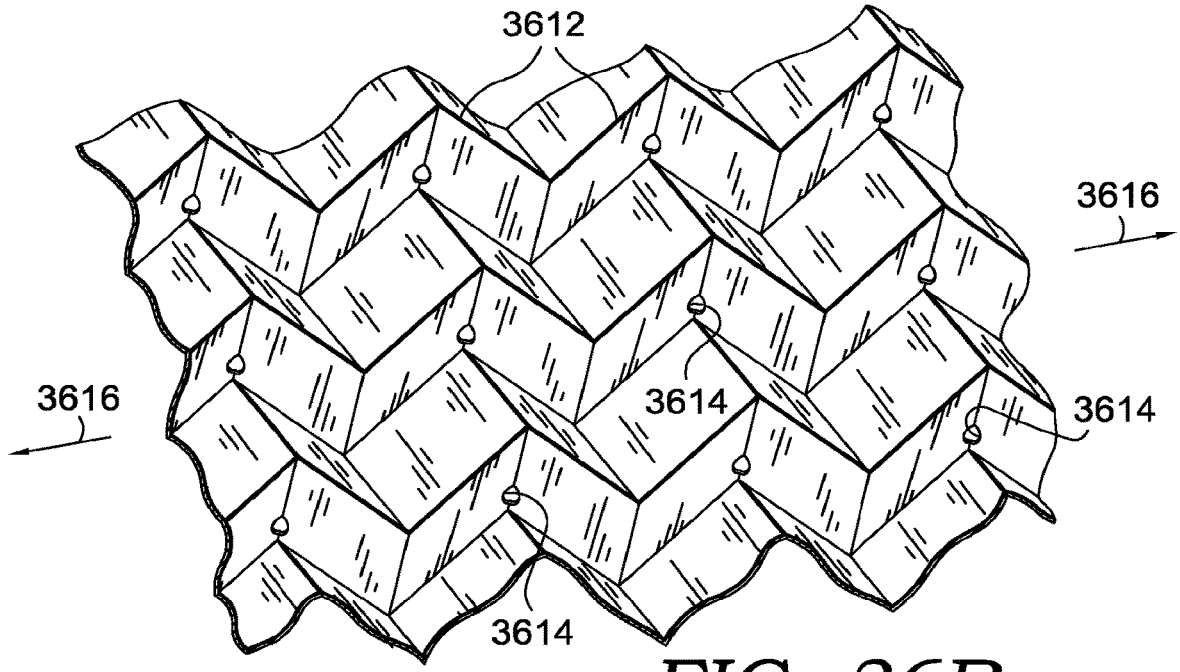
FIG. 36B illustrates the exemplary pleat structure of FIG. 36A in a tensioned state in accordance with aspects herein.

An exemplary pleat structure 3600 is shown in FIGS. 36A and 36B in accordance with aspects herein. The pleat structure 3600 is shown in a resting or non-tensioned state in FIG. 36A and in a tensioned state in FIG. 36B. In general, the pleat structure 3600 is formed by folding a textile 3610 to create a plurality of folds 3612 that are positioned adjacent to one another on the textile 3610. In exemplary aspects, the textile 3610 may comprise a trim piece that is incorporated into the apparel item, or the textile 3600 may be used to form the apparel item. Continuing, spaces 3613 are formed between adjacent folds 3612. The folds 3612 may be heat set such that they maintain their shape during use. So that the heat setting is more effective, the textile 3610, or portions thereof, may be formed of synthetic fibers such as polyester or nylon. As shown, each fold 3612 extends away from the surface plane of the textile 3610 (i.e., extends in the z-direction).

FIG. 36B depicts a view of the pleat structure 3600 after tensioning forces (indicated by arrows 3616) are applied to the textile 3610. As shown, the folds 3612 are pulled apart (pulled in the direction of the tensioning forces 3616) to expose optional perforations 3614 located between the folds 3612.

When located on an inner-facing surface of an apparel item, the folds 3612 may produce stand-off from a wearer's body surface. When in an un-tensioned state, such as would occur when the wearer is resting or has not started exercising, the spaces 3613 between the folds 3612 may help to trap warmed air produced by the wearer helping to keep the wearer warm. When in a tensioned state such as would occur when the wearer has begun exercising, the area of stand-off created by the folds 3612 is increased and may provide a sufficient space for air to effectively circulate and cool the wearer by, for example, promoting evaporative cooling. Moreover, the exposure of the perforations 3614 when the textile 3610 is in the tensioned state may increase the percent openness of the apparel item and facilitate air flow between the environment outside of the apparel item and the interior of the apparel item. Any and all aspects, and any variation thereof, are contemplated as being within aspects herein.

When located on an outer-facing surface of an apparel item, the pleat structure 3600 may help direct air flowing over the surface of the apparel item. For instance, when the pleat structure 3600 is in a tensioned state, such as shown in FIG. 36B, the air may flow along the folds 3612 and be directed to the perforations 3614.

In both instances, whether located on the inner-facing surface or the outer-facing surface of an apparel item, the pleat structure 3600 may help to increase the stretch characteristics of the apparel item when worn. For example, the inherent stretch associated with the gathered material of the pleat structure 3600 may be used to provide increased stretch at areas of the apparel item prone to high degrees of movement.

Tension Deformation

Tension Deformation generally relates to the process of applying tension to a textile material, applying (and curing when needed) a surface treatment to the textile material while in the tensioned state, and releasing the tension. The surface treatment helps to maintain the textile material in the tensioned state in the areas where it is applied. This process may be used to create, for example, stand-off and venting structures. Exemplary textile materials and apparel items that have undergone tension deformation are depicted in FIGS. 45, 46, 48, 49, and 50.

As used throughout this disclosure, the term "tensioned state" means a textile material that is stretched to between 110% to 180%, 120% to 170%, 130% to 160%, or 140% to 150% of its original length (original length may also be described as a textile's length in a resting or non-tensioned state). Stretch may be measured along the textile's lengthwise grain, crosswise grain, and/or bias grain. Another way to describe this is by stating that stretch may be measured in the warp direction or the weft direction. One exemplary way to measure the stretch of the textile material is to stretch the textile material along its warp direction until it cannot be stretched any further (i.e., until lockout). The final stretched length is divided by the textile material's original length to determine the percent stretch. The same process can be carried out for stretch in the weft direction. As an example, a fabric that stretches from 58.5 cm to 73.5 cm in the warp direction would have 25.6% stretch. The percent stretch measured at lockout may correspond to the maximum allowable stretch in the stretch direction (warp or weft) for the specific textile material being tested. However, since different textile materials may be formed with different yarns and/or by different manufacturing methods, the percent stretch may vary for each textile material.

Figure 51:
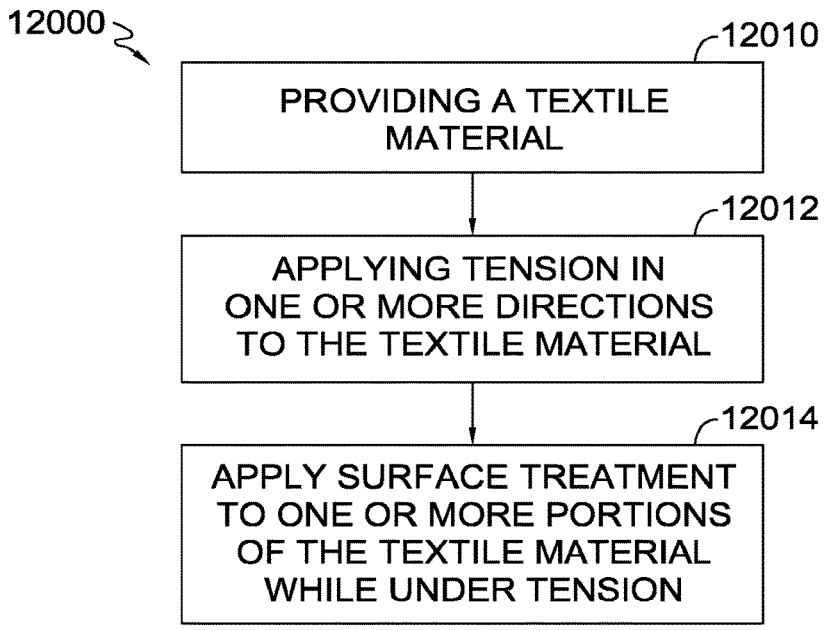
FIGS. 51-52 illustrate flow diagrams of exemplary methods of creating tension deformation in a textile material in accordance with aspects herein.

FIG. 51 depicts a first exemplary process 12000 for creating tension deformation in a textile material in accordance with aspects herein. To begin the process 12000, a textile material is provided at step 12010. The textile material may comprise a panel of material that is knit, woven, or non-woven. In exemplary aspects, the textile material may exhibit a low degree of stretch in response to normal tensioning forces generated by, for example, a wearer wearing an apparel item formed from the textile material. For example, the textile material may be formed without use of elastic yarns such as Spandex, Lycra, elastane and the like. However, it is also contemplated herein that the textile material may exhibit some degree of stretch (2-way or 4-way) due to, for example, the presence of Spandex, Lycra, elastane, and the like. Any and all aspects, and any variation thereof, are contemplated as being within the scope herein.

Tension is then applied to the textile material in one or more directions at step 12012. The tension applied to the textile material may be in an x-direction (e.g., lengthwise grain) and a y-direction (e.g., crosswise grain) or only in the x-direction or y-direction. Stretch may also be applied along the bias grain of the textile. To describe it another way, tension may be applied in the weft direction, the warp direction, in both the weft and warp direction, or in a direction offset from the weft and warp direction. As will be explained more fully below, a number of different tension-maintaining apparatuses may be used to apply tension to the textile material. In one exemplary aspect, tension may be applied to the textile material until lockout is achieved (i.e., no further stretch is possible without tearing or breaking the fabric). In other words, the tension applied to the textile material is just below the material's breaking strength. However, it is contemplated herein that tension may be applied that is less than the textile material's lockout point. Any and all aspects, and any variation thereof, are contemplated as being within aspects herein. As stated above, tension may be applied to stretch the textile material to 110%, 120%, 130%, 140%, 150%, 160%, 170%, or 180% of the textile material's resting or original length.

At step 12014, a surface treatment is applied to one or more portions of the textile material while the textile material is maintained under tension. Surface treatments may include, for example, silicone, thermoplastic polyurethane, polyurethane, polyurethane resin inks, other elastomeric materials, and the like. Further, the surface treatment may comprise additives to impart functional benefits to the surface treatment. Exemplary additives may comprise reflective materials, cooling materials such as xylitol, and the like. Application of the surface treatment may be by a number of methods such as screen printing, 3-D printing, film transfers, additive manufacturing, heat transfers, and the like. The surface treatment may be applied to the textile material in a number of different shapes or configurations. Further, the surface treatment may be applied to the textile material in a variable pattern or repeating pattern. Additionally, more than one layer of the surface treatment may be applied to the portions of the textile material. It is contemplated herein that the amount of tension applied to the textile material, the direction in which the tension is applied, the shape configuration of the applied surface treatment, and/or the number of layers of the surface treatment may all or individually be controlled or adjusted to achieve a specific tension deformation effect as described below.

The process 12000 may further comprise a curing step where the textile material is cured after application of the surface treatment. The curing step occurs while the textile material is maintained under tension. Curing may occur through, for example, heat, application of ultra-violet light, and the like. Once the surface treatment has been cured, the tension applied to the textile material may be released. Following the release of tension, steam may be applied to the textile material to promote the return of portions of the textile material to their original or resting state and decrease deformation of the textile material. A result of the process 12000 is that portions of the textile material to which the surface treatment has been applied and cured under tension are maintained in a tensioned state (i.e., in a stretched state) while other portions of the textile material to which the surface treatment was not applied return to their original or resting length or state. In other words, the application and curing of the surface treatment while the textile material is under tension helps to "lock" or fix the stretched yarns, fibers, and/or filaments in a stretched state.

In an optional aspect, one or more openings may be formed in the textile material in locations that correspond to where the surface treatment was applied. In other words, openings may be formed in the textile material at portions of the textile material that are maintained in a tensioned state through the application of the surface treatment. This may occur, for example, through laser cutting, mechanical cutting, water jet cutting, ultrasonic cutting, and the like to form openings in the textile material that promote air flow. In exemplary aspects, the openings may be formed after the tension has been released. In an alternate aspect, the openings may be formed while the textile material is under tension.

As mentioned, to create tension, the textile material may be positioned on a tension-maintaining apparatus that is configured to apply and maintain a predetermined amount of tension to the textile material. The tension-maintaining apparatus used may be any apparatus on which the textile material may be positioned, and tension can be applied and maintained on the textile material throughout the tension deformation process. In general, the tension-maintaining apparatuses contemplated herein are configured to be adjustable to one or more lengths, widths, or circumferences (when the tension-maintaining apparatus is circular). Depending on the known length, width, and/or circumference of a particular tension-maintaining apparatus, and depending on the textile material's particular percent stretch at lockout, an undersized portion of the textile material is positioned on the apparatus. In other words, to avoid the situation where the textile material stretches further than the known length, width, and/or circumference of the tension-maintaining apparatus, the textile material is cut or formed to have a length, width, and/or circumference less than the known length, width, and/or circumference of the tension-maintaining apparatus. To describe it yet another way, the fabric is cut or formed so that it can be stretched to its maximum percentage stretch when positioned in the tension-maintaining apparatus.

Figure 53:
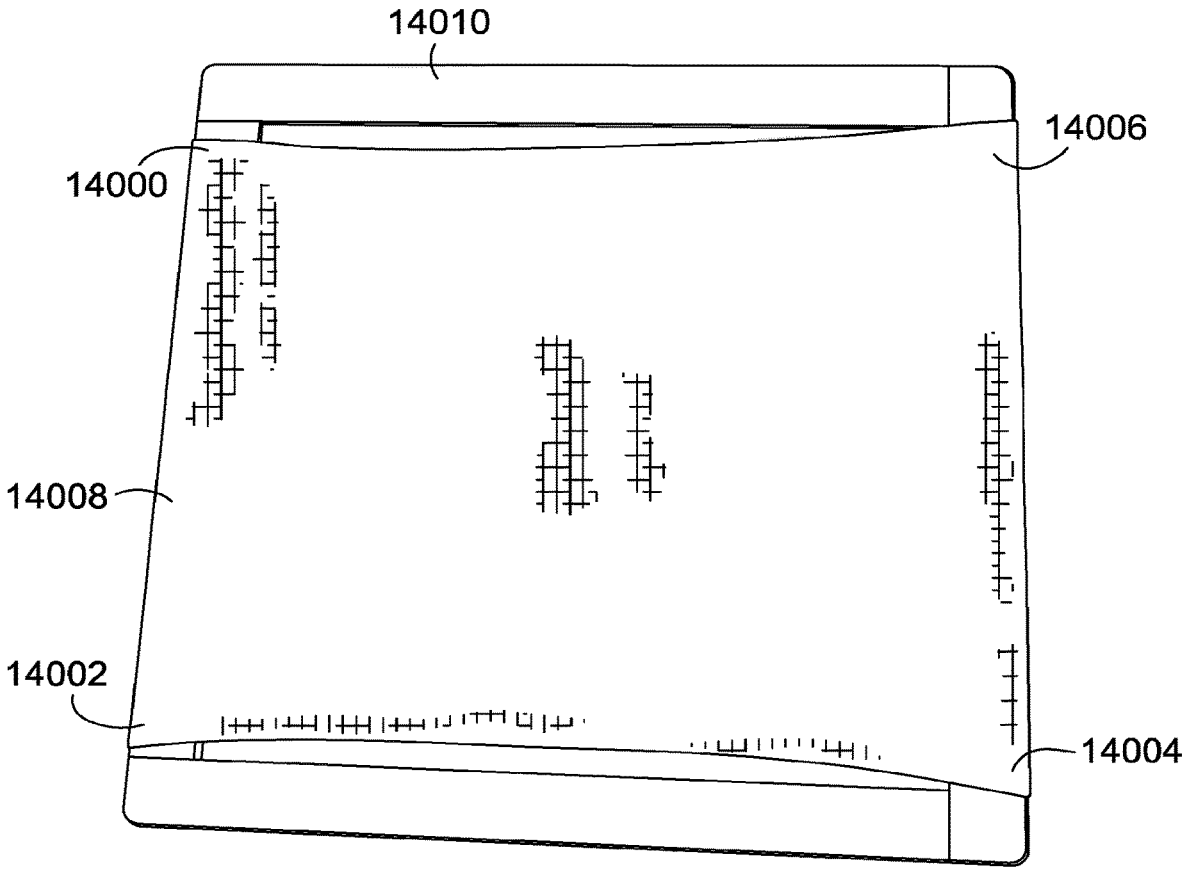
FIG. 53 illustrates an exemplary tension-maintaining apparatus in accordance with aspects herein.
Figure 54:
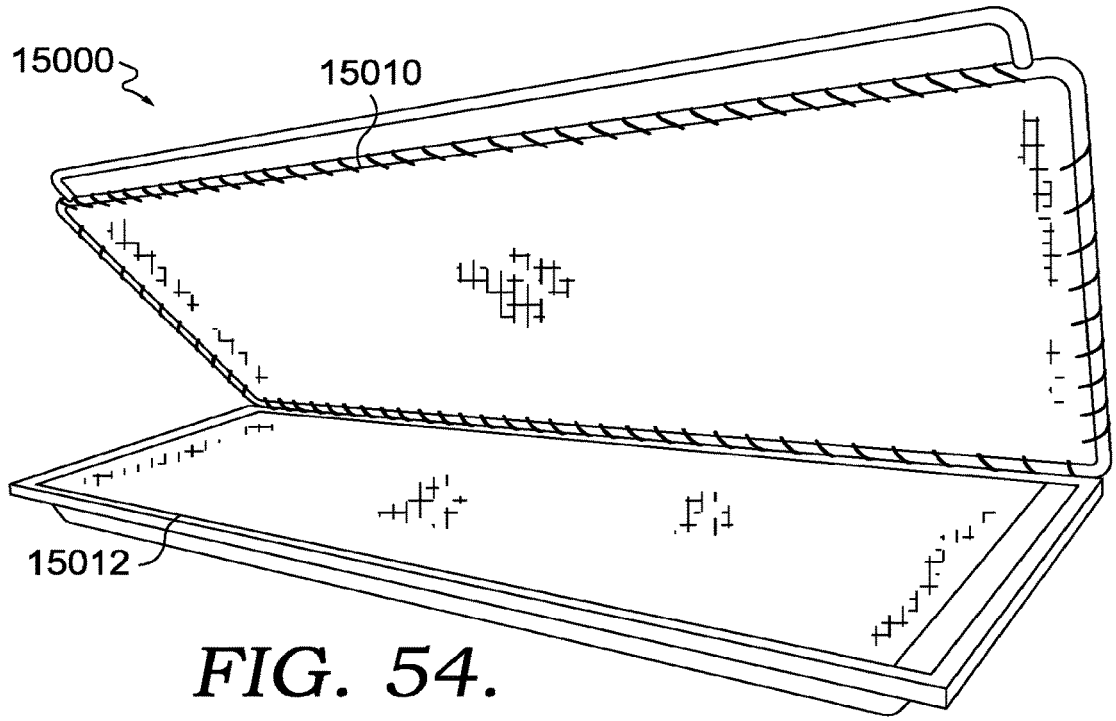
FIG. 54 illustrates another exemplary tension-maintaining apparatus in accordance with aspects herein.

In one configuration, the tension-maintaining apparatus may be a jig which holds the textile material throughout the tension deformation process as described with respect to FIG. 51. The textile material may be secured to the jig through various methods, including for example, being sewn onto the jig, being attached to the jig via clamps, being secured in a jig frame, and the like. FIGS. 53 and 54 illustrate two exemplary tension-maintaining apparatuses. In FIG. 53, a textile material 14008 has been secured to a flat frame-shaped tension-maintaining apparatus 14010. In one example, this may be accomplished by forming pockets or tunnels at opposing sides of the textile material 14008, and inserting rods into the pockets. Once the textile material 14008 has been secured to the tension-maintaining apparatus 14010, tension may be applied to the textile material 14008 in the x-direction, the y-direction, or both directions. The structure depicted in FIG. 53 is exemplary only, and it is contemplated herein that alternative configurations may be used. Any and all aspects, and any variations therefor, are contemplated as being within aspects herein In another example, and as shown in FIG. 54, a tension-maintaining apparatus 15000 may comprise two halves 15010 and 15012 where the two halves 15010 and 15012 are hinged along one side (e.g., shaped like a clam shell). The tension-maintaining apparatus 15000 may be made out of metal or any other material which will maintain its structure throughout the tension deformation process and maintain the textile material under tension. A textile material may be attached to the side edges of the two halves 15010 and 15012 via, for instance, clamps, sewing, and the like. To apply tension, the two halves 15010 and 15012 are opened, which stretches the textile material and creates tension that is maintained throughout the tension deformation process. The structure depicted in FIG. 54 is exemplary only, and it is contemplated herein that alternative configurations may be used. Any and all aspects, and any variations thereof, are contemplated as being within aspects herein.

Additional examples of tension-maintaining apparatuses contemplated herein include a flat frame that telescopes to create length. In this example, the textile material would be affixed to the flat frame at the resting length. Then, the tension-maintaining device would be expanded to create tension on the textile material. Another example includes a three-dimensional structure (rectangular, cylindrical, and the like). In this aspect, the textile material would be formed into a tubular structure and drawn over the three-dimensional structure to create tension in the textile material. Yet another example includes a jig having a circular frame useable to simultaneously apply tension in the warp direction, weft direction, and in directions offset from the warp and weft directions (along the bias grain). Additional examples of tension-maintaining apparatuses are contemplated herein.

In addition to maintaining tension on the textile material, it is contemplated that the tension-maintaining apparatuses described herein may be configured to allow for registration between locations where the surface treatment is applied to the textile material and locations where one or more openings in the textile material are formed. In other words, the tension-maintaining apparatus may be configured to be transferable from one step in the process, such as application of the surface treatment to the textile material while under tension, to a subsequent step, such as laser cutting while maintaining registration of the locations to where the surface treatments are applied and locations where the openings are to be formed. The tension-maintaining apparatus 14010 of FIG. 53 demonstrates an example of a tension-maintaining apparatus that is configured to allow for registration. For example, the four corners, 14000, 14002, 14004, and 14006 of the tension-maintaining apparatus 14010 may be used to register the textile material 14008 for multiple steps, such as application of the surface treatment under tension followed by laser cutting. This may occur by positioning one or more of the four corners 14000, 14002, 14004, and 14006 in relation to a fixed reference point during the processing steps thereby maintaining the textile material in a uniform position during multiple processing steps. Additionally, the tension-maintaining apparatus 14010 may be flipped or inverted from one step to the next, and one or more of the corners 14000, 14002, 14004, and 14006 may be positioned in relation to the fixed reference point thereby allowing processing steps to be carried out on the opposing surface of the textile material while maintaining registration between the different locations on the textile material to which the surface treatment is being applied and/or where the openings are being formed.

Figure 52:
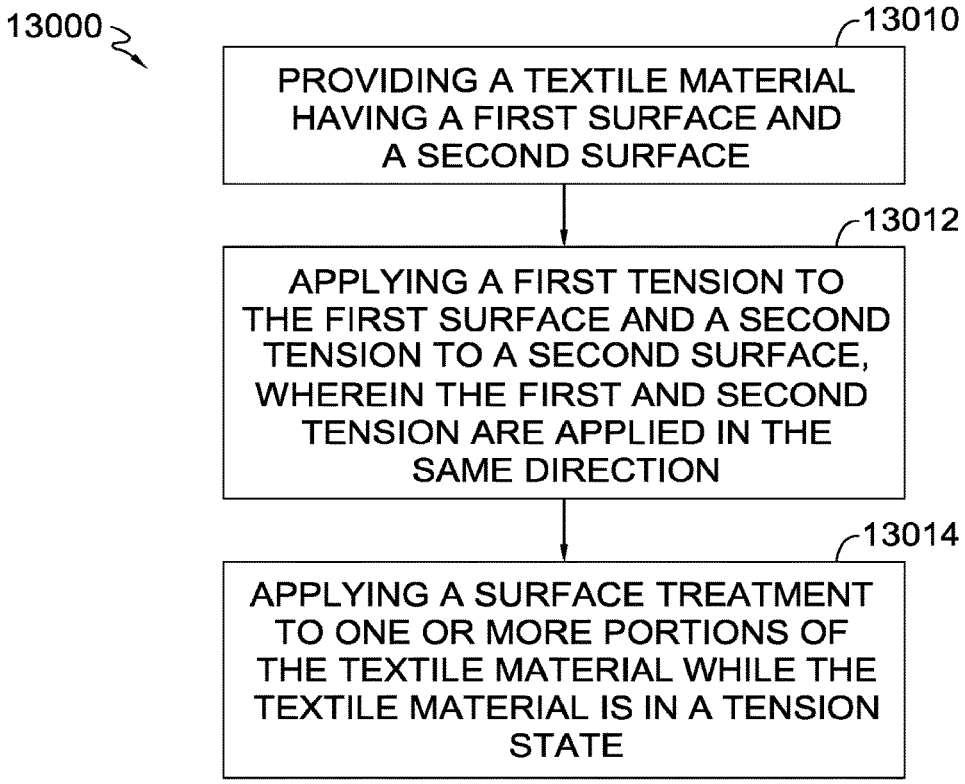

Tension deformation is also contemplated to occur through a second process 13000 as described in FIG. 52. It is contemplated herein that the process 13000 may be carried out at a manufacturing facility that manufactures textile materials. A textile material, having a first surface and a second surface is provided at step 13010. The textile material may have similar properties as the textile material described in relation to the process 12000. Following this, a first tension is applied to the first surface and a second tension is applied to the second surface at step 13012. The first tension and second tension may be applied in the same direction and at the same time. In one exemplary aspect, the first and second tensions may be applied, for example, by rollers acting on opposing surfaces of the textile material. In this aspect, the rollers move or rotate in the same direction at varying speeds, creating a first and second tension on the opposing surfaces of the textile material.

Continuing, at step 13014, a surface treatment is applied to one or more portions of the textile material while the textile material is maintained under tension. Additionally, similar to the first tension deformation process described with respect to FIG. 51, after receiving the surface treatment, the textile material may be cured to set or fix the surface treatment. One or more openings may also be formed in the textile material in locations that correspond to where the surface treatment was applied (i.e., in areas maintained under tension). This may be carried out, for example, utilizing laser cutting, mechanical cutting, and the like to form a desired pattern of openings in the textile material. The openings may be formed while the textile material is under tension or after the tension has been released. These tension deformation processes described are merely examples and any and all aspects, and any variations thereof are contemplated as being within aspects herein.

The tension deformation processes described herein result in the formation of textile materials having first portions and second portions, where the first portions are maintained in a tensioned state via the application of the surface treatment and the second portions are in a tension-free or resting state (i.e., a state where the yarns, fibers, and/or filaments within the second portions are at their resting length). To describe it another way, the first portions may be maintained at a predetermined level of stretch greater than the textile material's resting length, and the second portions are at the textile material's resting length.

Figure 45:
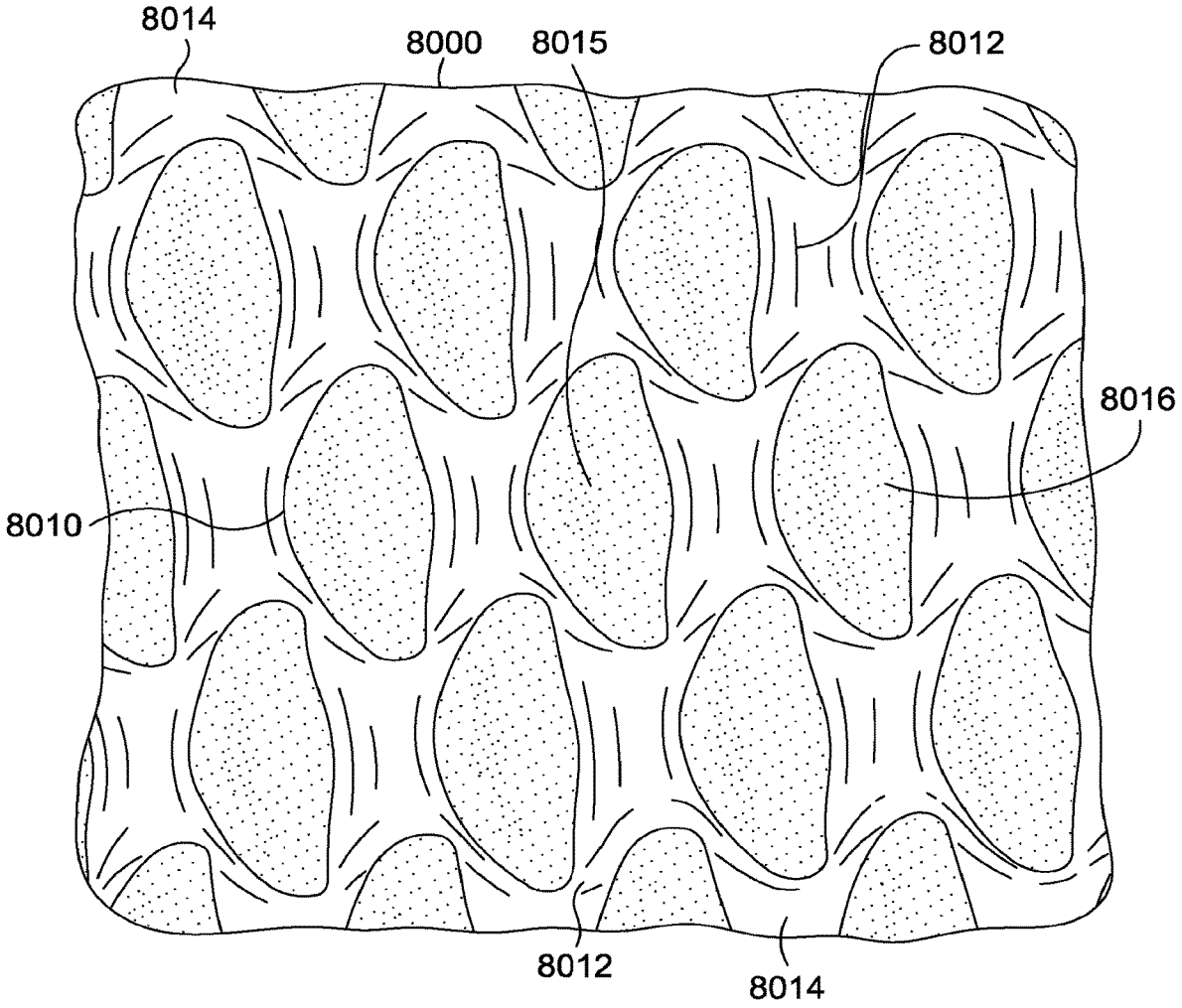
FIG. 45 illustrates a plan view of an exemplary textile material having a plurality of stand-off structures generated through a tension deformation process in accordance with aspects herein.

For example, FIG. 45 shows a first surface of a textile material 8000 which has undergone a tension deformation process in accordance with aspects herein. A surface treatment 8016 was applied under tension to multiple disparate first portions 8010 of the textile material 8000 causing the first portions 8010 to be maintained in a tensioned or stretched state after the surface treatment has been cured. The first portions 8010 maintained in the tensioned state are separated from each other by second portions 8014 which are in a non-tensioned or resting state. The positioning of the tensioned or stretched first portions 8010 adjacent to the non-tensioned or non-stretched second portions 8014 produces a deformation or "wrinkling" 8012 in the textile material 8000 resulting in a plurality of raised portions or stand-off structures 8015. To describe it a different way, the first portions 8010 are maintained between 110-160% stretch due to the surface treatment, and the second portions 8014 are in a non-stretched state due to an absence of the surface treatment. When the textile material 8000 is incorporated into an apparel item, the stand-off structures created through the tension deformation process may be positioned on an inner-facing surface of the apparel item where they help to facilitate airflow between an inner surface and an outer surface of the apparel item when the apparel item is worn. The structures depicted in FIG. 45 are exemplary only, and it is contemplated herein that alternative configurations may be used. Any and all aspects, and any variations thereof, are contemplated as being within aspects herein.

Figure 50:
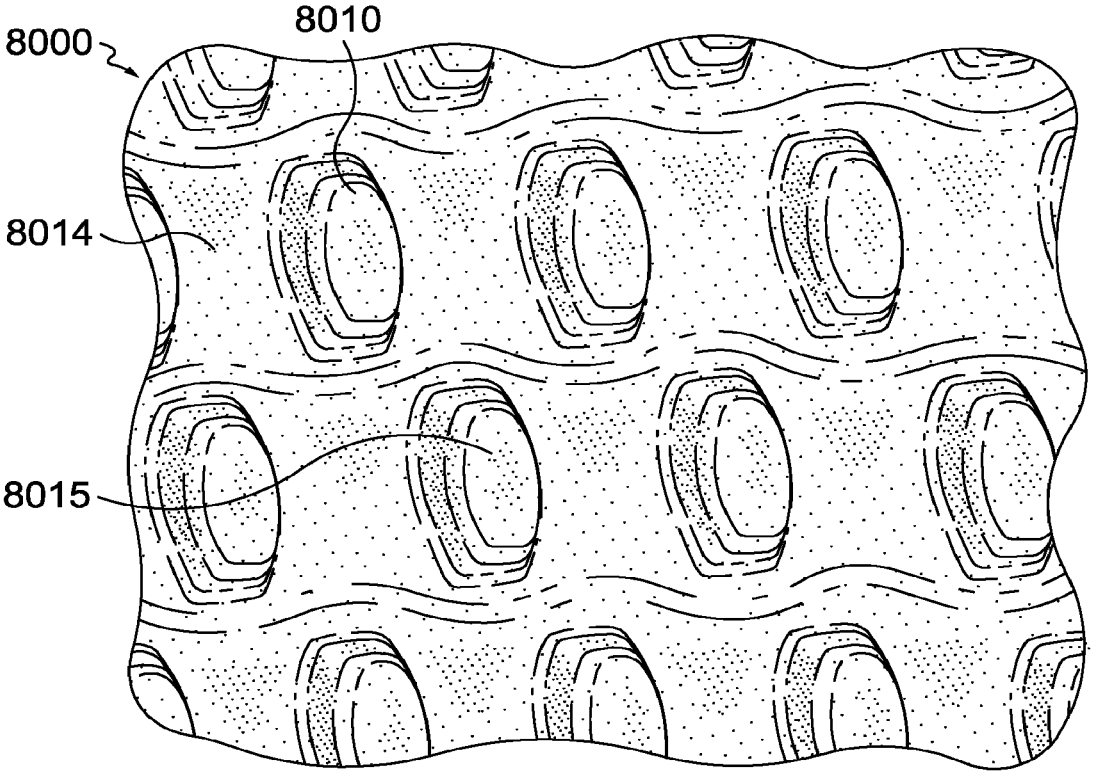
FIG. 50 illustrates a perspective view of the exemplary textile material of FIG. 45 in accordance with aspects herein.

FIG. 50 illustrates a perspective view of the first surface of the textile material 8000 in accordance with aspects herein. In FIG. 50, the creation of the stand-off structures 8015 on the first surface of the textile 8000 (shown in FIG. 45) is better shown. As described, the positioning of the tensioned first portions 8010 adjacent to the non-tensioned second portions 8014 creates the stand-off structures 8015. The stand-off structures 8015 extend in a z-direction with respect to the surface plane of the textile material 8000. When the textile material 8000 is incorporated into an apparel item, the stand-off structures 8015 provide a space between the apparel item and the wearer's body surface in which air can effectively circulate and cool the wearer. While the stand-off structures 8015 are described as being positioned on the inner-facing surface of an apparel item, the stand-off structures 8015 may also be located on an outer-facing surface of an apparel item. The structures depicted in FIG. 50 are exemplary only, and it is contemplated herein that alternative configurations may be used. Any and all aspects, and any variations thereof, are contemplated as being within aspects herein.

Figure 46:
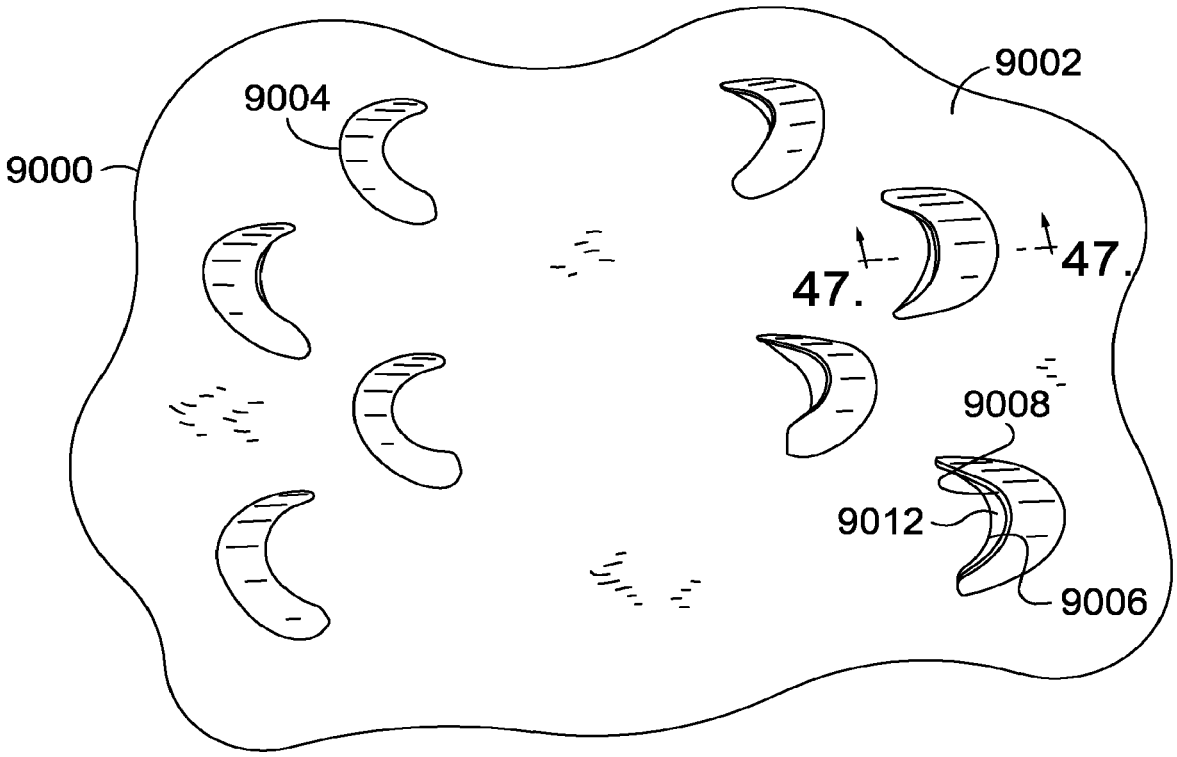
FIG. 46 illustrates another exemplary textile material comprising a first and second portion, wherein the first portion is maintained in a tensioned state in accordance with aspects herein.

FIG. 46 illustrates another exemplary textile material 9000 that has undergone a tension deformation process in accordance with aspects herein. The textile material 9000 comprises a plurality of first portions 9004 and a plurality of second portions 9002. In this example, the plurality of first portions 9004 are maintained in a tensioned state via the application of a surface treatment which, for example, may be a film. The second portions 9002 are in a tension-free resting state. In exemplary aspects, slit edges 9006 and 9008 are made and define an opening 9012 in the textile material 9000 in areas where the surface treatment has been applied (i.e., at the first portions 9004). Because of the juxtaposition of the first portions 9004 (tensioned state) and the second portions 9002 (non-tensioned state), the first portions 9004 extend away from the surface plane of the textile material 9000 (e.g., extend in the z-direction) to form stand-off structures as described above. Thus, the combination of the stand-off structures formed by the application of a surface treatment to the textile material 9000 while in a tensioned state and the openings such as opening 9012, creates vent structures configured to help channel air from a first surface to a second surface of the textile material 9000. The process of tension deformation enables the creation of a plurality of openings that may be strategically located on the textile material 9000.

Continuing with respect to FIG. 46, the plurality of first portions 9004 that are maintained in a tensioned state may have a generally arched shape due at least in part to the shape configuration of the applied surface treatment. Although shown in an arched shape, it is contemplated herein that the plurality of first portions 9004 may comprise other shapes, such as, for example, circles, squares, diamonds, ovals, and the like. Moreover, it is contemplated that the shape of the plurality of first portions 9004 may be formed or shaped to reflect a company's brand or logo.

Figure 47:
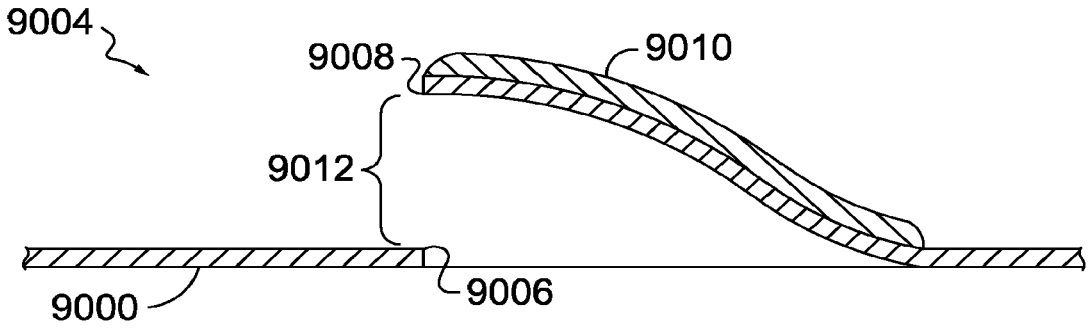
FIG. 47 illustrates a cross-section view of the exemplary textile material of FIG. 46 taken at cut line 47-47 in accordance with aspects herein.

FIG. 47 depicts a cross-section of an exemplary first portion 9004 of the textile material 9000 taken along cut line 47-47 in accordance with aspects herein. A surface treatment 9010 has been applied to the textile material 9000 while the textile material 9000 is under tension. When the surface treatment 9010 is applied to the first portion 9004 while under tension, the textile material 9000 in that location is biased to form a stand-off structure. The addition of the slit edges 9006 and 9008 creates a vent or opening 9012 which facilitates airflow between the outer and inner surfaces of the textile material 9000.

Figure 48:
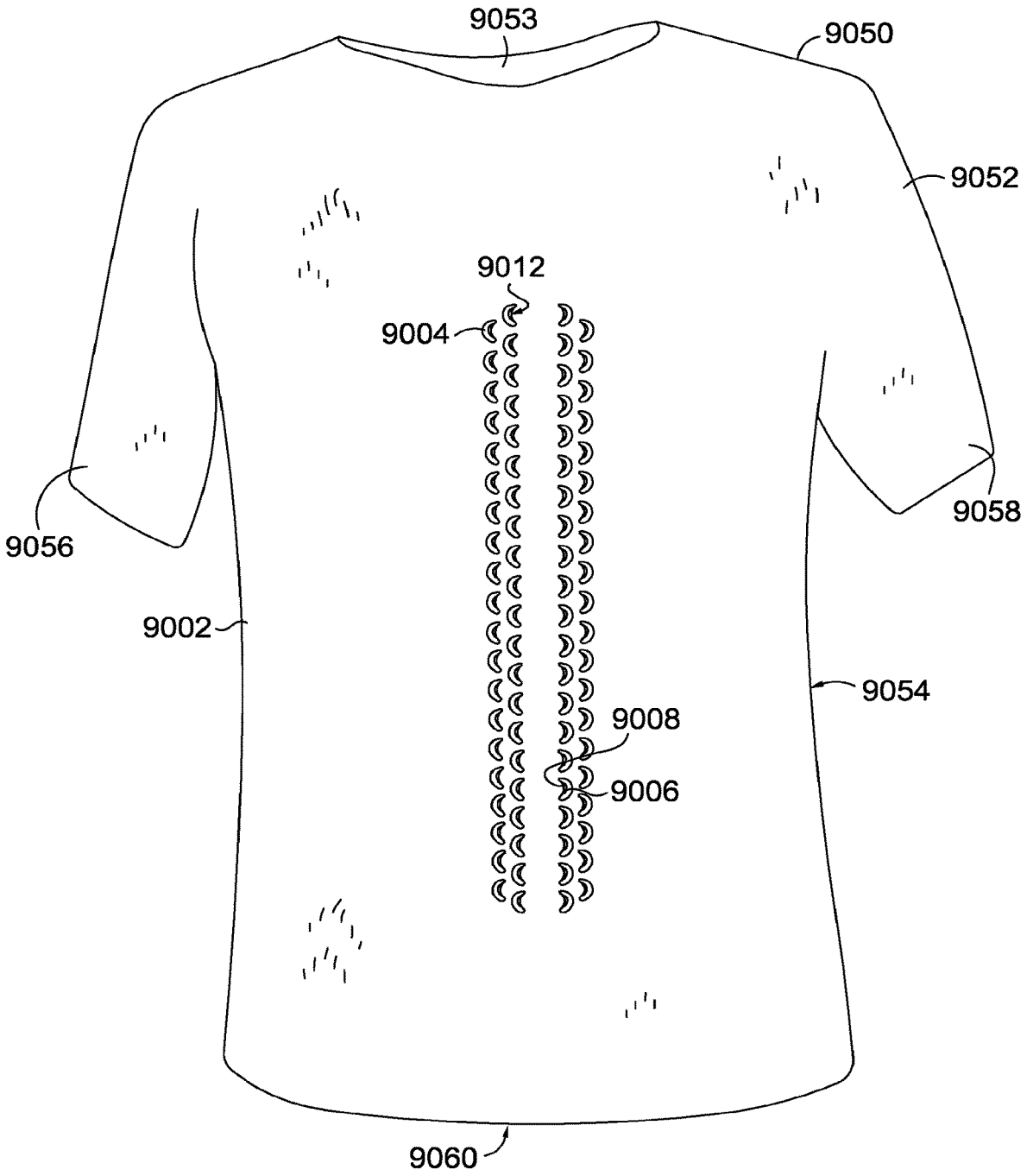
FIG. 48 illustrates a front view of an exemplary apparel item comprising a first and second portion, wherein the first portion is maintained in a tensioned state in accordance with aspects herein.

An apparel item 9050 that incorporates the textile material 9000 is shown in FIG. 48, which depicts a front view of the apparel item 9050. The apparel item 9050 has multiple vents or openings 9012 in accordance with aspects herein. In exemplary aspects, the apparel item 9050 may comprise a front panel 9052 and a back panel 9054, that together help define at least in part a neckline opening 9053, and a waist opening 9060. The apparel item 9050 may further comprise a first sleeve 9056 and a second sleeve 9058. Although the apparel item 9050 is described as having a front panel 9052 and a back panel 9054, it is contemplated herein that the apparel item 9050 may be formed from a unitary panel (e.g. through a circular knitting, flat knitting or weaving process) or from one or more additional panels affixed together at one or more seams. While the apparel item 9050 in FIG. 48 is depicted as a shirt with sleeves, it is contemplated that the apparel item 9050 may take the form of a sleeveless shirt, a shirt with a cap or one-quarter sleeves, a shirt having full-length sleeves, three-quarter sleeves, a jacket, a hoodie, a zip-up shirt or jacket, pants, shorts, socks, a hat, and the like. Any and all aspects and any variation therefore, are contemplated as being within the scope herein. The plurality of first portions 9004 may be aligned by column and/or row as shown in the apparel item 9050 depicted in FIG. 48 or the plurality of first portions 9004 may be randomly located on the front 9052 and back 9054 panels of the apparel item 9050. Additionally, the plurality of first portions 9004 may be arranged in bands or zones over the front, back, sides or shoulder areas of the apparel item 9050. In these configurations, the plurality of first portions 9004 may act as venting structures located to optimize opportunities for capturing and channeling air flowing over the front, back, and/or sides of the apparel item 9050. Any and all aspects, and any variation thereof, are contemplated as being within the scope herein.

As shown in FIG. 48, the apparel item 9050 comprises a plurality of first portions 9004 maintained in the tensioned state, while the second portions 9002 are in a resting or non-stretched state. The slit edges 9006 and 9008 extend through the front panel 9052 such that they form a fluid communication path between the environment outside the apparel item 9050 and the interior of the apparel item 9050. The location of the openings 9012 may be based on air flow maps and air pressure maps that may indicate that these portions of the apparel item 9050 experience a high (or higher) degree of air flow (or air pressure) as opposed to other areas of the apparel item 9050. As such, the openings 9012 may act as inflow vents. Although shown with relatively small-sized openings, it is contemplated herein that the openings 9012 may vary in size. The configuration depicted in FIG. 48 is exemplary only, and it is contemplated herein that alternative configurations may be used. Any and all aspects, and any variations thereof, are contemplated as being within aspects herein.

Figure 49:
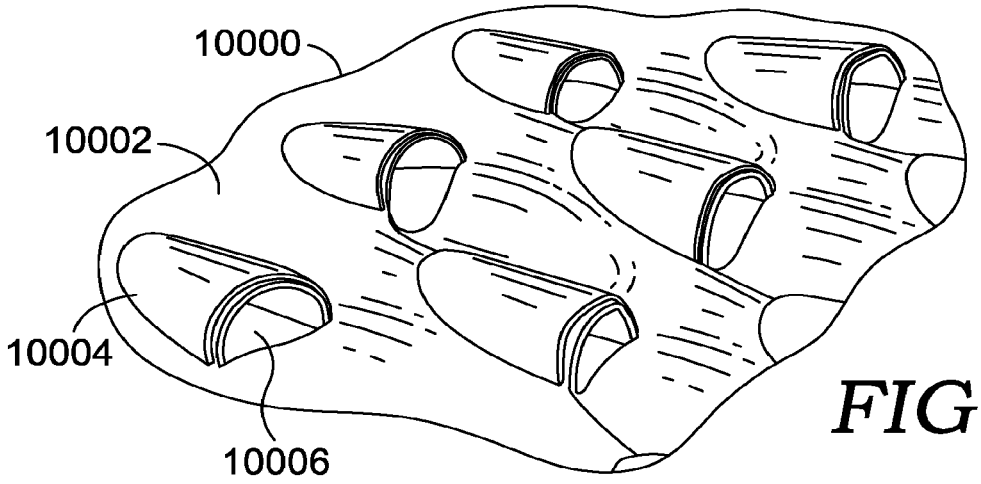
FIG. 49 illustrates an alternate configuration for an exemplary textile material that has vent structures generated through a tension deformation process in accordance with aspects herein.

FIG. 49 depicts yet another alternative configuration for textile material 10000 that has undergone the tension deformation process in accordance with aspects herein. In FIG. 49, the textile material 10000 comprises a plurality of first portions 10004 maintained in a tensioned state and second portions 10002 that are in a tension-free or resting state. Openings 10006 may be formed at the first portions 10004 through which air may flow from a first surface to a second surface of the textile material 10000. In this particular example, the shape of the applied surface treatment creates a longer more tunnel-like opening which may be useful in directing air flowing through the textile material 10000. It is contemplated that additional configurations for textile portions and apparel items that have undergone a tension deformation process may be used herein. The structure depicted in FIG. 49 is exemplary only, and it is contemplated herein that alternative configurations may be used. Any and all aspects, and any variations thereof, are contemplated as being within aspects herein.

As described, the tension deformation process may be useful for creating stand-off structures and/or vent structures in an apparel item to achieve a predetermined level of airflow through the apparel item and to help cool the wearer by promoting evaporative heat transfer. Moreover, the portions of the apparel item which are maintained under tension via the application of a surface treatment may be strategically located at portions of the apparel item that are exposed to high airflow, which may help to capture and funnel air into the apparel item where the air may facilitate evaporative heat transfer.

CONCLUSION

Aspects herein provide for an apparel item that utilizes a variety of different structures and features to provide stand-off, openness, and venting structures to achieve thermo-regulation over a wide range of conditions. The features and structures described herein may be utilized in isolation or in any combination to achieve these characteristics. When utilized, the features and/or structures may help the athlete maintain temperatures within an optimal range with resulting benefits in athletic performance.

What is claimed is:

1. An apparel item comprising:

a textile material having a first portion and a second portion, wherein the first portion comprises a surface treatment that biases the first portion in a tensioned state and wherein the second portion is maintained in a tension-free resting state, and a slit positioned directly adjacent the first portion and between the first portion and the second portion, the slit comprising an opening extending through the textile material, wherein along the slit the first portion extends away from a surface plane of the textile material to form a stand-off structure.

2. The apparel item of claim 1, wherein the surface treatment is a film.

3. The apparel item of claim 1, wherein the stand-off structure and the opening comprises a vent configured to channel air from a first surface to a second surface of the textile material.

4. The apparel item of claim 1, wherein a position associated with the vent is based on one or more of air flow maps and air pressure maps.

5. The apparel item of claim 1, wherein the apparel item is an upper-torso garment and the first portion is positioned on a back panel of the upper-body garment.

* * * * *